US006082470A

United States Patent [19]

Webb et al.

[11] Patent Number: 6,082,470

[45] **Date of Patent: *Jul. 4, 2000**

[54] DIRECTIONAL DRILLING SYSTEM AND APPARATUS

[75] Inventors: Charles T. Webb, 8050 John Henry, Burleson, Tex. 76028; Roy L. Chandler, Arlington, Tex.

[73] Assignee: Charles T. Webb, Burleson, Tex.

[ * ] Notice: This patent is subject to a terminal disclaimer.

[21] Appl. No.: 09/326,795

[22] Filed: Jun. 4, 1999

Related U.S. Application Data

[63] Continuation-in-part of application No. 09/093,747, Jun. 8, 1998, Pat. No. 5,957,222.

[60] Provisional application No. 60/049,283, Jun. 10, 1997.

[51] Int. Cl.[7] ..... E21B 7/06

[52] U.S. Cl. ..... 175/45; 175/74

[58] Field of Search ..... 175/45, 61, 62, 175/73, 74, 75, 76, 38, 19; 340/853.4

[56] References Cited

U.S. PATENT DOCUMENTS

| | | | |
|---|---|---|---|
| 3,042,125 | 7/1962 | Duncan . | |
| 3,043,381 | 7/1962 | McNeely, Jr. . | |
| 3,363,704 | 1/1968 | Farris et al. . | |
| 3,617,865 | 11/1971 | Hakata . | |
| 3,630,295 | 12/1971 | Coyne . | |
| 4,076,084 | 2/1978 | Tighe . | |
| 4,281,723 | 8/1981 | Edmond et al. . | |
| 4,416,339 | 11/1983 | Baker et al. . | |
| 4,732,223 | 3/1988 | Schoeffler et al. . | |
| 4,895,214 | 1/1990 | Schoeffler . | |
| 4,953,638 | 9/1990 | Dunn . | |
| 5,423,388 | 6/1995 | Hale . | |
| 5,458,208 | 10/1995 | Clarke . | |
| 5,469,155 | 11/1995 | Archambeault et al. . | |
| 5,490,569 | 2/1996 | Brotherton et al. . | |
| 5,957,222 | 9/1999 | Webb et al. ..... | 175/45 |

*Primary Examiner*—William Neuder
*Attorney, Agent, or Firm*—Arthur F Zobal

[57] ABSTRACT

The apparatus, in one embodiment has guide housing with a shaft extending through the guide housing with a drill bit coupled to its forward end. The shaft may be moved to a forward drilling position or to a rearward shifting position relative to the guide housing. A cam is located inside of the guide housing. A cam follower is coupled to the shaft. In the shifting mode, the cam follower is disengaged from the cam. A clutch is provided for coupling the cam to the shaft when the shaft is in the shifting position such that the cam follower may be rotated with the shaft relative to the cam to allow the cam follower to engage the cam when the shaft is moved to the forward drilling position. In the forward drilling position of the shaft, the clutch release the cam from the shaft and the cam follower engages the cam to allow straight drilling to occur or to cause the axis of said guide housing to shift relative to the axis of the shaft to cause the direction of drilling by the shaft and drill bit to change.

44 Claims, 38 Drawing Sheets

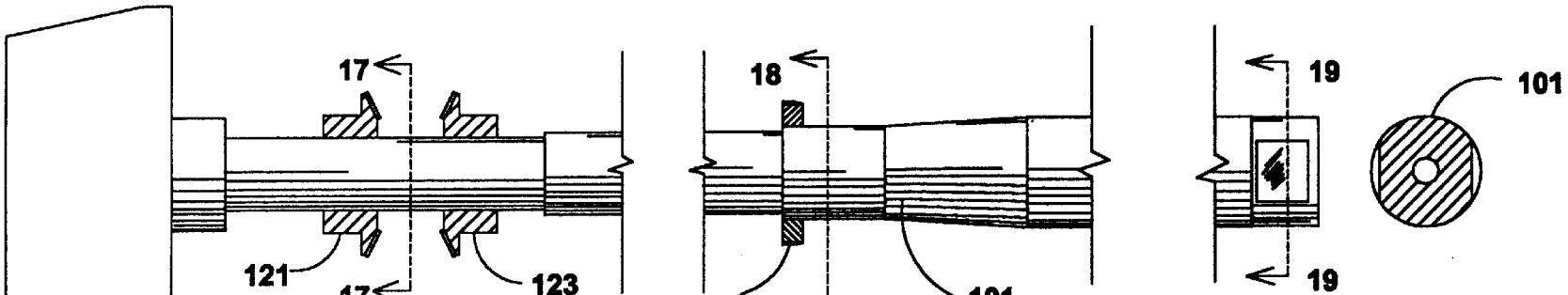
FIG. 19
FIG. 16
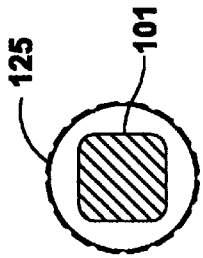
FIG. 18
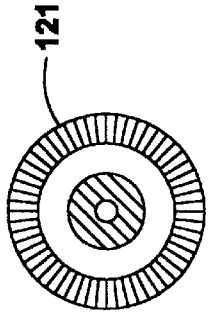
FIG. 17
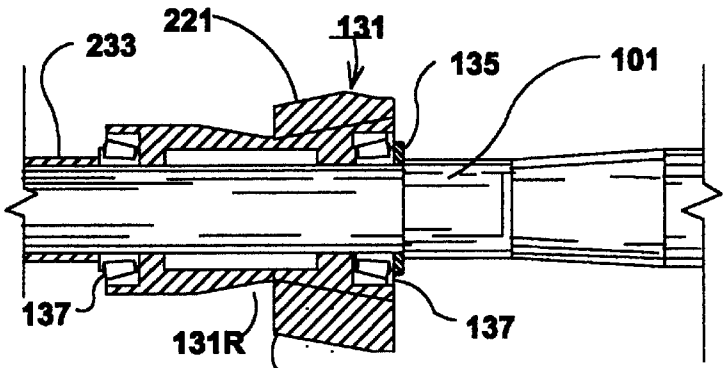
FIG. 20

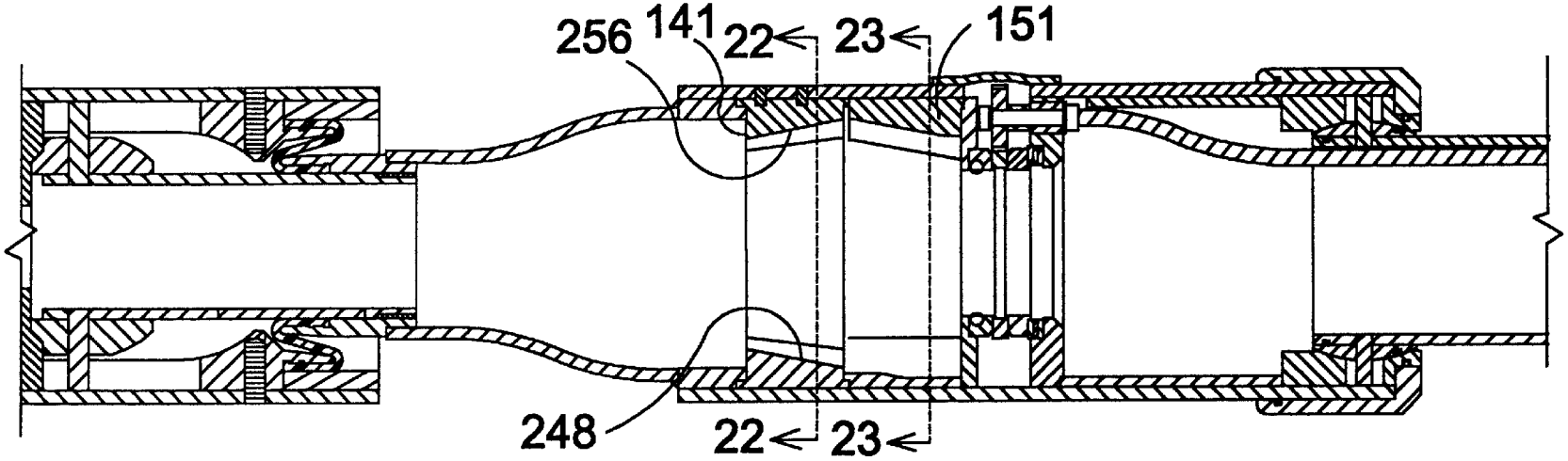
FIG. 21
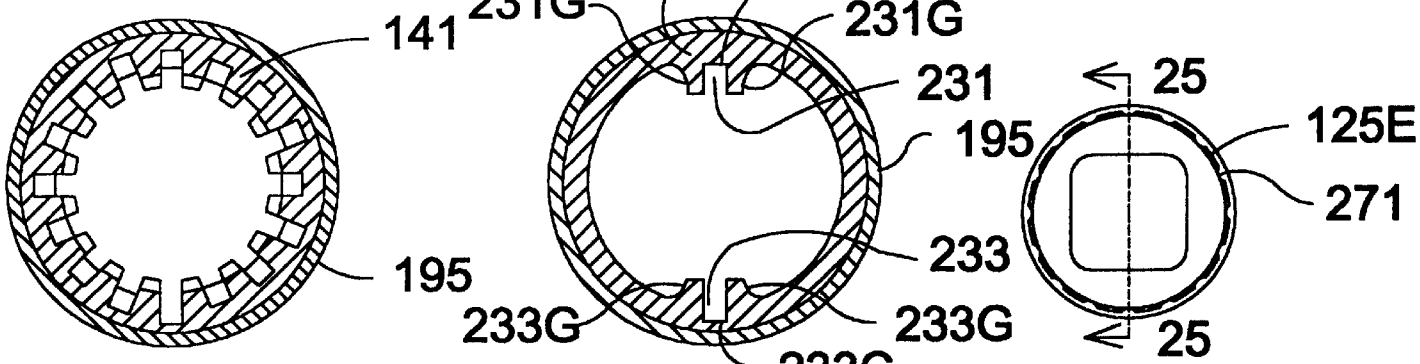
FIG. 24
FIG. 23
FIG. 22
FIG. 25

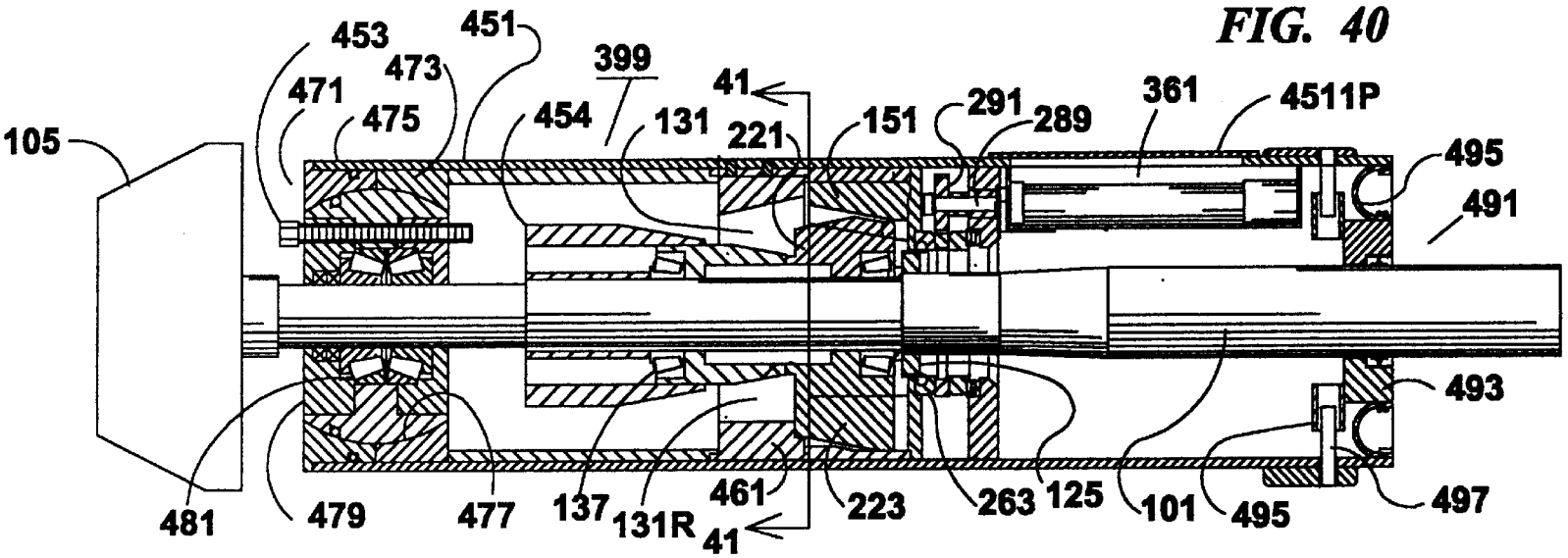
FIG. 40
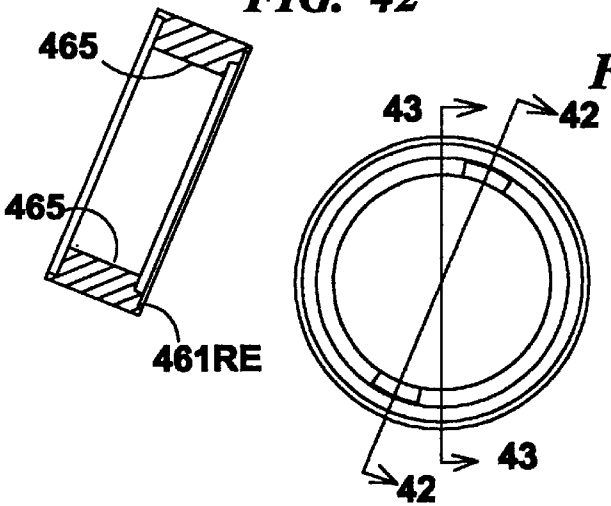
FIG. 41
FIG. 42
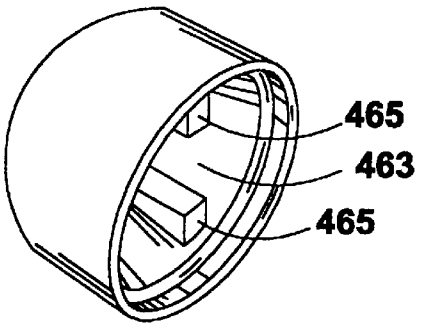
FIG. 44

267
125A 113
125A
750
70
70
731

771
773A 267
101
267
63A
113
125A 801
813
801
817
731

125A
754
61A
69
69
731
771
67
754
66
66
67
773A
811
813
815
750
801

771
773A

811

925
925

923
923

921
923
925

91
91
90
90
923
923
925
89
89

927
927
87
87
931

DIRECTIONAL DRILLING SYSTEM AND APPARATUS

This application is a continuation-in-part of U.S. application Ser. No. 09/093,747, filed Jun. 8, 1998, now U.S. Pat. No. 5,957,222, which is a continuation-in-part of U.S. application Ser. No. 60/049,283, filed Jun. 10, 1997.

BACKGROUND OF THE INVENTION

1. Field of the Invention

The invention relates to a drilling system for drilling a borehole in the earth with a directional control system.

2. Description of the Prior Art

In recent history, the utility industry has been using methods of placing conduits and cable in the ground without forming trenches. This is known as trenchless technology and is carried out by drilling, using machines that advance a drill string into the ground and guiding it around obstacles to the exit point desired. There is no problem in drilling in dirt using techniques and equipment similar to those found in U.S. Pat. No. 4,953,638. Also the oil and gas drilling systems have for many years used devices to direct a drill stem to desired locations. These systems use devices such as whipstocks and downhole motors mounted on bent shafts. When the drilling system, used by the utility industry, encounters rock, the operators have used downhole motors and devices that use two stems, one for cutting and one for steering such as disclosed in U.S. Pat. No. 5,490,569. It requires a special machine to operate these systems and the cost of such machines is very high. Moreover the downhole motors that use water, require environmental clean up which present problems. Other prior art drilling systems are disclosed in U.S. Pat. Nos. 4,281,723, and 5,423,388.

SUMMARY OF THE INVENTION

It is an object of the invention to provide a new and useful directional drilling apparatus.

The apparatus comprises a guide housing having a shaft extending therethrough. A cutting means is coupled to the forward end of the shaft for drilling purposes upon rotation of the shaft. The shaft is movable longitudinally relative to the guide housing such that the shaft may be moveable to a forward drilling position relative to the guide housing and to a rearward shifting position relative to the guide housing. Means located in the guide housing is controllable by movement of the shaft in the shifting position for locating the axis of the guide housing in at least first and second positions relative to the axis of the shaft. In the first position, the axis of the guide housing generally coincides with the axis of the shaft to allow the apparatus to drill straight. In the second position the axis of the guide housing is shifted relative to the axis of the shaft to cause the direction of the apparatus to turn while drilling operations are carried out.

In one embodiment, cam means is coupled to the guide housing at different angular positions around the shaft. A cam follower is coupled to a cam follower housing which surrounds the shaft. The cam follower is disengaged from the cam means and the cam follower housing and the cam follower are rotatable together relative to the guide housing when the shaft is in the shifting position. The cam follower is movable longitudinally with the shaft relative to the cam means. A clutch is provided for coupling the cam follower housing to the shaft when the shaft is in the shifting position such that the cam follower housing and hence the cam follower may be rotated by the shaft relative to the cam means to allow the cam follower to engage the cam means at a selected angular position around the shaft when the shaft is moved to the forward drilling position. When the shaft is moved toward the forward drilling position, the clutch allows the cam follower housing to be uncoupled from the shaft such that in the forward drilling position of the shaft, the cam follower engages the cam means and causes the guide housing to shift relative to the shaft to cause the direction of drilling to change.

In a further aspect, rotational indicators are provided for indicating the rotational position of the cam follower relative to the cam means and the position of the cam follower required for straight drilling. This information is transmitted to the surface by a radio frequency signal.

In one embodiment, the cam means comprises a conical shaped surface and at least one other surface to be selectively engaged by the cam follower. The conical shaped surface may be in line with or offset from the axis of the outer perimeter of the cam means.

In another embodiment the cam means comprises a plurality of cams coupled to the guide housing at different angular positions around the shaft.

The cam follower comprises two cam members spaced 180 degrees apart with one of the members adapted to be used for engaging the cam means.

In another embodiment, the cam means may be rotated to reposition the straight position of the cam means to a different clock position thereby allowing a turn to be made in all clock positions. A stop is coupled to the cam means for allowing the cam follower to rotate the cam means to a different position for deflecting the axis of the guide housing. A second stop is provided on the cam means for engagement by the cam follower to allow the cam follower to be disengaged from the clutch sufficient to prevent deflection of the guide housing to allow straight drilling to occur. A second clutch weaker than the shifting clutch may be employed for releasably holding the cam means to the guide housing.

In still another embodiment, the cam means comprises a single annular member having two slots spaced 180 degrees apart for receiving two cam members of the cam follower. A stop is coupled to the cam follower for engaging a forward stop coupled to the guide housing for providing a straight drilling position. As an alternative, a rotatable ring releasably coupled to the guide housing with a clutch is provided for supporting the forward stop for rotating the forward stop to a different position to allow a turn to be made at all clock positions.

In another embodiment, the cam follower is adapted to engage a stop coupled to the guide housing to rotate the guide housing in the bore while the cam follower is in the straight position and while drilling is being carried out.

In still another embodiment the drill shaft may be a telescoping shaft to obtain a means to hold the housing in a vertical hole while the shaft pushes the cam follower into the cam means.

In another embodiment, side cutters are mounted and operated in a manner to cut side slots in the hole for trailing guides to prevent the housing from rotating. In one embodiment, the side cutters to help pull the apparatus through the hole being drilled.

In still another embodiment, a rotational brake is provided to help prevent the cam means from rotating when the drill head is drilling forward. The brake comprises a piston and friction material located in an aperture formed through the side wall of the cam means for applying pressure to the inside of the guide housing by the cam follower during drilling operations.

BRIEF DESCRIPTION OF THE DRAWINGS

FIG. 16 illustrate the drill bit, the driving gear and the sprocket fixed to the shaft.

FIG. 17 is a cross-sectional of FIG. 16 taken along the lines 17—17 thereof.

FIG. 18 is a cross-section of FIG. 16 taken along the lines of 18—18 thereof.

FIG. 19 is a cross-section of FIG. 16 taken along the lines 19—19 thereof.

FIG. 20 illustrate the double cam follower mounted on the shaft.

FIG. 21 is a cross-sectional view of the apparatus similar to that of FIG. 4 but with the shaft removed.

FIG. 22 is a cross-sectional view of FIG. 21 taken along lines 22—22 thereof.

FIG. 23 is a cross-sectional view of FIG. 21 taken along lines 23—23 thereof.

FIG. 24 is a side view of the sprocket which is connected to the shaft.

FIG. 25 is a cross-sectional view of FIG. 24 as seen along lines 25—25 thereof.

FIG. 40 is a cross-section of another embodiment of the invention.

FIG. 41 is a cross-section of the cam of the apparatus of FIG. 40.

FIG. 42 is a cross-section of FIG. 41 taken along the lines 42—42 thereof.

FIG. 44 is an isometric view of the cam of FIG. 41.

In FIG. 65 illustrate the shaft of the apparatus is in a shifting position.

FIG. 66 is a cross-section of FIG. 65 taken along the lines 66—66 thereof.

FIG. 67 is a cross-section of FIG. 65 taken along the lines 67—67 thereof.

In FIG. 68 illustrates the shaft of the apparatus in a position to rotate the cam means.

FIG. 69 is a cross-section of FIG. 65 taken along the lines 69—69 thereof.

FIG. 70 is a cross-section of FIG. 68 taken along the lines 70—70 thereof.

FIG. 73 is a cross-sectional view of the apparatus of the embodiment of FIGS. 48–61 with a portion of the telescoping shaft removed and shown in FIG. 74.

FIG. 75 is a cross-sectional view of the apparatus of the embodiment of FIGS. 48–61 with the telescoping shaft in place in the apparatus and with the apparatus in a turning condition.

FIG. 76 is a cross-sectional view of the apparatus of FIG.75 with the apparatus in a straight drilling condition.

FIGS. 77, 78, and 79 are cross-sectional views of FIG. 76 taken along the lines 77—77, 78—78, and 79—79 respectively

In FIG. 80 the shaft is located in a forward turning drilling position.

FIG. 81 is an enlarged cross-sectional view of the brake in the pressurized condition of FIG. 80.

In FIG. 82, the shaft of the apparatus is in a shifting position.

FIG. 83 is a cross-sectional view of the cam means with its brake in the relaxed, unpressurized condition of FIG. 82.

FIG. 84 is an enlarged cross-sectional view of the brake in the condition of FIGS. 82 and 83.

FIG. 92 is a side view of the apparatus with the drill bit in a forward drilling position.

FIG. 93 is a view similar to that of FIG. 92 with the apparatus and drill bit pulled back in the hole being drilled.

FIG. 94 is a view similar to that of FIG. 92 with drilling operations turning downward.

FIG. 95 is a view similar to that of FIG. 92 with drilling operations turning upward.

FIG. 96 is a top view of the apparatus of FIG. 92.

FIG. 97 is a top view of the apparatus of FIG. 93.

FIG. 98 is a cross-section of FIG. 97 as seen along lines 98—98 thereof.

FIG. 99 is a cross-section of FIG. 96 as seen along lines 99—99 thereof.

FIG. 100 is a cross-section of FIG. 93 as seen along lines 100—100 thereof.

FIG. 101 is a cross-section of FIG. 100 as seen along lines 101—101 thereof.

FIG. 102 illustrates rear guides that pass in guide slots cut in the formation from the hole being drilled to prevent rotation of the drill head.

FIG. 103 illustrates the contour of the hole cut with the apparatus of FIGS. 92–102.

FIG. 104 is a partial cross-section of the apparatus of one of the embodiments for rotating the guide housing with the shaft in a forward drilling position.

FIG. 105 is a cross-section of FIG. 104 taken along the lines 105—105 thereof.

FIG. 106 is a cross-section of FIG. 105 taken along the lines 106—106 thereof.

FIG. 107 is a partial cross-section of the apparatus with the shaft in a shifting position.

FIG. 108 is a cross-section of FIG. 107 taken along the line 108—108 thereof.

FIG. 109 is a partial cross-section of the apparatus of the other embodiment with the shaft in the shifting position and the two stops aligned.

FIG. 110 is a cross-section of FIG. 109 taken along the lines 110—110 thereof.

FIG. 111 is a partial cross-section of the apparatus with the shaft in a shifting position.

FIG. 112 is a cross-section of FIG. 111 taken along the lines 112—112 thereof.

FIGS. 113–119 are cross-sectional views of two other embodiments of the apparatus wherein the shaft may be used to rotate the guide housing in the hole while drilling straight.

FIG. 113 is a cross-section of the apparatus with the shaft in a forward drilling position.

FIG. 114 is a cross-section of the apparatus with the shaft in a shifting position.

FIG. 115 is a cross-section of FIG. 114 taken along the lines 115—115 thereof.

FIG. 116 is a cross-section of the apparatus with the shaft in a forward drilling position.

FIG. 117 is a cross-section of the apparatus with the shaft in a shifting position.

FIG. 118 is a cross-section of FIG. 117 taken along the lines 118—118 thereof.

FIG. 119 is a cross-section of the apparatus with the shaft in a straight drilling position.

FIG. 120 illustrates an apparatus of the invention coupled to a drill rig.

DETAILED DESCRIPTION OF THE PREFERRED EMBODIMENTS

Figure 1:
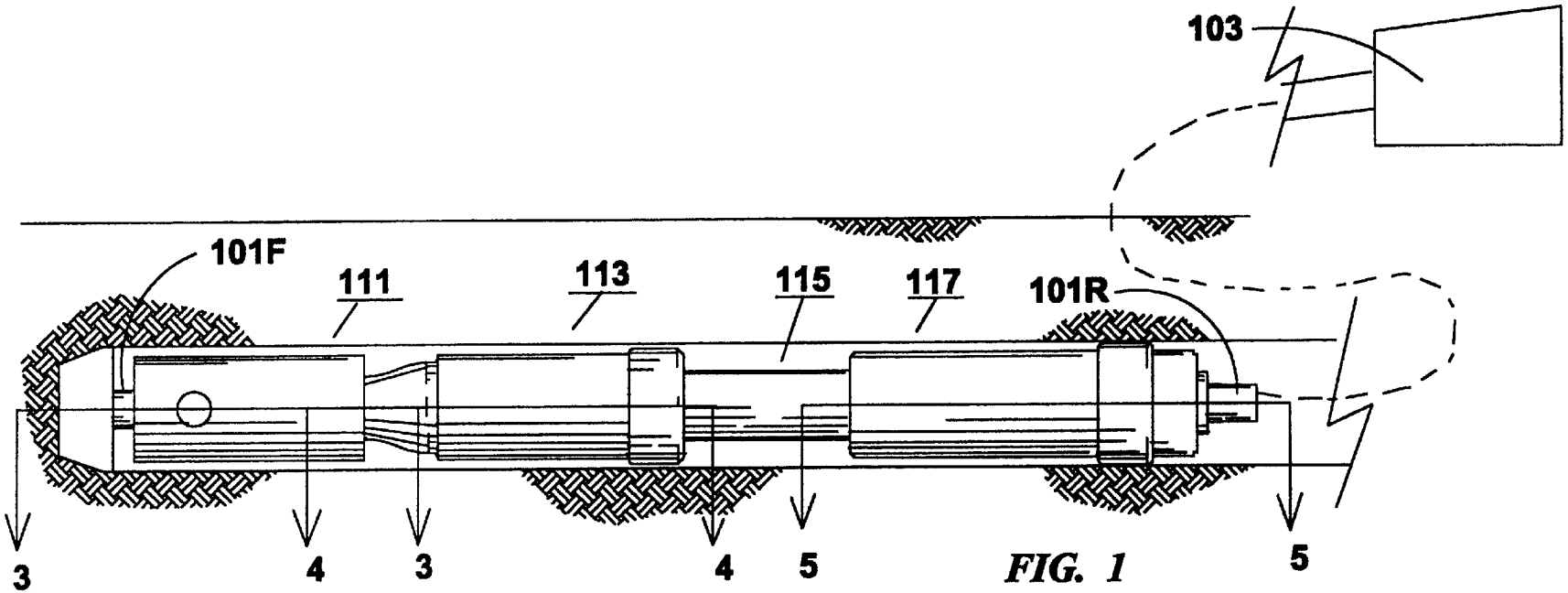
FIG. 1 illustrates the drilling apparatus of the invention in a shifting mode.

Referring to FIGS. 1–34 of the drawings, the apparatus comprises a shaft 101 having a rear end 101R connectable to a drilling system 103 and a drill bit 105 connectable to the front end 101F. The shaft 101 extends through a front shaft support or head assembly 111, a guide housing 113, a universal link 115 and a rear shaft support 117. The drilling system 103 is a conventional system having a drilling stem 103A coupled to the rear 101R of the shaft 101 that can rotate the shaft clockwise as seen from the rear looking forward while pushing the shaft 101 forward for drilling purposes and it can also pull the shaft rearward. Additional stem members can be attached to the rear 101R of the shaft 101 and to the drilling system 103 as the hole being drilled gets longer or deeper. The shaft 101 can rotate within each of units 111, 113, 115, and 117, and can move forward and rearward relative to units 113, 115, and 117. The units 111, 113, 115, and 117 cannot rotate relative to each other but can roll together about the shaft 101 if means is not provided for preventing the roll. Unit 111 can be moved longitudinally by the shaft 101 rearward a small distance to a shifting position relative to unit 113 and forward a small distance to a drilling position relative to unit 113 as shown in FIG. 1 and 2.

Ball joints at the rear of unit 111 and at the front of unit 113; at the rear of unit 113 and at the front of unit 115; and at the rear of unit 115 and at the front of unit 117 allow unit 113 to swivel relative to unit 111, unit 113 to swivel relative to unit 115 and unit 115 to swivel relative to unit 117 for turning purposes. Units 111 and 117 remain concentric with the shaft 101 at all times including when the apparatus is turning.

Figure 2:
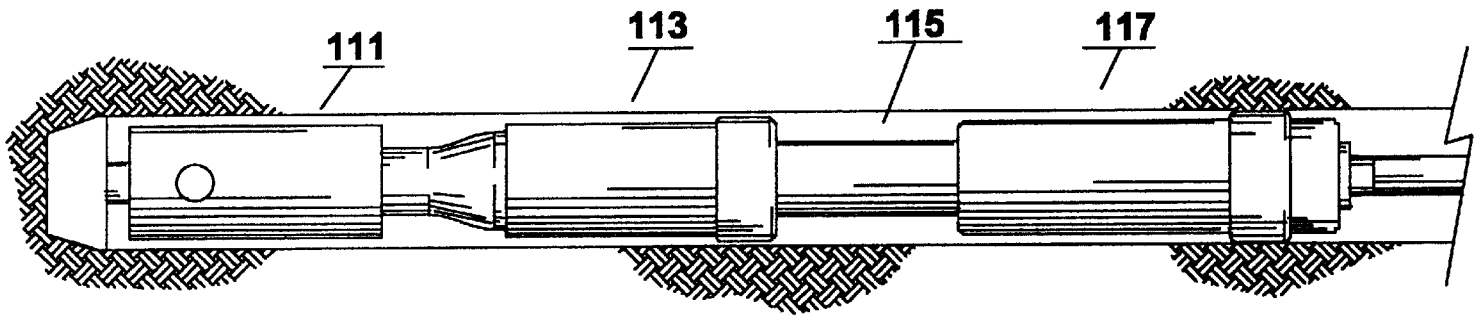
FIG. 2 illustrates the drilling apparatus of the invention in a straight drilling mode.

A cam means or system and a cam follower are employed in unit 113 to cause the apparatus to drill straight as shown in FIG. 2 or to tilt unit 113 relative to the shaft 101 as shown in FIGS. 6A, and 31–34 to cause the unit 111 and hence the apparatus to turn up, down, left or right or any fraction thereof while drilling operations are being carried out.

Referring to FIGS. 3, 4, 6A, and 16–19, the drill bit 105, two driving gears 121 and 123 and a sprocket 125 are coupled to the shaft 101 such that they cannot rotate or move longitudinally relative to the shaft 101. They rotate and move longitudinally with the shaft as it is rotated or moved longitudinally. The bit 105, the gears 121 and 123 and the sprocket can be replaced when worn or to change bit sizes. The drill bit 105 will have an outside diameter greater than the outside diameters of each of units 111, 113, 115, and 117.

Referring to FIG. 20, there is provided a cam follower 131 coupled to the shaft 101 which can rotate about the shaft but cannot move longitudinally relative to the shaft. Longitudinal movement on the shaft is prevented by members 133 and 135. Members 137 are bearings. The front shaft support 111 cannot move longitudinally relative to the shaft 101 but the shaft 101 can rotate within the support 111. The shaft 101 can move longitudinally within the rear shaft support 117 and can rotate within the support 117.

Referring to FIGS. 21–23, there is provided a cam ring 141 which is fixed in the guide housing 113 and cannot rotate or move longitudinally within the guide housing. Also located in the guide housing is a cam follower housing 151 which is fixed longitudinally within the guide housing 113 but can be rotated within the guide housing.

Figure 3:
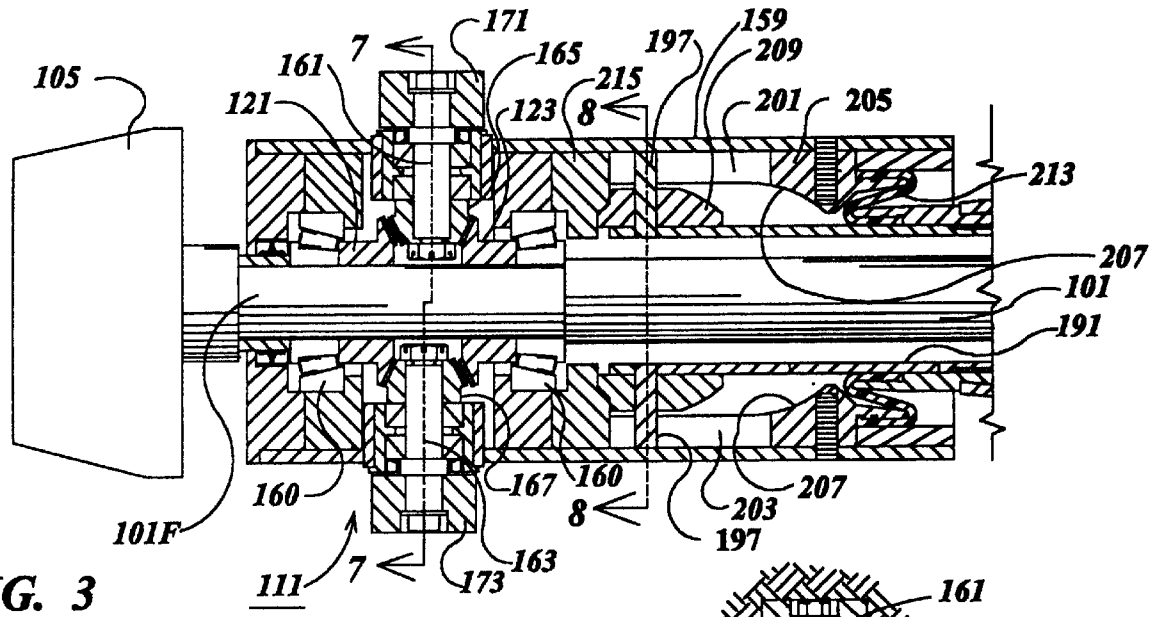
FIG. 3 is a cross-sectional view of FIG. 1 taken along the lines 3—3 thereof.
Figure 7:
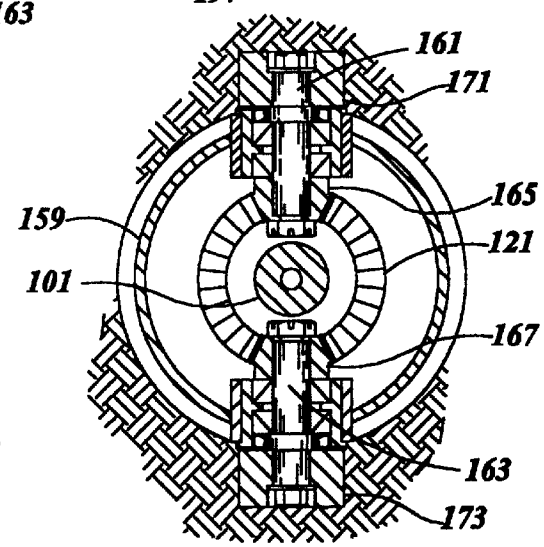
FIG. 7 is a cross-sectional view of FIG. 3 taken along the lines 7—7 thereof.
Figure 8:
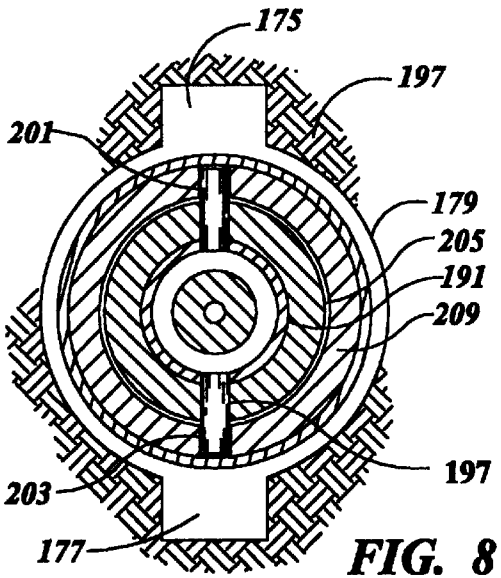
FIG. 8 is a cross-sectional view of FIG. 3 taken along the lines 8—8 thereof.
Figure 5:
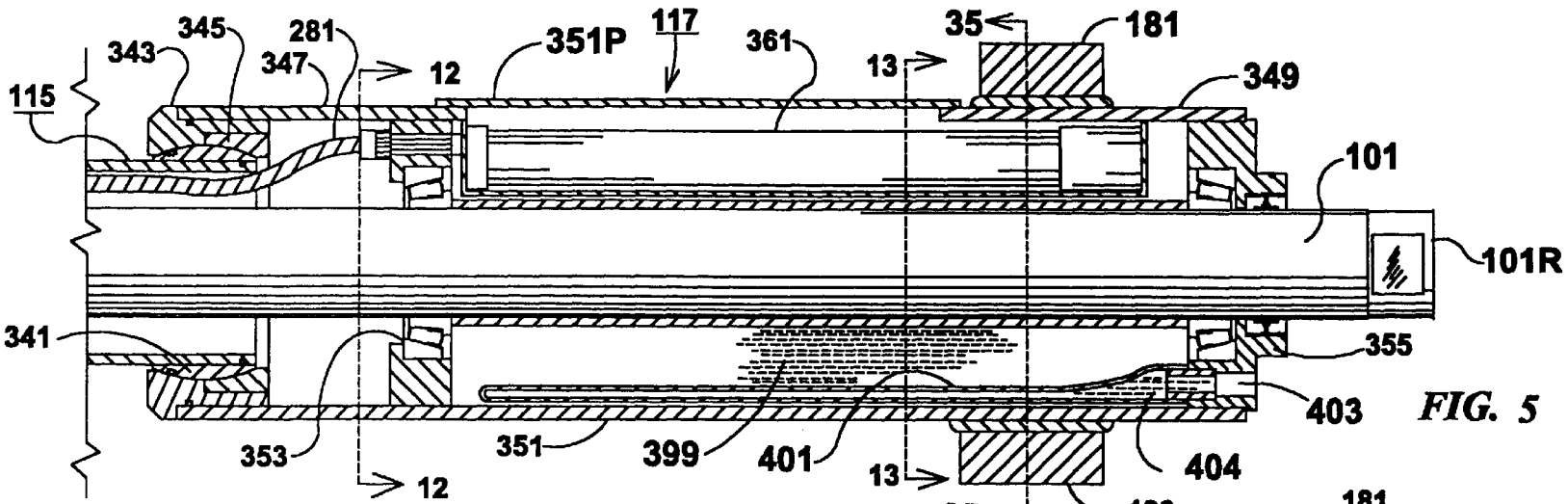
FIG. 5 is a cross-sectional view of FIG. 1 taken along the lines 5—5 thereof.

Referring to FIGS. 3, 7, and 8, the front shaft support 111 comprises a cylindrical tube 159 which has structure for supporting bearings 160 and two side shafts 161 and 163 having gears 165 and 167 connected to the inner ends of the shafts 161 and 163 respectively and side cutters 171 and 173 connected to the outer ends of the shafts 161 and 163 respectively. Gears 165 and 167 mesh with gears 121 and 123 such that rotation of the shaft 101 causes gears 165 and 167 to rotate and hence the side cutters 171 and 173 to rotate. When the shaft 101 is rotated clockwise, as seen from the rear end 101R of the shaft 101 looking toward the front end 101F for drilling purposes, the bit 105 rotates and the side cutters 171 and 173 rotate. The purpose of the side cutters 171 and 173 is to cut side holes 175 and 177 which are transverse to the axis of the borehole 179 being drilled for receiving roll stabilizers 181 and 183 coupled to the rear shaft support 117, as shown in FIG. 5, to prevent the units 111, 113, 115, 117 from rolling around the shaft 101 as the hole 179 is being drilled.

An inner tube 191 is slidably located in the housing tube 159 and has its rear end connected to a tubular member 193. (Note FIG. 4) The rear end of the tubular member 193 increases in diameter and is connected to the front end of the tube 195 of the guide housing 113 such that the tubular members 191, 193, and 195 are fixed together and cannot rotate relative to each other or move longitudinally relative to each other. Two slide pins 197 are fixedly coupled to the front end of the inner tube 191 and can slide forward and rearward within slots 201 and 203 formed in a stop ring 205 fixed to the inside of tube 159. The ring 205 deceases in diameter rearward to form a stop ball socket 207 in which an annular guide stop ball 209 can slide. The guide stop ball 209 is fixedly connected to the inner tube 191 and to pins 197. Fixedly connected to the inside of the rear end of the tube 159 is the front end of a flexible sleeve 213. The rear end of the sleeve 213 is connected to the front end of the tube 191.

Figure 4:
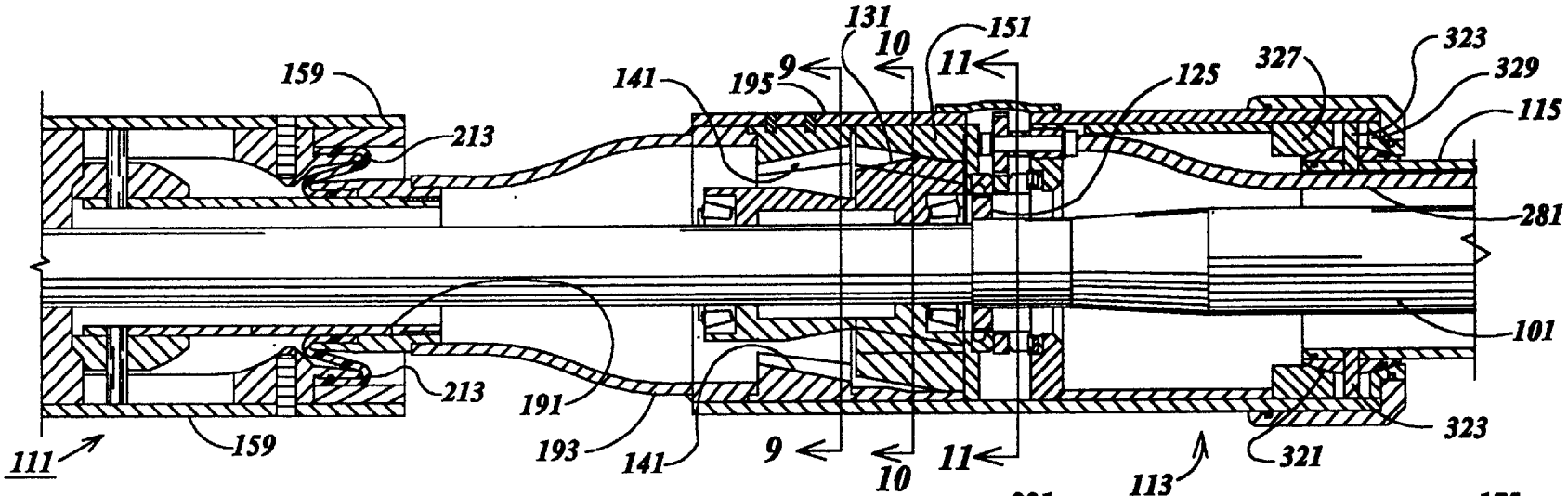
FIG. 4 is a cross-sectional view of FIG. 1 taken along the lines 4—4 thereof.
Figure 11:
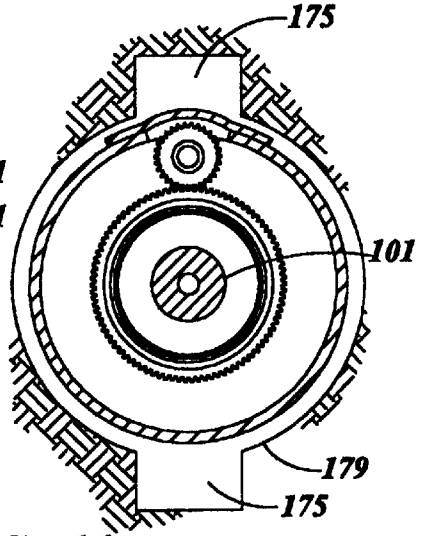
FIG. 11 is a cross-sectional view of FIG. 4 taken along the lines 11—11 thereof.
Figure 10:
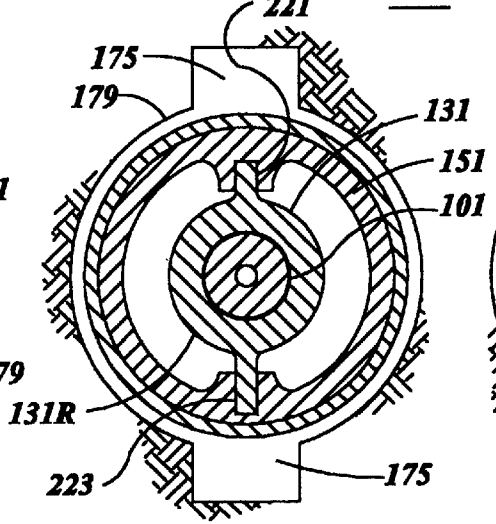
FIG. 10 is a cross-sectional view of FIG. 4 taken along the lines 10—10 thereof.
Figure 9:
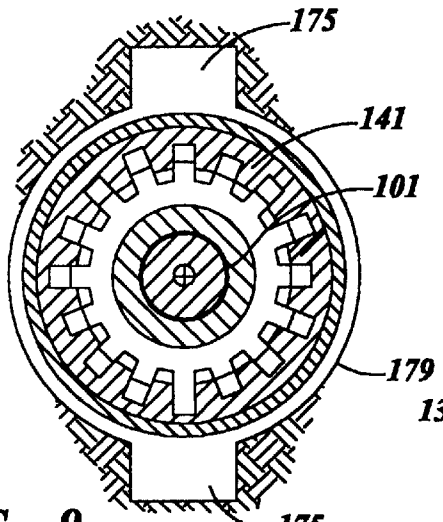
FIG. 9 is a cross-sectional view of FIG. 4 taken along the lines 9—9 thereof.
Figure 6A:
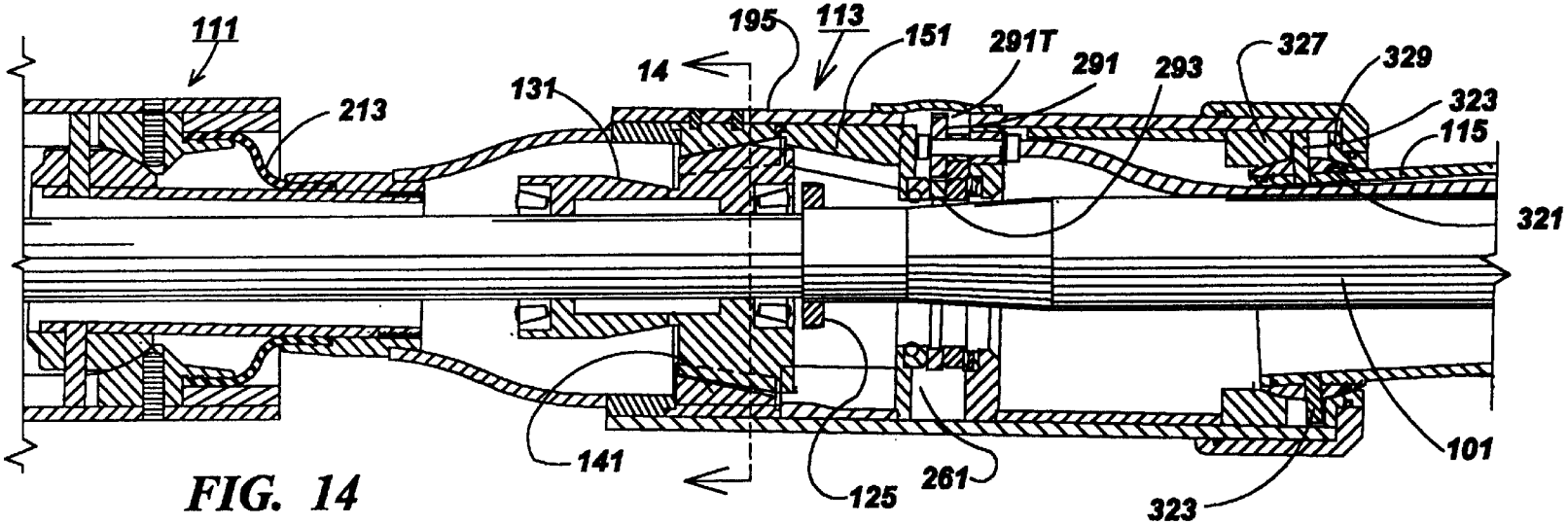
FIG. 6A is a cross-sectional view of FIG. 6 taken along the lines 6A—6A thereof.

In the position of the shaft 101 as shown in FIGS. 3 and 4, the front housing 111 and hence the tube 159 are in a rearward position relative to the guide housing 113 and the front housing 111 is stopped or prevented from going further rearward by engagement of the ring structure 215 with the front end of the stop ball 209. In this position, the sleeve or boot seal 213 is folded. The shaft 101 can move the front housing 111 forward relative to the guide housing 113 until the rear end of the stop ball 209 engages the rearward smaller diameter portion of the socket 207 of the ring 205 as shown in FIG. 6A. In this position, the front end of the sleeve 213 is moved forward as shown in FIG. 6A. The rear end of the stop ball 209 and the smaller diameter portion of the tube 205 are rounded in convex and concave shapes and mate with each other such that when the shaft 101 and the front housing are in the forward drilling position, the front housing 111 and the guide housing 113 can swivel relative to each other to allow the drilling apparatus to turn. Referring to FIGS. 4, 6, 9–11, 14, 15, 16, 18, 20–30, the guide housing 113 comprises the tube 195, the follower housing 151, the cam ring 141, the double cam follower 131 and the sprocket 125 as disclosed above. The double cam follower 131 comprises two members 221 and 223 located 180 degrees apart and extending radially from a central ring 131 R which can rotate about the shaft 101. The cam follower housing 151 comprises two slots 231 and 233 in which the cam members 221 and 223 can slide forward or rearward when the shaft 101 is moved forward or rearward relative to the tube 195 of the guide housing 113 for drilling or shifting purposes. The cam ring 141 has 16 cams or cam surface adapted to be engaged by the cam member 223.

Figure 33:
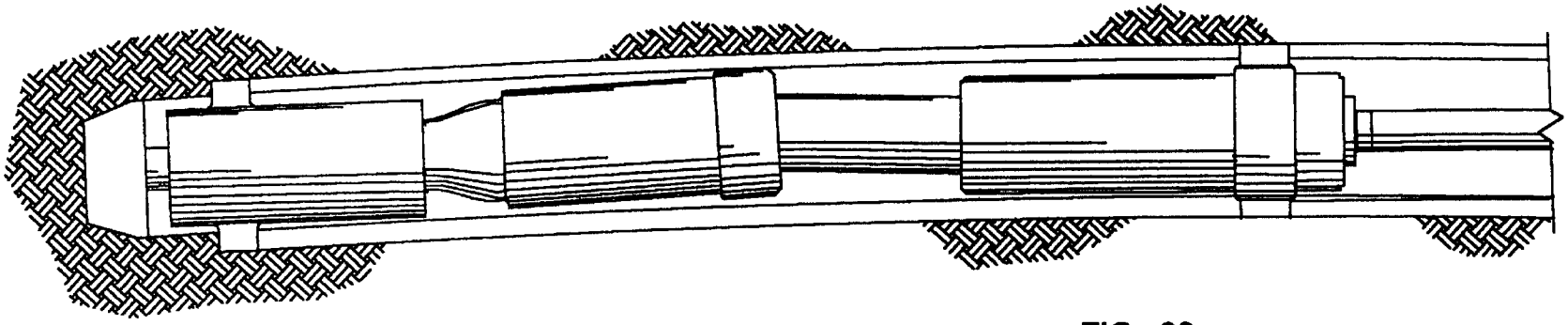
FIG. 33 illustrates the apparatus in a borehole in a left turning position.
Figure 34:
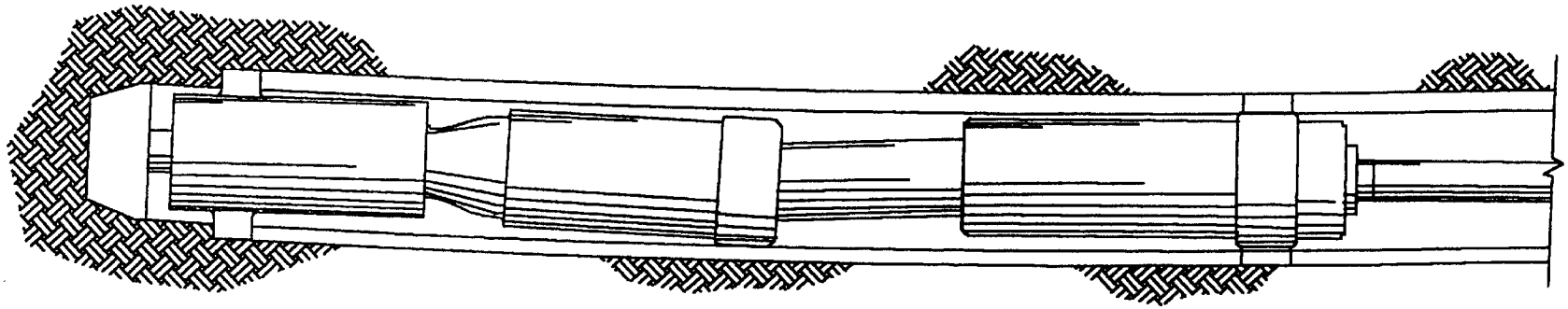
FIG. 34 illustrates the apparatus in a borehole in a right turning position.
Figure 37:
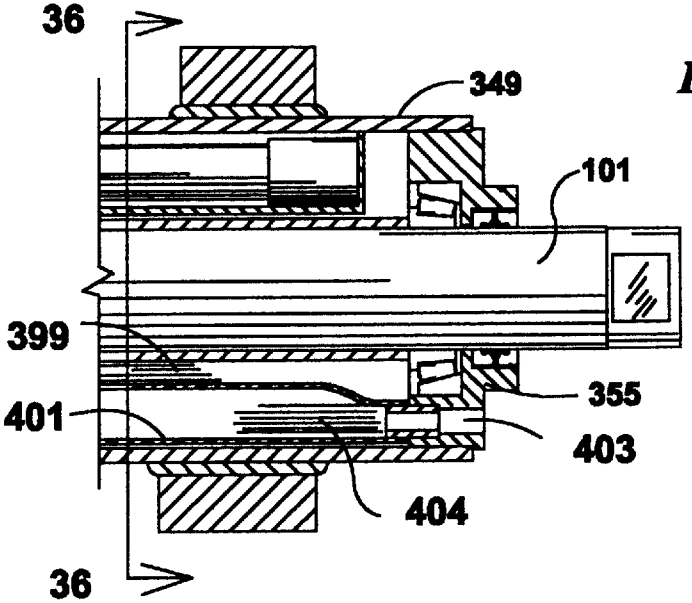
FIG. 37 is a partial cross-section of the rear shaft support showing the bladder of FIGS. 35 and 36.
Figure 36:
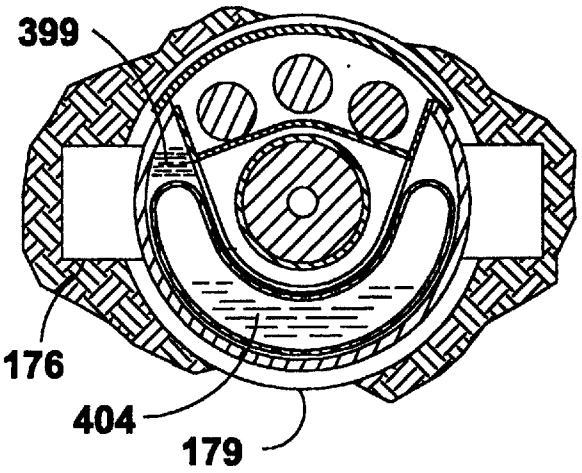
FIG. 36 is a view similar to that of FIG. 35 but with the bladder full of water and expanded.

Cam member 221 is employed for guide purposes only and does not engage the cams. Only the cam member 223 engages a selected cam for controlling the tilt of the guide housing 113 relative to the axis of the shaft 101. Either of cams 241 or 255 is employed to maintain the guide housing 113 concentric relative to the axis of the shaft 101 when engaged by the cam member 223 for drilling straight. The cams 241 and 255 have little or no incline. The other cams 256 and 242–254 are employed to cause the guide housing 113 to tilt relative to the axis of the shaft 101 when engaged by the cam member 223. Cams 243, 247, 249, 253 and 256 have the same amount of slant or incline relative to the axis of the guide housing 113 which is defined as a small incline. Cams 242, 244, 246, 250, 252 and 254 have the same amount of incline which is defined as a medium incline. Cams 245, 248, and 251 have the same amount of incline which is defined as a large incline. The amount of tilt in which the guide housing is moved relative to the axis of the shaft depends on which cam is selected for engagement by the cam member 223 for titling purposes. When the desired cam is selected, the shaft 101 is pushed forward relative to the guide housing 113 and the cam member 223 is pushed forward with the shaft to fully engage the selected cam ramp. This causes the guide housing 113 to tilt relative to the axis of the shaft 101 and pushes the rear end of one side of the guide housing against one side of the borehole wall causing the drill head to be forced in a direction opposite the direction in which the rear end of the guide housing is forced. For example in FIG. 31, the rear end of the guide housing is forced against the upper side of the borehole, forcing the front housing 111 downward to cause drilling to turn downward. An opposite turn is up in FIG. 32. In FIG. 33, the rear end of the guide housing is forced against the right wall of the borehole, forcing the front housing 111 to the left to cause drilling to turn to the left. An opposite turn from that of FIG. 33 is shown in FIG. 34.

Except for the cams 241 and 255, in this embodiment, all of the cams may have the same incline.

Figure 6:
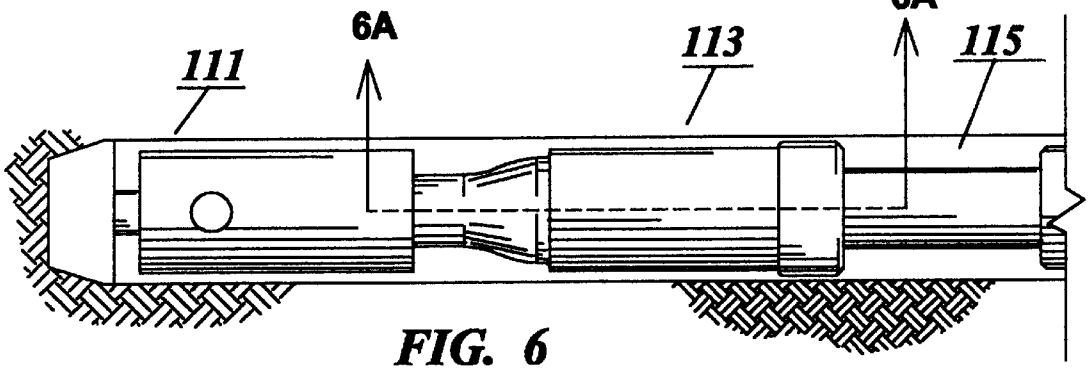
FIG. 6 is a partial view of the apparatus of FIG. 1.
Figure 14:
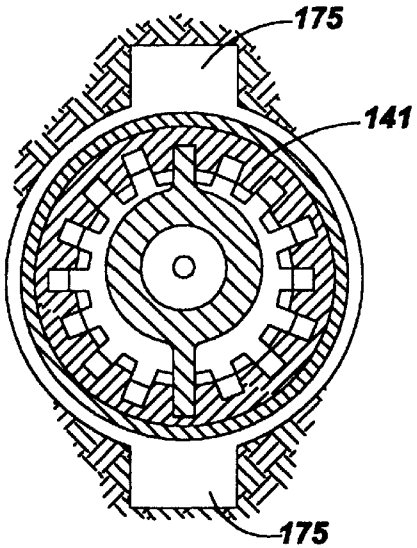
FIG. 14 is a cross-sectional view of FIG. 6 taken along the lines 14—14 thereof.
Figure 15:
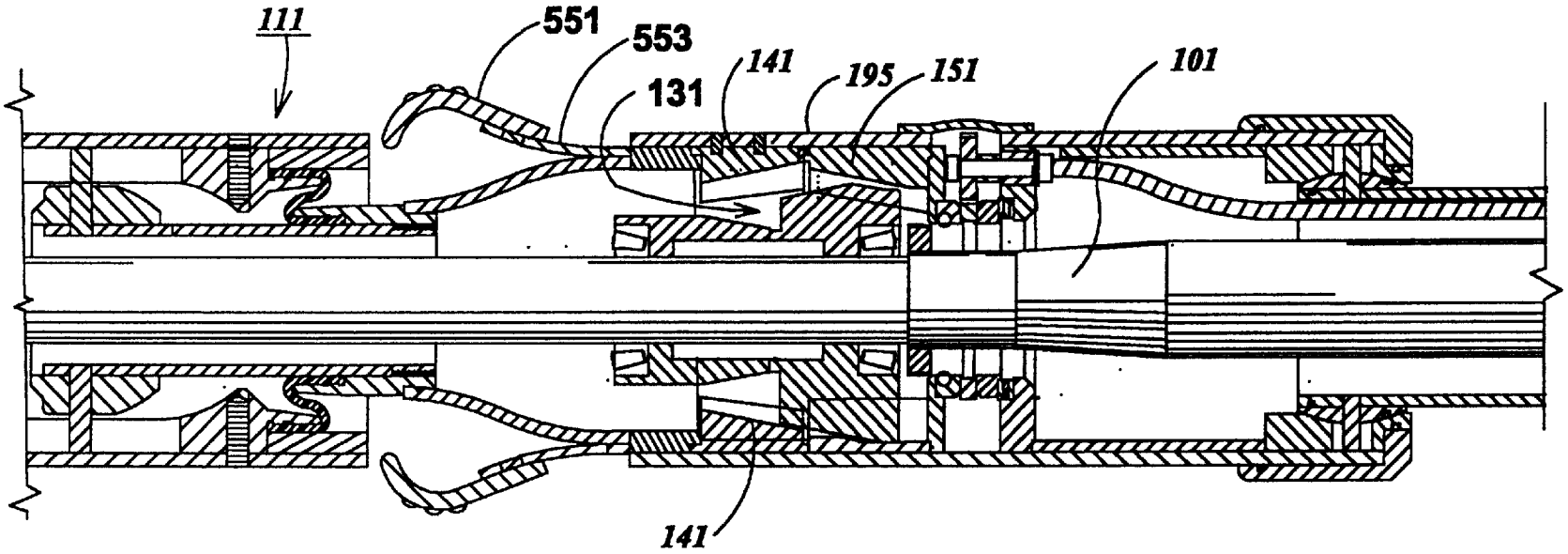
FIG. 15 is a cross-sectional view of the apparatus similar to that of FIG. 4 but with the clutch in a released position.
Figure 27:
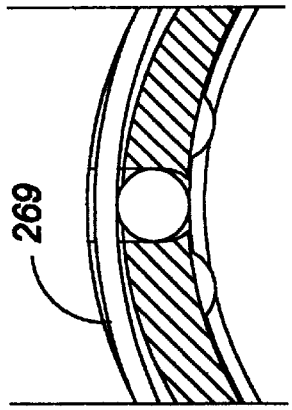
FIG. 27 illustrate the ball of FIG. 25 between notches of the sprocket.
Figure 26:
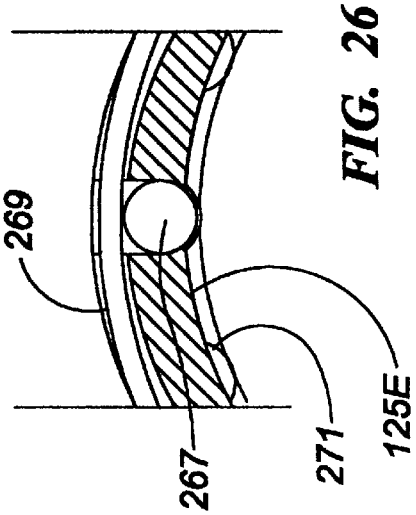
FIG. 26 illustrate one of the balls of the clutch in a notch of the sprocket.
Figure 30:
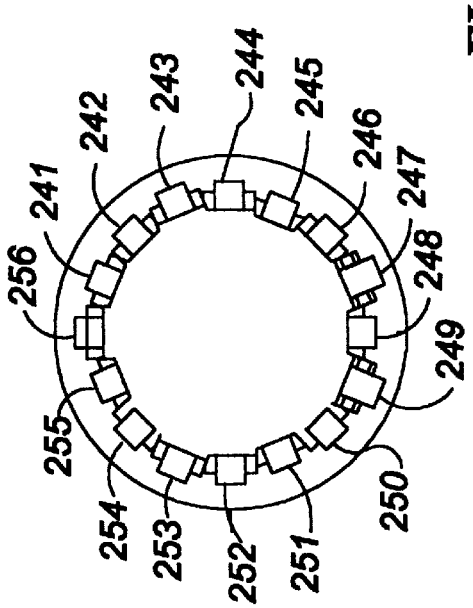
FIG. 30 illustrate the 16 cams of the apparatus.
Figure 28:
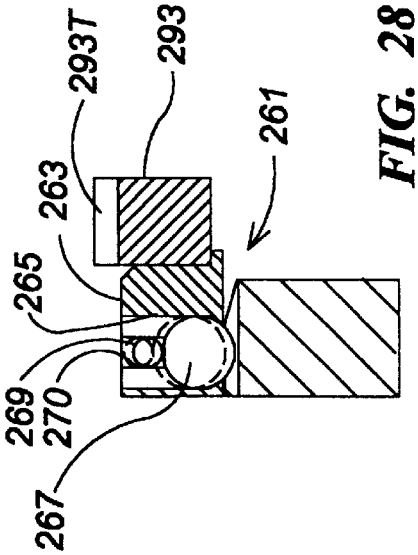
FIG. 28 is an enlarged a cross-section of FIG. 26.

Referring to FIGS. 26–29, there will be described the mechanism for allowing the cam follower 131 and its cam member 223 to be shifted from one cam to another cam. Attached to the rear of the cam follower housing 151 is a ball ring 263 which operates in conjunction with the sprocket 125 to form a clutch 261 to allow shifting to take place. The annular ball ring 263 has two apertures 265 formed radially through the ring 263, 180 degrees apart. Located in each of the apertures 265 is a steel ball 267 which is biased radially inward by a spring 269 located in a slot 270 above each aperture 265. The sprocket 125 comprises an annular member having 16 slots 271 formed in its outer edge 125E. The centers of adjacent slots form an angle of 22.5 degrees. When the shaft 101 and the front shaft support 111 are in a forward drilling position as shown in FIG. 6, the sprocket 125 is located forward of the ball ring 263. When cam member 223 fully engages a cam, the rear ends of both cam members 221 and 223 are still located in the slots 231 and 233 of the follower housing 151 preventing the housing 151 from rotating within the guide housing 113. When the shaft 101 and the front shaft support 111 are moved rearward, the sprocket 125 moves rearward whereby the balls fall into two slots 271 which lock the balls 267 and hence the follower housing 151 to the sprocket 125. If the balls are initially located between adjacent slots 271 they will be pushed radially outward by the sprocket as it moves rearward, and rotation of the shaft 101 and sprocket 125 by the drill system 103 will enable the balls to fall into two opposite slots. In this position, the cam members 221 and 223 are completely disengaged from the cams and rotation of the shaft 101 and sprocket 125 will cause the cam follower housing 151 and its cam members 221 and 223 to rotate relative to the cams. The operator, then can rotate the shaft 101 with the system 103 to position the cam member 223 adjacent to a selected cam and cause the system 103 to push the shaft 101 forward to release the sprocket 125 from the ball ring 263 and to push the cam members 221 and 223 to a drill position to allow cam 223 to fully engage the selected cam. FIG. 15 shows the position of the sprocket 125 as is moved forward an amount sufficient to be released from the ball ring 263 with the cam follower members 221 and 223 just entering the cam ring 141. At the drill position, the rear ends of the cam members 221 and 223 are still in the cam follower slots 231 and 233 and prevent rotation of the cam follower 151 housing.

Referring also to FIGS. 1, 4, 5, 12, 13, and 39, a monitoring system is provided for monitoring the angular position of the cam follower to enable the operator above ground to monitor the shifting position while rotating the shaft 101 which is attached to the cam follower. The system comprises a conventional flexible cable 281 having a flexible cable shaft connected to the shaft 289 of a gear 291 having teeth 291T which mesh with the teeth of a gear 293 which is connected to the ring 263. The shaft 289 of the gear 291 is supported for rotation by a bearing and sleeve 295 which is connected to the inside of the tube 195 of the guide housing 113. The cable 281 extends to a cam follower sonde 361 located in the rear shaft support housing 117 which sends a wireless signal to a monitor 421 located at the surface. This makes it possible to select any cam or shifting position by rotating the shaft 101 while watching the above ground monitor 421

Referring to FIGS. 4, 5, 6A, 12, and 13, the universal link 115 comprises a tubular member having an annular member 321 with a convex surface, secured to its front end by way of rods 323, located in annular members 327 and 329 secured to the inside of the rear of tubular member 195 of the guide housing 113. The members 327 and 329 have concave surfaces which mate with the convex surface of annular member 321 to form a ball joint for connecting members 195 and 115 together to allow the two members 113 and 115 to swivel relative to each other as shown in FIGS. 31–34. An annular member 341 with a convex surface is secured to the rear end of tubular member 115 which mates with a concave surface formed on members 343 and 345 secured to the inside of the rear end of a tubular member 351 of the rear shaft support 117 to form a ball joint which allows the members 115 and 117 to swivel relative to each other as shown in FIGS. 31–34.

Bearing members 353 and 355 support the shaft 101 for rotation within the rear shaft support 117. Located in the rear shaft support 117 are a cam follower sonde 361 and a housing roll sonde 371. The cable 281 is connected to a rear cable gear 365 which meshes with a shifting sonde gear 367 to turn the sonde 361 in the same direction and the same amount in degrees as the cam follower 131 is rotated by the shaft 101 during the shifting procedure as described previously. The sonde 361 contains a battery and a wireless transmitter which transmits wireless signals to the surface monitor 421, the rotational position of the sonde 361, the longitudinal tilt of the sonde 361 and the depth of the sonde 361. Also located in the shaft support 117 is a housing level sonde 371 which also includes a wireless transmitter and battery. The sonde 371 transmits to the same monitor 421, a wireless signal which includes information of the rotary position of the rear housing support 117 and thus the cam ring, its tilt, and its depth. The wall of the tube 351 at 351P is of a material, such as plastic that will allow transmission of the signals.

The sondes 361 and 371 and monitors 421 and 423 are conventional units commercially available from Radiodetection Ltd. of Bristol, U.K. and identified as RD385L. These devices also are disclosed in U.S. Pat. Nos. 5,469,155 and 3,617,865 which are incorporated into this application by reference.

Figure 29:
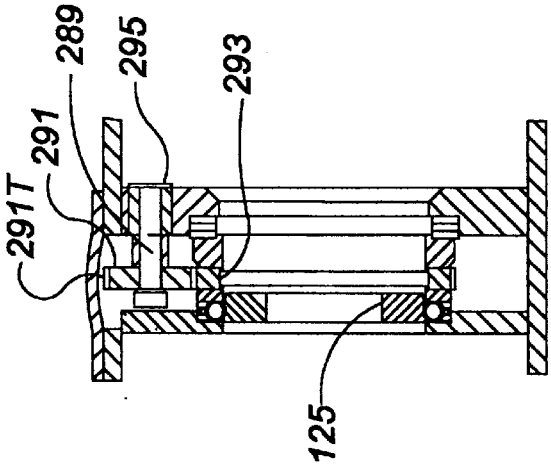
FIG. 29 illustrate the sprocket and ball ring of the clutch of the invention.
Figure 31:
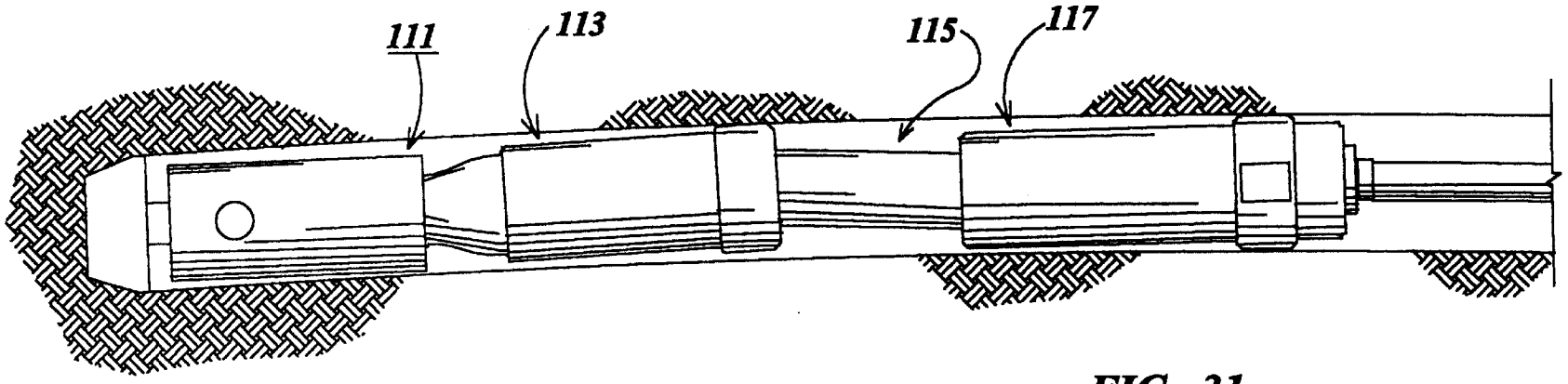
FIG. 31 illustrates the apparatus in a borehole in a downward turning position.
Figure 32:
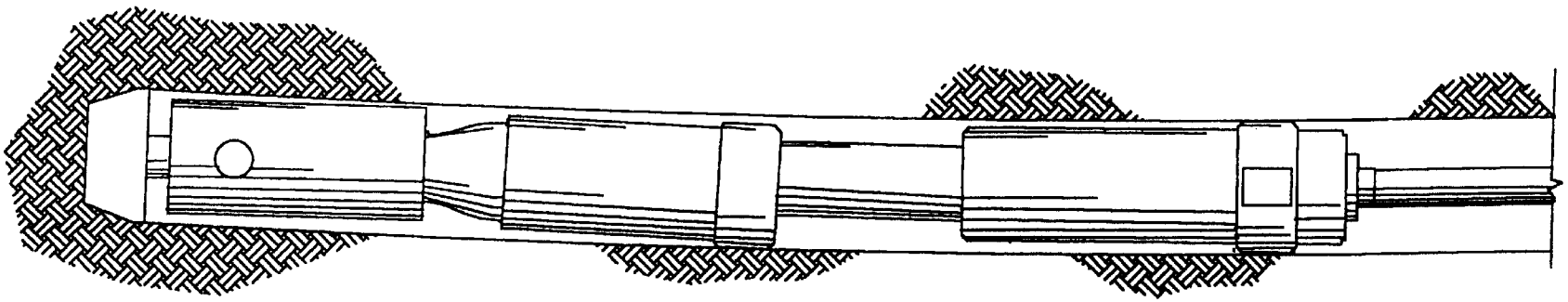
FIG. 32 illustrates the apparatus in a borehole in an upward turning position.

The follower housing 151 is the central part of the shifting and operating system. Referring to FIG. 23, there are two opposing cams 231C and 233C in the follower housing 151 that work with the double sided cam follower 131 to align the guide housing 113 to a position concentric with the shaft 101, when the shaft 101 is pulled into the shifting position. There are side guides 231G and 233G for the cams 231C and 233C in the follower housing 151 that keep the center line of the follower housing 151, the center line of the shaft 101 and the center line of the guide housing 113 at a common axis when in a shifting position. Referring to FIG. 29, there is a gear 293 mounted on the rear of the follower housing 151 that is a part of a gear and flexible cable system, that causes the cam follower sonde 361 to rotate in the same direction and to the same angle as the cam follower. This allows the above ground apparatus to indicate the shifting position.

The spring loaded ball ring 263 of clutch 261 is connected to the rear of the cam follower housing. The two balls 267 of the clutch work with the clutch sprocket 125 fixed to the shaft 101 to connect the follower housing 151 to the shaft 101 when in the shifting position. This makes it possible to select any shifting position by rotating the shaft 101 while watching the above ground monitor.

When the shaft 101 is pushed forward into the drilling position, the follower 131 engages the cam ring 141, and since the rear of the follower 131 always remains engaged with the follower housing 151, this locks the guide system rotational to the guide housing 113 and releases the ball clutch 261 allowing the shaft 101 to be free of the guide system in order to rotate the drill bit.

Figure 35:
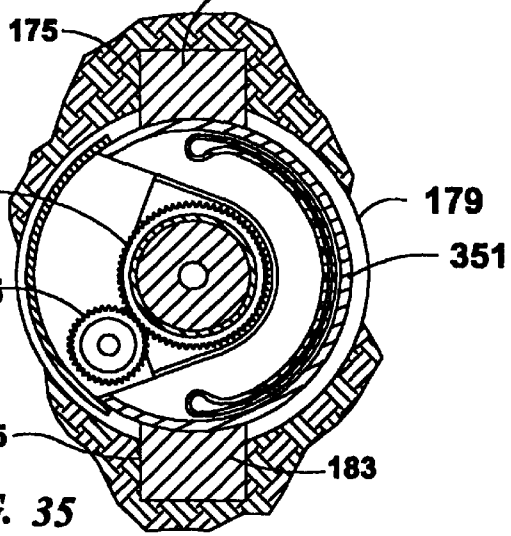
FIG. 35 is a cross-section of FIG. 5 taken along the lines 35—35 thereof.
Figure 13:
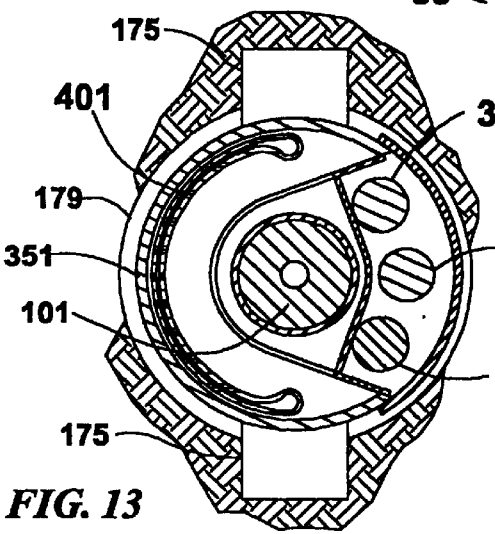
FIG. 13 is a cross-sectional view of FIG. 5 taken along the lines 13—13 thereof.
Figure 12:
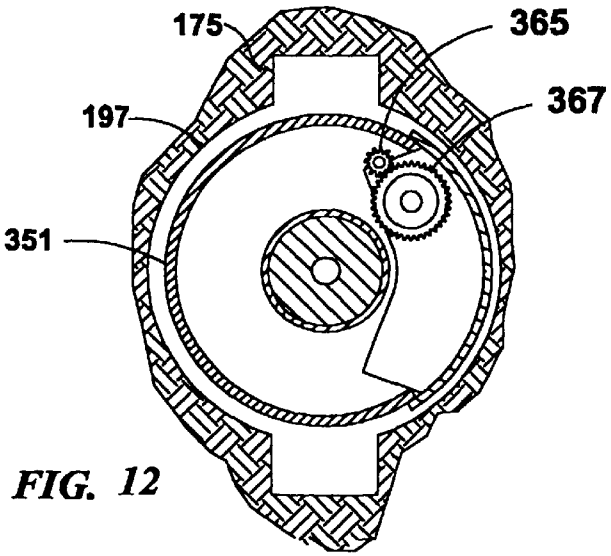
FIG. 12 is a cross-sectional view of FIG. 5 taken along the lines 12—12 thereof.
Figure 39:
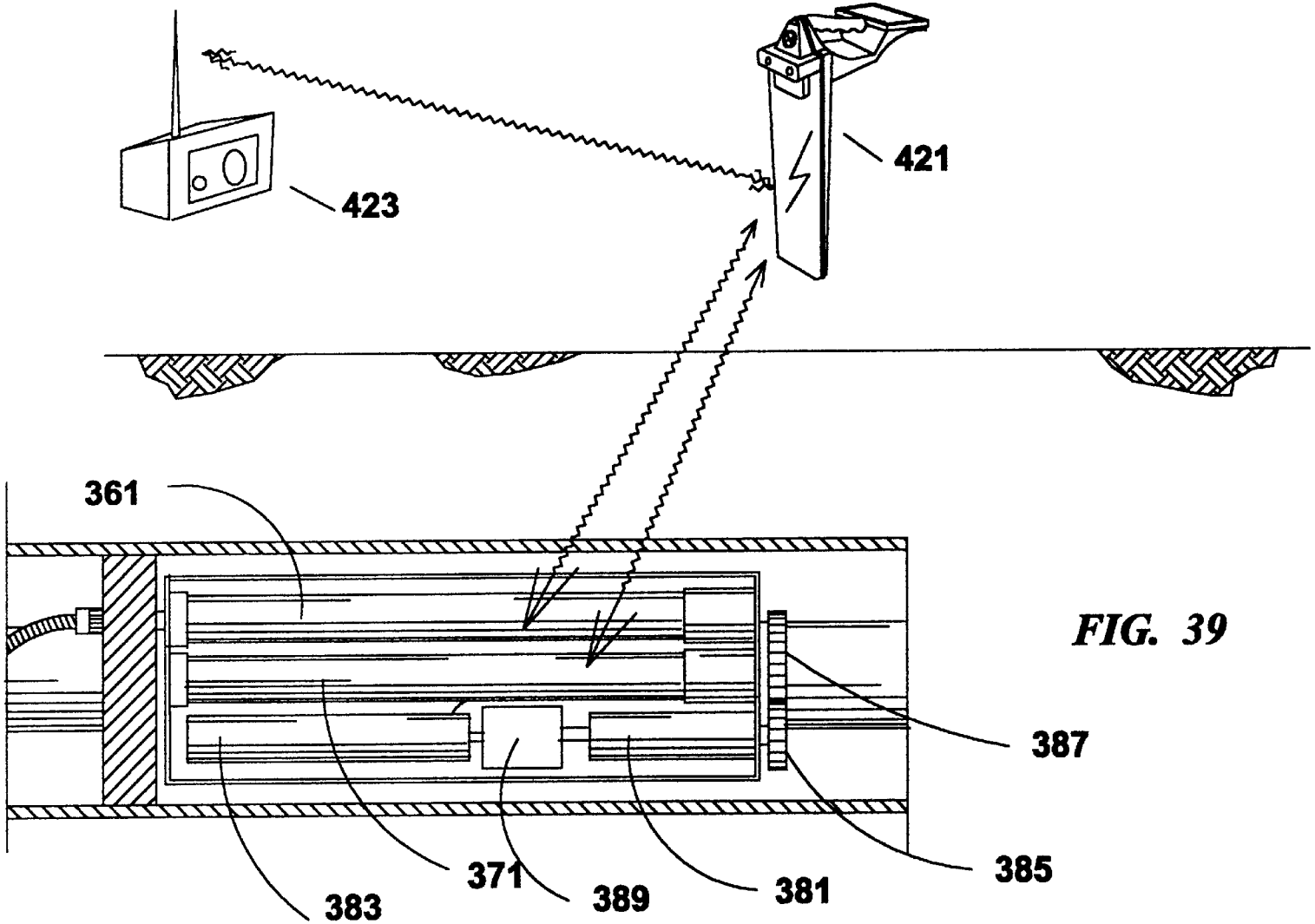
FIG. 39 illustrates an electrical power system employed in the rear shaft support.

Referring to FIGS. 13, 35, and 39 there is disclosed a generator 381 rotated by the shaft 101 for charging the batteries 383 used to provide electrical power to the sondes 361 and 371. The generator 381 has a gear 385 which meshes with a gear 387 connected to the shaft 101 such that as the shaft 101 rotates, it rotates the generator 381 by way of gears 387 and 385 to produce an electrical output which is applied to a regulator 389 having an electrical output which is applied to maintain a charge on the batteries 383. The use of the generator avoids the problems of the batteries becoming discharged which requires the apparatus to be pulled out of the borehole to replace the batteries.

The insides of the three units 111, 113, 115, and 117 contain oil 399 and are in fluid communication with each other. As the shaft 101 and front support housing 111 move forward or rearward relative to units 113, 115, and 117 the volume in the units expand and retracts. Referring to FIGS. 13, 35, 36, and 37, a flexible bladder 401 is located in the unit 117 and has a passage 403 in fluid communication with water exterior of the unit 117 which is the borehole being drilled. Thus water 404 in the borehole used for lubrication purposes, etc. can flow into and out of the bladder 401 by way of the passage 403. The bladder allows for the variation in volume when the apparatus expands and retracts during shifting and for the variation in exterior water pressure without the need of high pressure seals. The volume of the oil is fixed. When the volume of the interior of the units 111, 113, 115, and 117 expands, as the unit 111 moves to the drilling position relative to unit 113, water flows into the bladder from the borehole by way of passage 403 to provide extra fluid in the units to compensate for the increase in volume. When the volume of the units 111, 113, 115, and 117 decreases as the unit 111 moves to the shifting position relative to unit 113, water flows out of the bladder 401 and into the borehole by way of passage 403. Thus the bladder 401 maintains an equal pressure between the oil in the apparatus and the exterior water thereby eliminating the necessity of high pressure seals and preventing a difference in interior and exterior pressure from shifting the shaft when shifting is not desired. In preparing the apparatus for use, when the shaft 101 is in the rearward shifting position and the bladder is collapsed, the units 111, 113, 115, and 117 are filled with oil. When the interior volume is expanded, water flows in the bladder to maintain the interior and exterior pressures equal.

Figure 38:
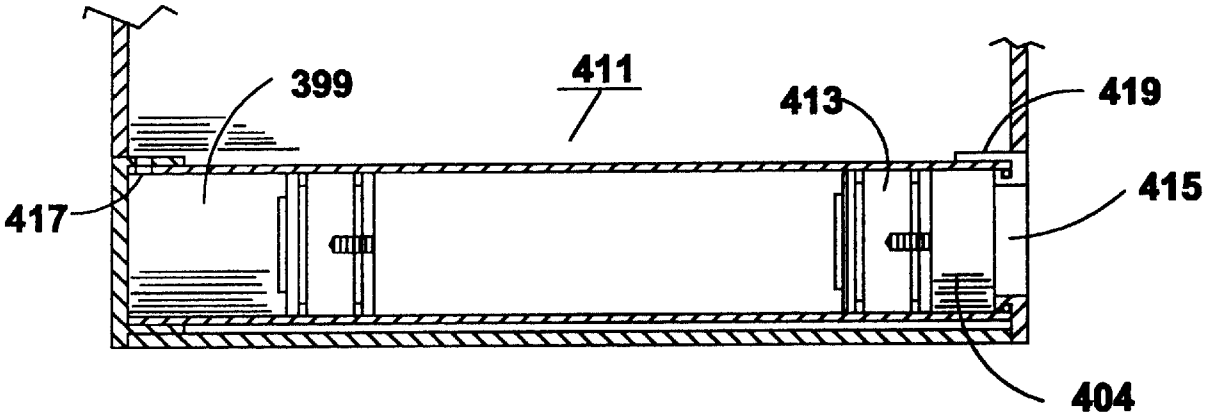
FIG. 38 illustrates a piston for compensating for the change in volume of the apparatus of the invention during the shifting operation.

Referring to FIG. 38, there is disclosed a cylinder 411 which takes the place of the bladder 401. The cylinder 411 has a floating piston 413 and a passageway 415 which leads to the exterior and a passageway 417 which leads to the interior of the housing. Water can enter the cylinder 411 on the right side of the piston 413 as shown in FIG. 38, and oil can enter the cylinder through passageway 417 on the left side of the piston 413. When filling the units 111, 113, 115, and 117 with oil, the piston 413 will be located close to the wall 419. As the interior volume expands, water enters the passageway 415 and oil flows from the cylinder 411 into the housing by way of the passageway 417.

Following is an example of using the subject directional control head (DCH) in boring a hole under a street. Assume that the minimum depth of the borehole under the street is to be 4 feet because a new electric conduit is being installed. At this depth, it is known from past experience that rock starts at 2 feet below the surface.

Surveying the Job

After a walk over and talking to all of the utility companies, it is determined that this situation is typical. It has a water line, a sewer line, a storm sewer, a telephone line and a gas line. The street is about a 120 feet wide.

Set Up

The system is set up about 30 feet from the edge of the street to have room to get down to the minimum depth by the time the apparatus bores to the street. The drill system is set up at an typical angle to horizontal of 23 points which means that the drill unit will start the lead stem in the ground in a way so as to be heading down at approximately 23 inches every ten feet.

Attaching the DCH To the Drill Unit

With the drill unit set up, the operator threads the rear end of the shaft of the DCH onto the lead drill stem which is attached to the drill motor that has the ability to rotate clockwise and counterclockwise and to travel forward and backwards.

The Indicator(s)

The operator changes the batteries in the rotational/depth/pitch indicator called a sonde(s) for short. Sondes are sold by several different companies. They all work about the same. The operator then places the sonde(s) into the DCH. The sonde transmits the information that it has via signals to a receiver that a worker, called a locator, carries above ground approximately overhead of the DCH. It has a range of approximately 25 feet. Thus the maximum depth is about 25 feet. Sondes of different strength can be used if the apparatus is to drill at deeper depths. There are two sondes in this DCH. One sonde is employed to locate the angular position of the cam follower and the other is used to locate the guide housing and thus the cam ring for locating the angular positions of the straight cams. The sondes will each produce different transmission frequencies. In this way, the receiver will be able to recognize each sonde signal. This also helps in the fact that sometimes a sonde of a certain frequency will have trouble in an area because of interference. The operator then calibrates the sondes to make sure that they will give a good reading.

Choosing a Drill Bit

The operator chooses a drill bit that will cut the rock the most efficient. He then threads it on to the front of the shaft that is passing through and is part of the DCH. This is what cuts the hole.

Beginning the Bore

The operator turns on the water which passes through the hollow drill stem and then through the hollow shaft of the DCH into the borehole by way of openings formed in the drill bit. The water is used to flush the cuttings away from the DCH, to cool the DCH, and to lubricate the borehole. The water returns by way of the space between the DCH and the wall of the borehole. In some cases water for lubrication purposes is not needed and hence the shaft 101 may be solid. Next the operator turns on the rotation mechanism and begins to thrust into the ground. The DCH is in a straight relation with the drill stem. This means the guide housing is not outside of the cutting radius of the drill bit. As the DCH starts into the ground, it may rotate but it does not matter since the housing sonde will keep track of how much it rotates.

Connecting Another Drill Stem

When the first drill stem is finished being drilled, the operator stops the thrust and rotation, shuts off the water, and unthreads the drill motor from the first stem. The operator then backs up the drill motor and attaches another stem. With two or more stems attached the whole stem assembly is known as a drill string.

Locating the DCH

The worker that is in charge of locating the whereabouts of the DCH takes a reading. At this point a decision is made to keep going as headed or to change the directions. The operator decides to continue a little further. Mid-way through this stem he checks the whereabouts of the head and decides to start leveling out.

The Shifting Sequence

The drill unit operator pulls back on the drill string. The shaft that passes through the DCH pulls back also. The DCH staying still allows the shaft to slide for about 2 ½ inches inside the DCH. The cam follower that is longitudinally locked to the shaft also slides with the shaft. This action pulls the cam follower out of the cam it had been in. Now the cam follower is free of the cam ring and can rotate independent of the cam ring. At the same time the cam follower becomes rotational locked to the shaft via the clutch. This allows the drill unit operator to have control of the rotational location of the cam follower. The cam follower is geared to the first sonde. This allows the locator to watch and know the rotational location of the cam follower. Watching the monitor, on which the signal is displayed, the drill unit operator rotates the drill string which in turn rotates the cam follower. When the cam follower gets to the location that is needed, in this case straight down, the drill unit operator stops the rotation. The second sonde is checked to make sure that the cam that is about to be entered is a "straight cam". If it is, then the operator rotates the stem a very little amount to line up with the cam that is next to a "straight cam". This may not be the optimum direction but it is only a fraction of a revolution off and can be corrected if need be by going into the cam on the other side of a "straight cam". If it is not, then the drill unit operator pushes on the drill string disengaging the shaft from the cam follower rotational and engaging the cam follower into the beginning of the cam that was chosen. As soon as the shaft is unlocked rotational from the cam follower, it is rotated to start cutting the bore hole. The cam follower continues to engage further into the cam forcing the cam out away from the center of the shaft and since the cam is attached to the inside of the guide housing the guide housing is forced away from the center of the shaft and outside of the cutting radius of the drill bit. Contacting the wall of the bore hole the guide housing forces the drill bit in the opposite direction. In this case up.

Continuing the Bore

The operator can continue in this mode for as long as the operator feels it is necessary to achieve the goal. The operator can repeat the shifting sequence anytime to guide the drill bit to where he wants it to go.

Going Straight

There are two straight cams. When either of these cams is engaged by the cam follower, the guide housing will stay within the cutting radius of the drill bit having no effect on the direction of the DCH.

Going Any Direction

There are numerous cams around the radius of the DCH giving a choice to the operator as to which direction to travel.

Finishing the Bore

When the other side is reached, the DCH is removed and either the utility is installed or a back reamer is connected to the drill string and the bore hole is enlarged while pulling back the drill stem.

Referring to FIGS. 40–45, there is disclosed another embodiment of the invention employing a single housing. In FIGS. 40–45 like reference numerals identify the same components as identified in FIGS. 1–39. In this respect the embodiment of FIGS. 40–45 comprises the shaft 101 and drill bit 105 supported for rotation in a tubular housing guide 451 and for longitudinal movement relative to the housing 451. The embodiment also includes the cam follower housing 151 supported for rotation in the housing 451 and the cam follower 131 with the cam members 221 and 223 supported for rotation about the shaft 101. The cam follower housing 151 cannot move longitudinally relative to the housing 451 and the cam follower 131 cannot move longitudinally relative to the shaft 101. The shaft 101 can move longitudinally relative to the housing 451 to a forward drilling position and to a rearward shifting position. Connected to the shaft 101 is the sprocket 125 and connected to the rear of the cam follower housing 151 is the ring 263 with the spring biased balls 267 for engaging the sprocket 125 when the shaft is in a shifting position and for disengaging the sprocket 125 when the shaft 101 is in a drilling position. A cam means 461 is provided which is fixed to the housing 451 and cannot rotate in the housing or move longitudinally in the housing. The cam means 461 comprises a conical shaped inner surface 463 with two stops 465, 180 degrees apart formed on the interior of the surface 463 spaced forward a small amount relative to the rear end 461RE of the device 461.

In the shifting position of the shaft 101, the cam members 221 and 223 do not engage the cam device 461 and the follower housing 151 is connected to the shaft 101 by way of the clutch 261 comprising the ball ring 263 and balls 267 and sprocket 125 such that rotation of the shaft 101 will rotate the cam follower housing 151 angularly relative to the cam means 461. At the desired angular position, the shaft is moved forward to release the balls 267 from the sprocket 125 and to cause the cam member 223 to engage the cam surface 463 to tilt the housing 451 relative to the axis of the shaft 101 for turning purposes or to engage the stops 465 to maintain the housing 451 concentric with the shaft 101. The stops 465 are spaced forward of the rear end 461RE of the means 461 far enough to allow the ring balls 267 to be released from the sprocket 125 and to prevent the cam member 223 from causing the housing 451 to tilt relative to the shaft 101. It is to be understood that the cam means 461 may be used in the embodiment of FIGS. 1–34 in lieu of the cam ring 141 with its plurality of separate cams and vice versa.

The arrangement for allowing the shaft 101 to rotate in the housing 451 and the housing 451 to tilt relative to the shaft 101 comprises a ball joint 471 formed at the front of the housing 451 and a flexible support 491 formed at the rear of the housing 451. The ball joint 471 comprises annular support structure 473 connected to the inside of the housing 451 having an annular concave surface 475 which mates with an annular convex surface 477 of structure 479 which supports bearings 481 for allowing the shaft 101 to rotate in the housing 451 and to move longitudinally relative to the housing 451. The housing 451 can tilt relative to the shaft 101 at the ball joint surfaces 475 and 477. At the rear end, annular structure 493 is connected around the shaft 101 with an annular flexible member 495, C-shaped in cross-section, having its radially inner end connected to the member 493 and its radially outer end connected to the inside of the housing 451 to allow the rear end of the housing 451 to tilt relative to the shaft 101. Tubular guides 495 are connected to the member 493. Rods 497 are connected to the inside of the housing 451 and extend into the members 497 and act as radial guides as the housing 451 tilts relative to the shaft and limit longitudinal movement of the member 493 in the forward and rearward direction. The shaft 101 can rotate within member 493 and move forward and rearward through member 493 for shifting purposes. A seal is formed between the member 493 and the shaft 101.

Figure 45:
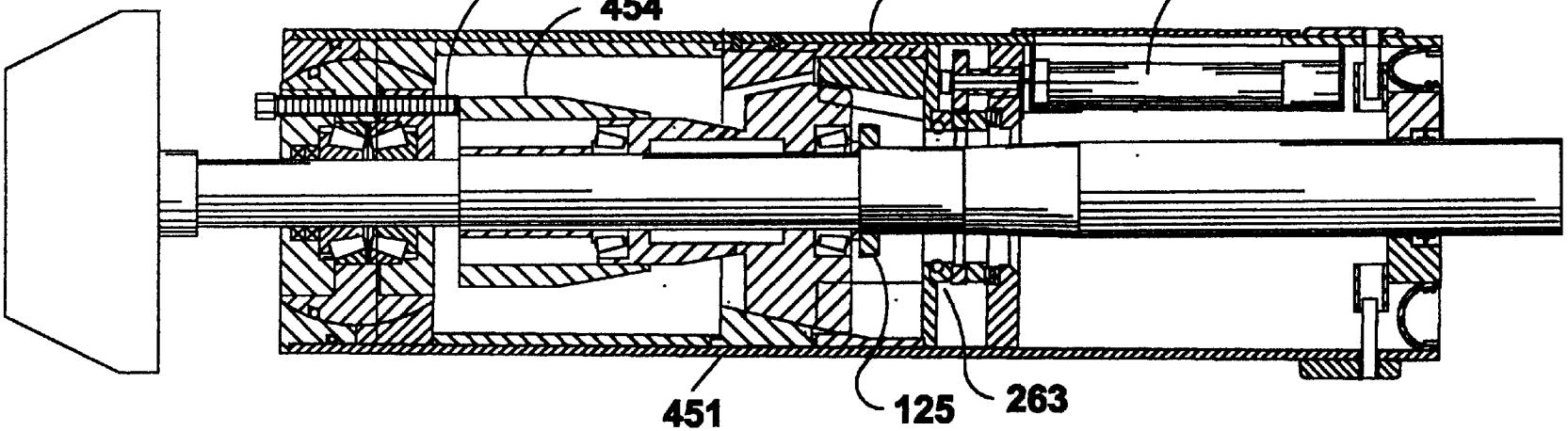
FIG. 45 is a cross-section of the apparatus of FIG. 40 with the housing tilted relative to the shaft.
Figure 43:
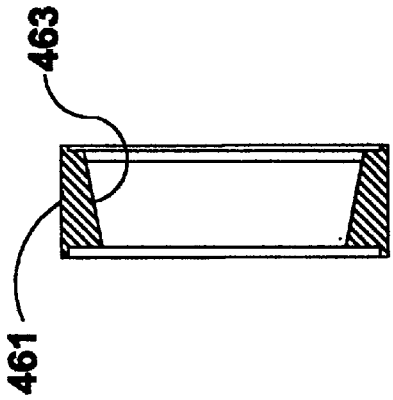
FIG. 43 is a cross-section of FIG. 42 taken along the lines 43—43 thereof.

FIG. 45, shows the housing 451 tilted relative to the shaft 101 and FIG. 40 shows the housing 451 concentric about the shaft 101.

Although not shown, the sondes 361 and 371 and the generator and battery arrangement of FIG. 39 may be located in the housing 451. The housing 451 has a window 451P formed of a material which will allow transmission of wireless signals.

A radius adjusting screw 453 and a stop disk 454 connected to the cam follower ring 131 are provided to vary the radius of turning of the apparatus. When the screw is screwed inward, it limits and reduces the forward travel of the shaft and hence of the cam follower in relation to the guide housing and hence results in a larger turning radius for all turning positions. When the screw 453 is screwed outward (to the left as seen in FIG. 42), it allows the shaft and hence the cam follower to travel further to a forward position and hence results in a smaller turning radius of the apparatus.

The housing 451 of the embodiment of FIGS. 40–45 will be filled with oil but since its volume does not change significantly during shifting, the bladder or piston arrangement of FIGS. 13, 35–38 may not be employed. The member 495 also act as a pressure and volume equalizer which eliminates the need of a piston and bladder. In the embodiment of FIGS. 40–45, turning can be accomplished by tilting the housing relative to the shaft to allow the rear edge of the housing to engage the borehole wall to allow the front edge of the opposite side and hence the drill bit to move in an opposite direction to carry out turning of the unit as it drills.

In the embodiment of FIGS. 40–45 the side cutters 171 and 173 of the embodiment of FIGS. 1–39 will not be employed.

The two sondes 361 and 371 are commercially available and each sends signals to a portable receiver or detector 421 at the surface which in turn sends the information to a receiver 423 at the surface coupled to a cathode ray tube display. The signals sent separately provide information of the depth of the sonde, the pitch or tilt of the axis, and the angle of roll about its axis. The sonde 371 is attached to the guide housing 113 and hence provides information of the location of the straight cams and the sonde 361 is attached to the cam follower housing and hence rotates with the cam follower housing when it rotates relative to the guide housing 113. In the prior art, sondes similar to that of units 361 and 371 have been used to locate directional drilling devices. The known sondes are always fixed to the housing of the drilling device and are not attached to a rotating member in the housing.

The two sondes 361 and 371 transmit at different frequencies. For example, sonde 361 may transmit signals at 8 MHz and sonde 371 may transmit signals at 33 MHz to be displayed. Each unit 421 and 423 has three separate displays to allow the depth, roll and pitch to be displayed. The unit 423 will be located at a fixed position near the drilling system 103 and the unit 421 is a portable unit that can be carried by an operator. Assume the embodiment of FIGS. 1–34 is to be used. The position of the cam 256 is defined as the 12 o'clock position. The operator moves the unit 421 around until the strongest signal is picked up. This indicates to the operator that the sonde 361 is directly below the unit. The operator then sets the unit on the ground and at that spot he can operate the depth switch to obtain depth information from sondes 361 and 371. The pitch and roll are readable at all times when the receiver is in range of the sonde. The information of roll from the two units 361 and 371 is important. The operator wants to know the position of the straight cam, for example cam 241 relative to the 12 o'clock position. When drilling first begins, the operator knows which cam the cam follower is engaging. This tells him the rotational position of the straight cam. As long as the apparatus is in the drilling mode, the position of the straight cams will have the same relationship with the sonde 361 as when drilling began since during drilling, the sonde 361 is connected to the cam follower which engages a cam. When a change in direction of drilling is desired, the operator switches to the shifting mode. In this mode the sonde 361 is no longer connected to the cams but is still linked to the cam follower. The cam follower is free to be rotated in the housing which means the sonde 361 is free to be rotated in relation to the housing. Knowing the position of the straight cams, the operator can locate the cam follower to engage the desired cam.

If the housing rolls during drilling, the cams will also roll. By knowing the direction and amount of housing roll, the operator can use this information to determine the direction and amount of roll of the straight cams since the cams will roll with the housing. This information allows the operator to determine position of the straight cams which allows him to locate the cam follower to engage the desired cam. The housing sonde 371 is desirable but not necessary in all cases.

Figure 46:
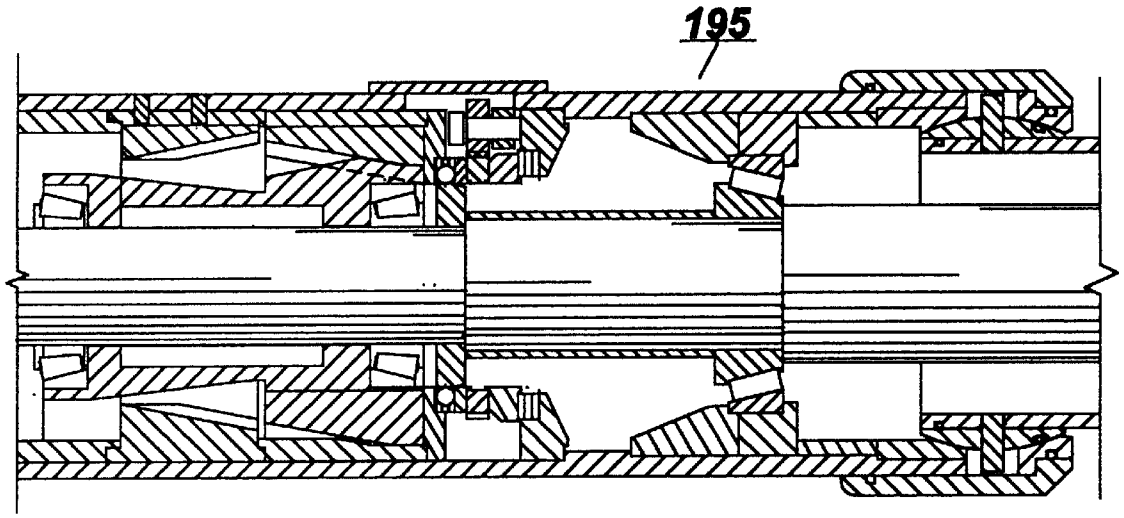
FIGS. 46 and 47 illustrate a rear shifting guide with the shaft in the drilling mode in FIG. 47 and in a shifting mode in FIG. 46.
Figure 47:
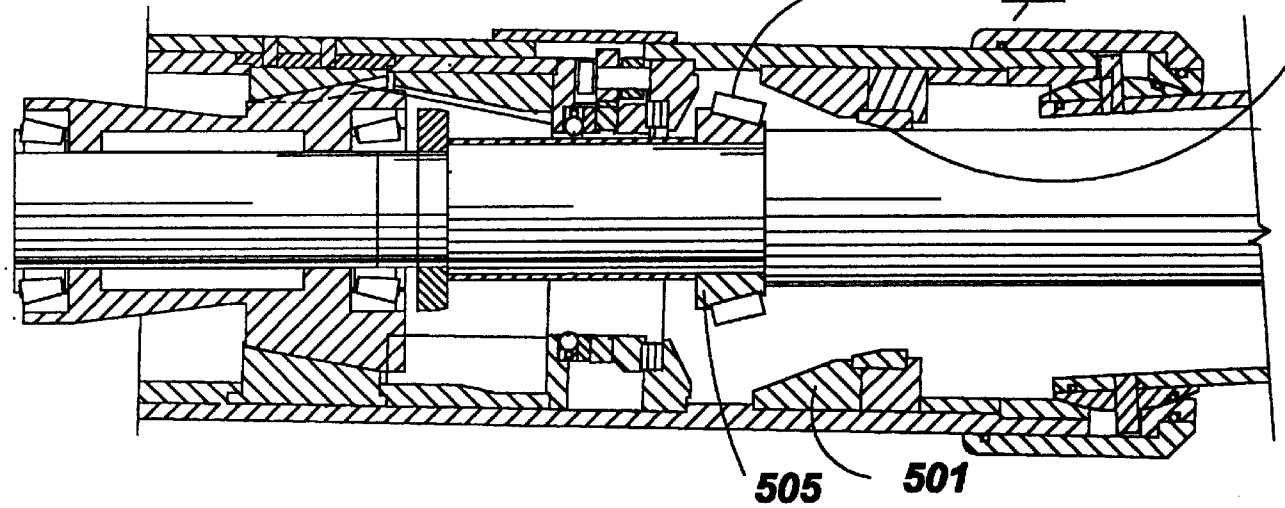
Figure 120:
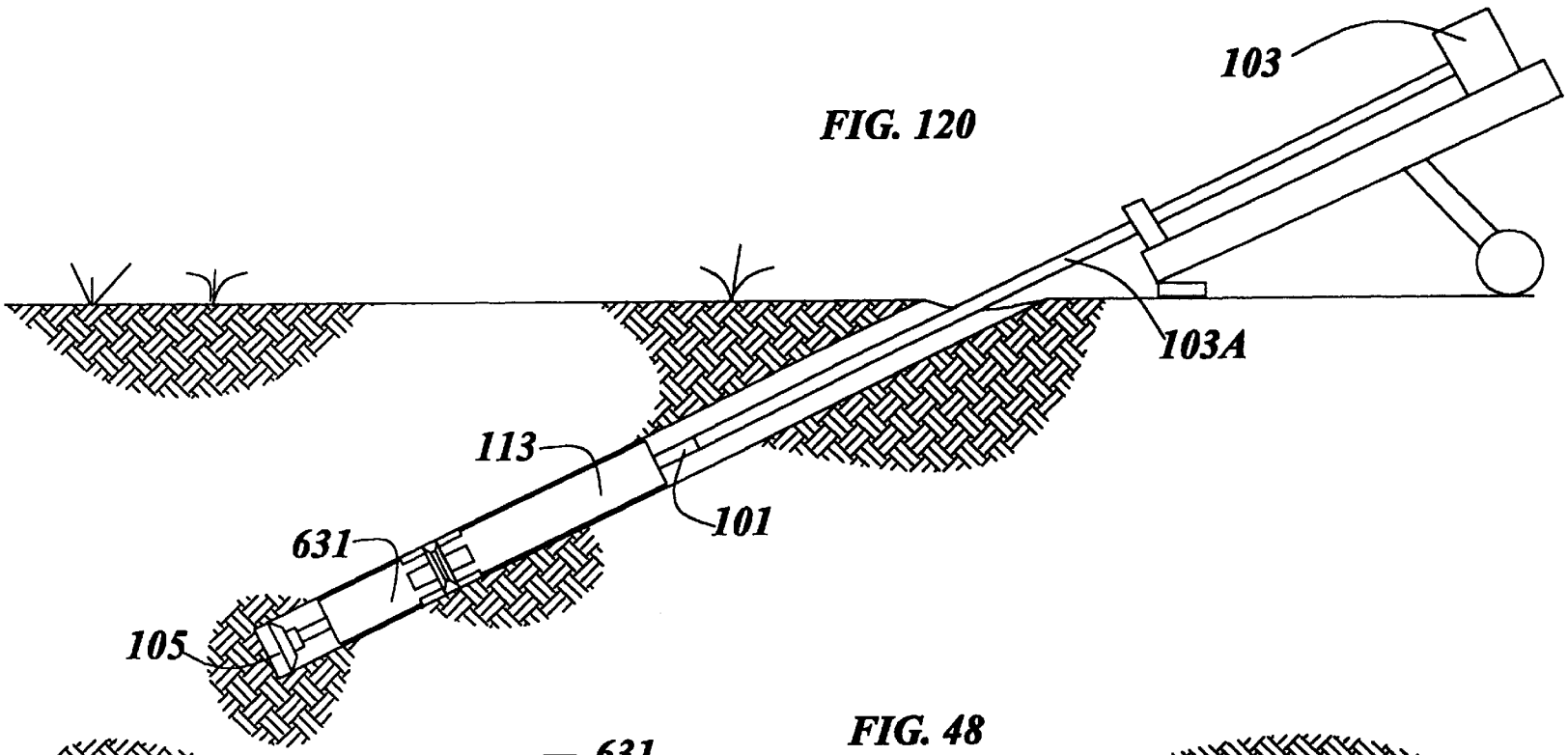
Figure 48:
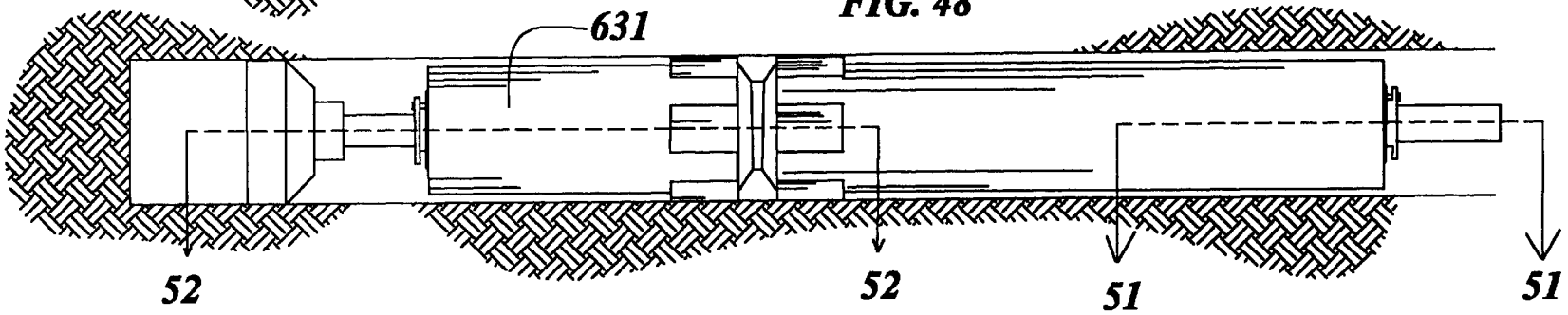
FIG. 48 is a side view of another embodiment of the apparatus of the invention.
Figure 49:
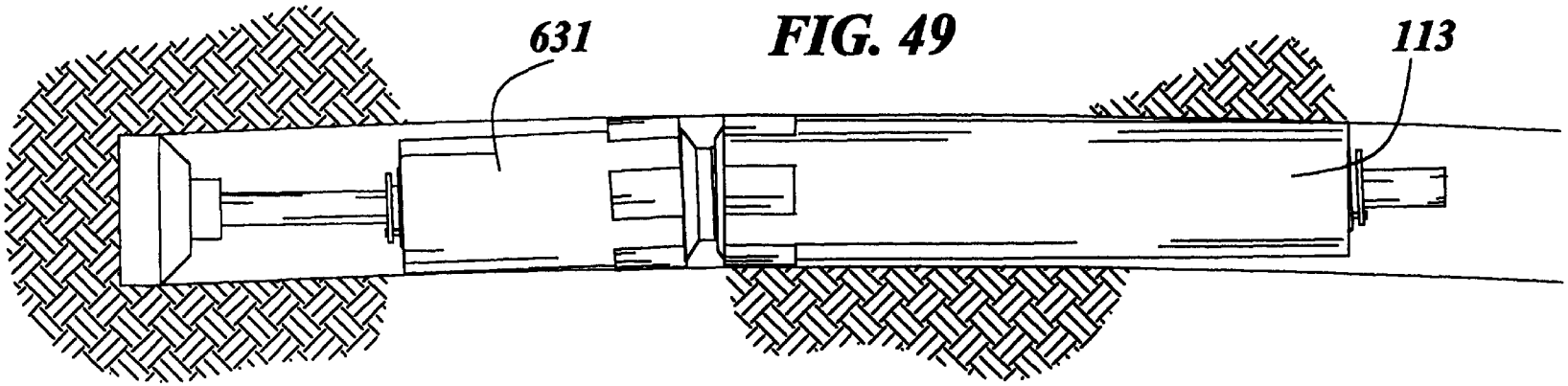
FIG. 49 illustrates the apparatus of FIG. 48 drilling downward.
Figure 50:
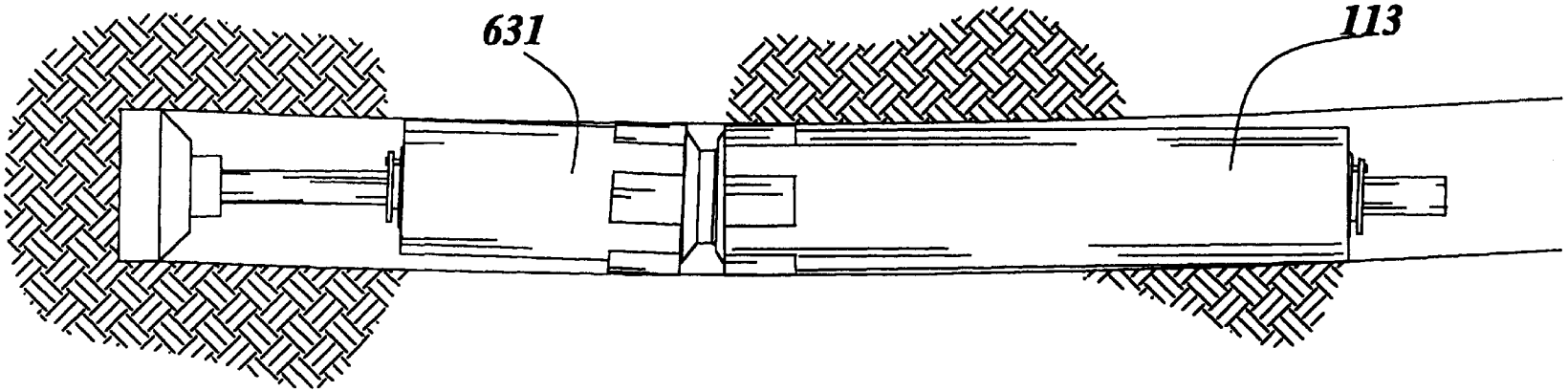
FIG. 50 illustrates the apparatus of FIG. 48 drilling upward.
Figure 51:
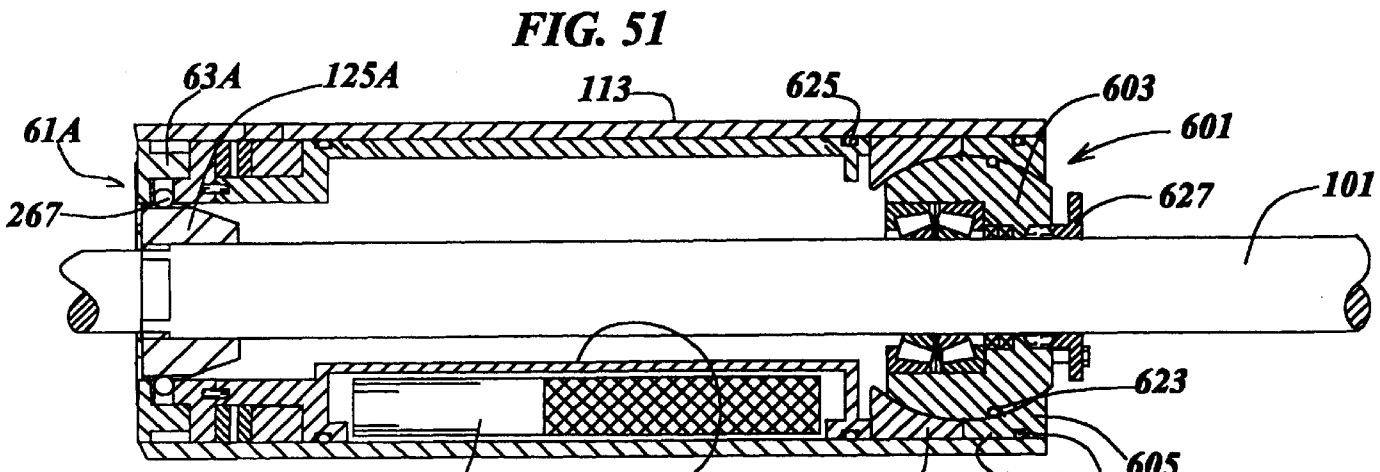
FIG. 51 is a cross-section of FIGS. 48 taken along the lines 51—51 thereof.
Figure 52:
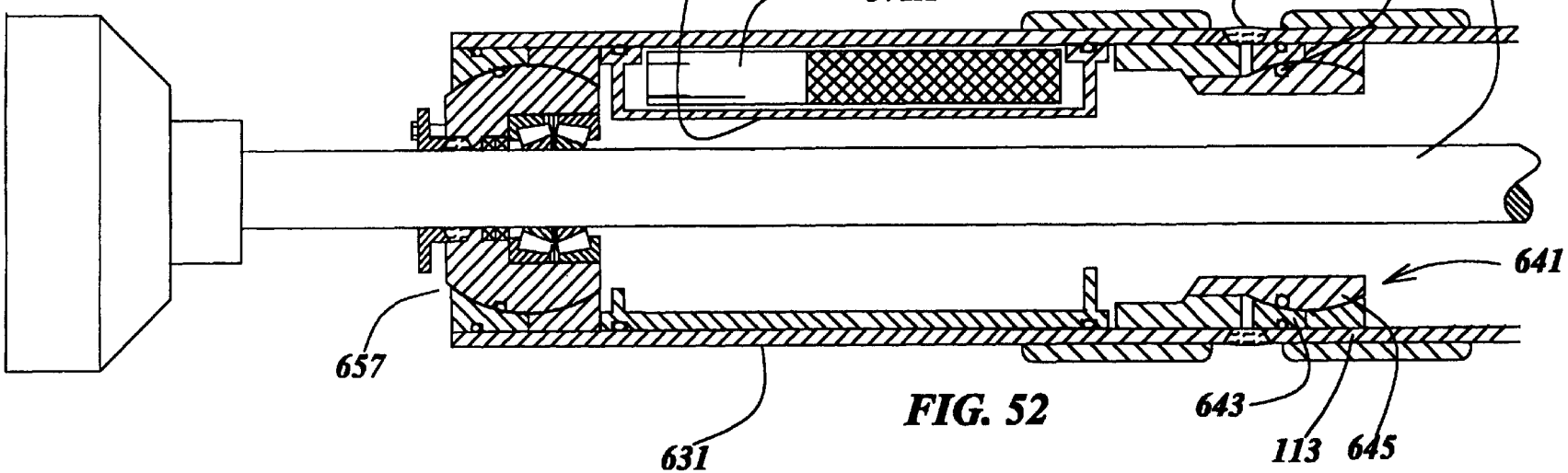
FIG. 52 is a cross-section of FIGS. 48 taken along the lines 52—52 thereof.

Referring now to FIGS. 46 and 47, there is disclosed a modification of the guide housing 113 of the embodiment of FIGS. 1–34 and of the embodiment of FIGS. 40–45. The housing shown is the guide housing of FIGS. 1–34. Attached to the inside of the tube 195 is an annular cup 501 having bearing surfaces 503 for receiving an annular cone 505 having bearings 507. In the drilling mode, the bearings 505 disengage the cone 501. In the shifting mode, the bearings 507 of the cone 505 engage the bearing surfaces 503 of the cone 501. This provides a precision concentric relationship between the housing 195 and the shaft 101 when the shaft is in the shifting mode. Without this feature, the sprocket seats against the outer clutch ring 263 when the shaft is in the shifting mode which places a load on the sprocket.

As indicated above, the rotating guide cutters 171 and 173 are perpendicular to the shaft 101. In an alternative embodiment, these rotatable cutters may be located parallel to the shaft 101. In this embodiment annular gears are coupled to the shafts of the cutters 171 and 173 which are supported by bearings coupled to the housing for rotation. An annular gear is coupled to the shaft 101 which mesh with the annular gears coupled to the shafts of the cutters 171 and 173 to rotate the cutters 171 and 173. The cutter arrangement in the alternative embodiment tend to create roll to the shaft 101 and the cutters 171 and 173 with shafts perpendicular to the shaft 101 are preferred.

Referring to FIG. 15, there is disclosed several metal leaf springs 553 connected to the guide housing 113 with a drag strip 551 connected to each spring 553. The strips 551 may have tungsten carbide members welded thereto. The purpose of the members 553, 551 is to provide a drag on the housing 113 while the shaft 101 and housing 111 are moved forward from the shifting position to the drilling position. The drag means facilitates shifting but will not affect forward drilling since the drill system 103 has sufficient power to overcome any drag produced by the members 553, 551. The members 553, 551 may be attached to the housing 117 rather than to the housing 113. The spring members 551 also help to keep the housing from rotating.

Referring now to FIGS. 48–61, there will be disclosed another embodiment of the apparatus of the invention. In this embodiment, like reference numerals identify the same components as identified in FIGS. 1–34. In the embodiment of FIGS. 48–61, the guide housing 113 is supported around shaft 101 by a rear ball joint 601 which comprises an annular ball member 603 coupled to the shaft 101 and a socket 605 coupled to the inside of the housing 113. The ball joint 601 is similar to ball joint 471. The socket 605 comprises two annular half members 605A and 605B coupled to the inside of the housing 113 at its rear end. Members 621, 623 and 625 are O-rings and member 627 is an annular holding member secured around the shaft 101 and to the ball 603. A forward hollow cylindrical housing 631 is provided. The front end of the guide housing 113 is coupled to the rear of the forward housing 631 by way of a second ball joint 641 comprising an annular concave member 643 coupled to the inside of the front of the guide housing 113 and an annular ball member 645 coupled to the rear end of the housing 631. Members 643 and 645 mate such that housings 113 and 631 can pivot relative to each other by way of the ball joint 641. Member 647 is an annular flexible or elastic member connected between the forward end of housing 113 and the rearward end of housing 631 to form a waterproof joint. Member 649 is an O-ring. The front end of the housing 631 is secured to a ball joint 657 which is similar to ball joint 601.

A clutch 61A (similar to clutch 61) comprising a sprocket 125A connected to the shaft 101 and an annular ball ring 63A with balls 267 connected to the end of a cam means 750 is provided. A deflecting means is provided in the guide housing 113 between the ball joints 601 and 641. Referring to FIGS. 53–57, the deflecting means comprises an annular cam follower 731 and the annular cam means 750. The cam follower 731 comprises two members 741 and 743 positioned 180 degrees from each other with member 743 protruding radially outward from the follower 731 further than member 741. The cam follower 731 is supported for rotation around the shaft 101 by members 751 and 753. Collars 732 secured to the shaft 101 prevent the follower 731 from moving longitudinally on the shaft 101. The cam means 750 is supported to rotate in the guide housing by bearings 761 but is prevented from moving longitudinally in the guide housing by members 754. The cam means 750 which is of simpler construction than the follower housing 151 and cam ring 141 takes the place of the follower housing 151 and cam ring 141 of the embodiment FIGS. 1–34. The cam means 750 is supported by the cam follower 731 via the cam follower members 741 and 743. On the rear of the cam means 750 is coupled the ball ring 63A of the ball clutch 61A. The cam means 750 has two slots 750A and 750B cut into its interior walls. The two cam follower members 741 and 743 are designed to slide in the two slots 750A and 750B respectively. The side walls of the two slots 750A and 750B keeps the cam follower 731 and cam means 750 rotational tied to each other. At the forward and rearward ends of the cam means 750, the slots 750A and 750B are parallel to each other and to the axis of the cam means 750 but are offset from the axis. The intermediate portions of the two slots 750A and 750B are parallel to each other but form an acute angle relative to the axis of the cam means 750. Due to the different radial dimensions of the members 741 and 743, the cam follower members 741 and 743 keep the axis of the cam means 750 parallel to the axis of the shaft 101 when the cam follower 731 is in a rearward position relative to the cam means 750 and in a slanted or tilted position relative to the axis of the shaft 101 when the cam follower 731 is in a forward position relative to the cam means 750. This causes the guide housing 113 to tilt relative to the axis of the shaft 101 thereby causing the direction of the drilling to turn or move up, down, sideways etc. as described previously. Thus in any rotational position of the cam follower 731 and cam means 750 relative to the guide housing 113, which allows for forward movement of the cam follower 731 relative to the cam means 750, the guide housing 113 will be deflected off center relative to the axis of the shaft 101 when the cam follower 731 is in a forward drilling position relative to the cam means 750. Also when the cam follower 731 is pulled backward relative to the cam means 750, the axis of the guide housing 113 will be parallel with the axis of the shaft 101.

Figure 61:
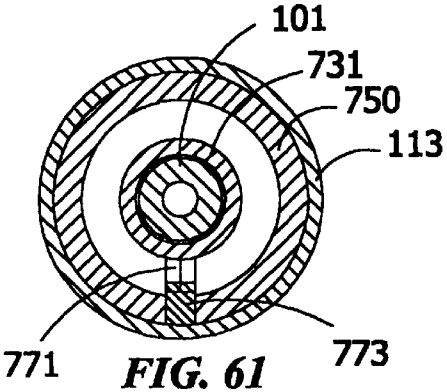
FIG. 61 is a cross-section of FIG. 55 taken along the lines 61—61 thereof.
Figure 59:
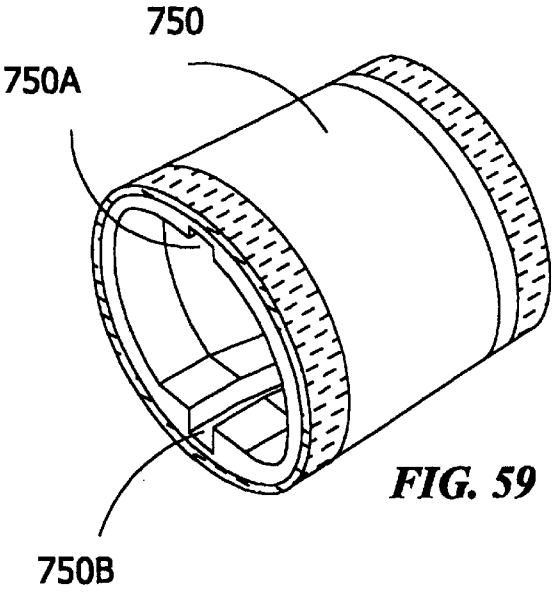
FIG. 59 is an isometric view of the left end of the cam means of FIG. 58.

Connected to the front of the cam follower 731 is a stop 771. The width of the stop 771 is small compared with the outer circumference of the cam follower 731 as shown in FIG. 61. A second stop 773 is attached to the inside of the guide housing 113 forward of the slots 750A and 750B. The width of the stop 773 is about equal to the width of the stop 771 and is small compared with the inner perimeter of the guide housing 113 as shown in FIG. 61. The stop 773 is located forward of the cam means 750 at a distance that allows the cam follower stop 771 to contact it in a longitudinal position that allows the sprocket 125A to be disengaged from the ball ring 63A of the clutch 61A, but not far enough to allow any significant deflection of the guide housing 113 relative to the shaft 101. Thus in this position, the axes of the housing 113 and of the shaft 101 coincide allowing the apparatus to drill straight. Since the width of the stops 771 and 773 are small, the cam follower 731 and cam means 750 can be rotated to angular positions in a large arc around the shaft 101 without the stop 771 contacting the stop 773 to allow the guide housing 113 to be deflected relative to the shaft in any angular position within this arc. In one embodiment, the arc may define an angle of about 350 degrees.

One of the purposes of the forward housing 631 is to act as a boot for the swiveling of the guide housing 113. Also secured in the forward housing 631 is a roll sonde 371A, which is similar to sonde 371, as previously described to transmit to the surface the rotational position of the housing stop 773 which is the straight position. The sonde 371A is supported in a housing 775 within the housing 631. A sonde 361A similar to sonde 361 as previously described is secured in the housing 113 to transmit to the surface rotational position of the stop 771 and cam follower 731. The sonde 361A is secured in a housing 777 which is connected to the cam 750 for rotation therewith. The sonde 361A rotates with the housing 777.

In all embodiments of the apparatus of the invention, sonde 371 or 371A may be used to sense and transmit to the surface the rotational position required for the cam follower to be in to cause the apparatus to drill straight and the sonde 361 or 361A may be used for sensing and transmitting to the surface the rotational position of the cam follower.

Figure 55:
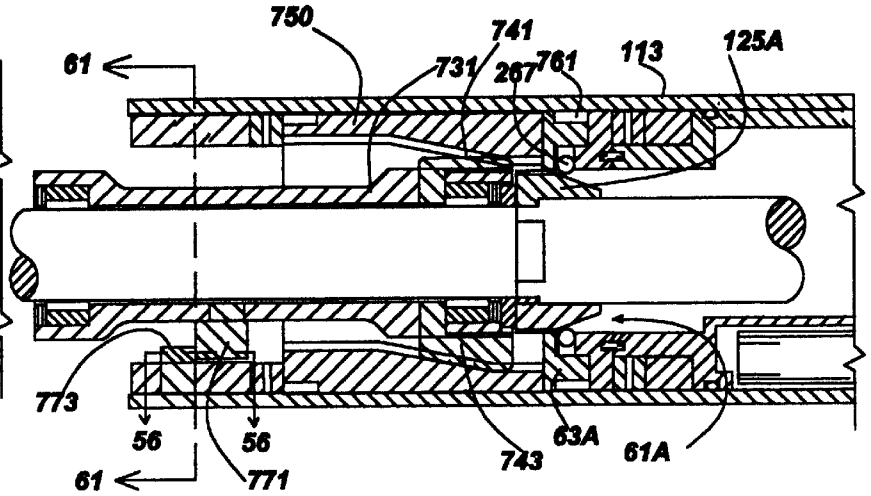
FIG. 55 is a cross-sectional view of part of the apparatus of FIG. 48 showing the shaft in a position for drilling straight.
Figure 55A:
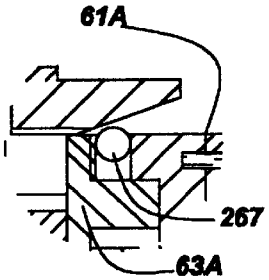
FIG. 55A is an enlarged portion of the clutch of FIG. 55.
Figure 56:
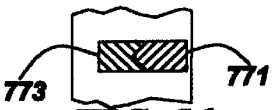
FIG. 56 is a cross-section of FIG. 55 taken along the lines 56—56 thereof.
Figure 53:
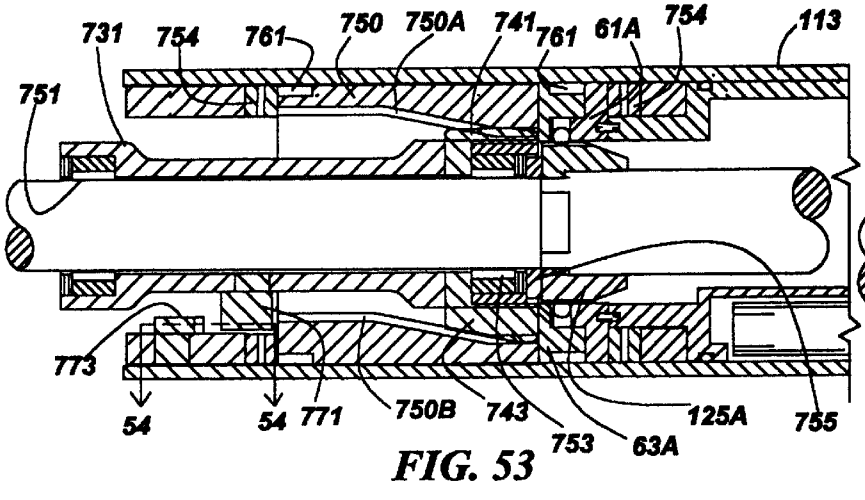
FIG. 53 is a cross-sectional view of part of the apparatus of FIG. 48 showing the shaft in a shifting position.
Figure 54:
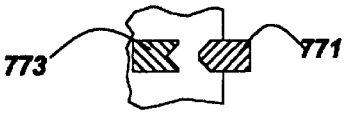
FIG. 54 is a cross-section of FIG. 53 taken along the lines 54—54 thereof.
Figure 57:
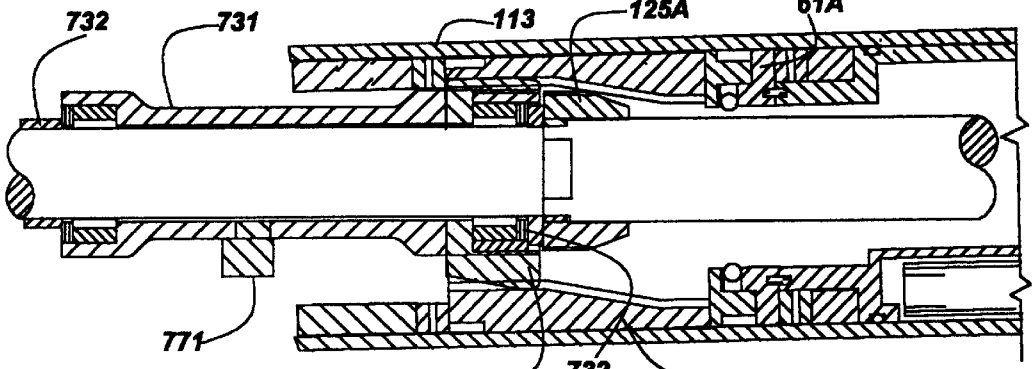
FIG. 57 is a cross-sectional view of a portion of the apparatus of FIG. 48 showing the apparatus in a turning position.
Figure 60:
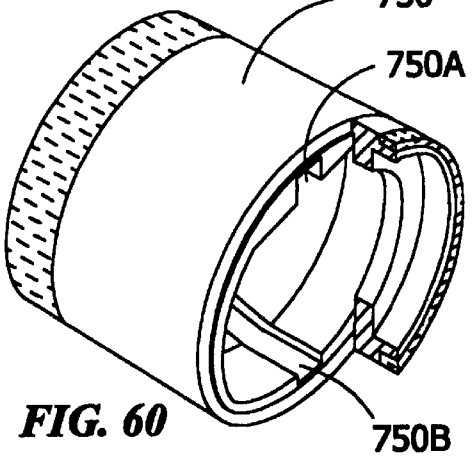
FIG. 60 is an isometric view of a portion of the right end of the cam means of FIG. 58.
Figure 58:
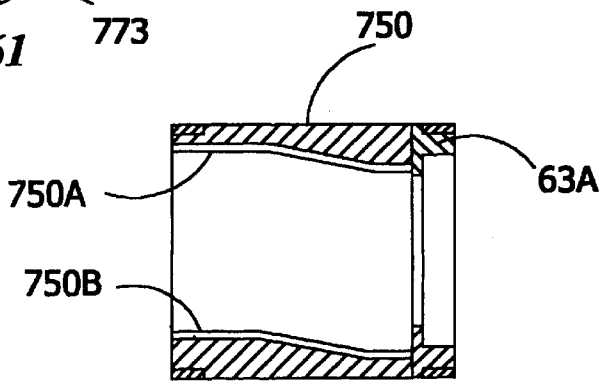
FIG. 58 is a cross-sectional view of the cam means of FIGS. 53, 55, and 57.

Referring to FIG. 53, in order to change the direction of drilling, the shaft 101 is pulled backwards relative to the guide housing 113 cam means 750, and ball ring 63A of the clutch 61A which in turn pulls back the cam follower 731 and sprocket 125A relative to the guide housing 113, cam means 750, and ball ring 63A. In this position the sprocket 125A is engaged rotational with the ball ring 63A of the clutch 61A and cam means 750. The sprocket 125A is fixedly connected to the shaft 101 such that it rotates with the shaft 101 and moves longitudinally with the shaft. When the shaft 101 is rotated in this longitudinal position, the clutch 61A, cam means 750 and cam follower 731 are rotated also. When the described rotational position is reached, the operator stops rotating the shaft. Referring to FIGS. 55 and 57, the shaft 101, sprocket 125A, and cam follower 731 then are pushed forward relative to the guide housing 113, cam means 750, with the ball ring 63A of the clutch 61A disengaging the sprocket 125A. This frees the shaft 101 to rotate relative to the cam follower 731 cam means 750 and guide housing, thus allowing the shaft 101 to drill while the cam follower 731, cam means 750 and guide housing 113 are prevented from rotating by the roll stabilizers 181 and 183 located in the side holes 175 and 177 cut by the side cutters 171 and 173 which are not shown in FIGS. 48–61. The spring loaded wings 551 also may be employed to prevent the guide housing 113 from rotating.

Figure 62B:
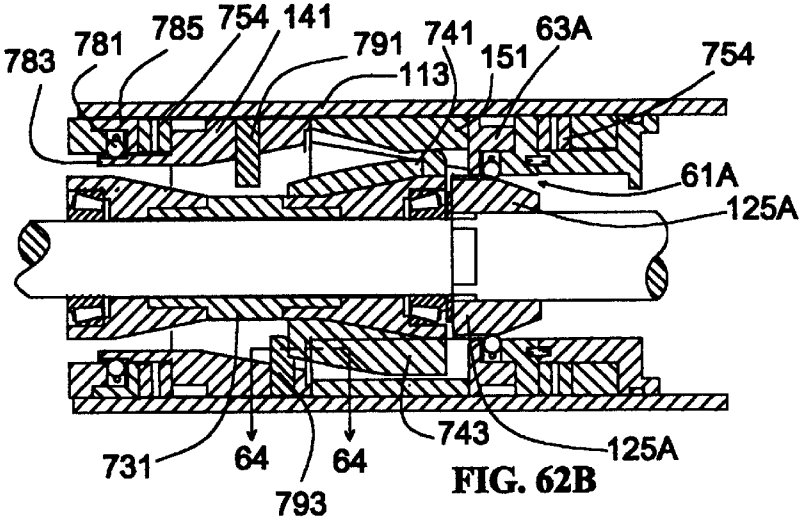
FIG. 62A, 62B, and 63 are cross-sectional views of another embodiment of the apparatus of the invention with the shaft in a forward drilling position; a shifting position; and in an position to rotate the cam means.
Figure 64:
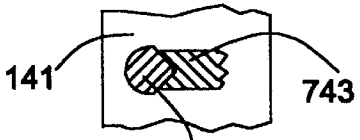
FIG. 64 is a cross-section of FIG. 62B taken along the lines 64—64 thereof.
Figure 62A:
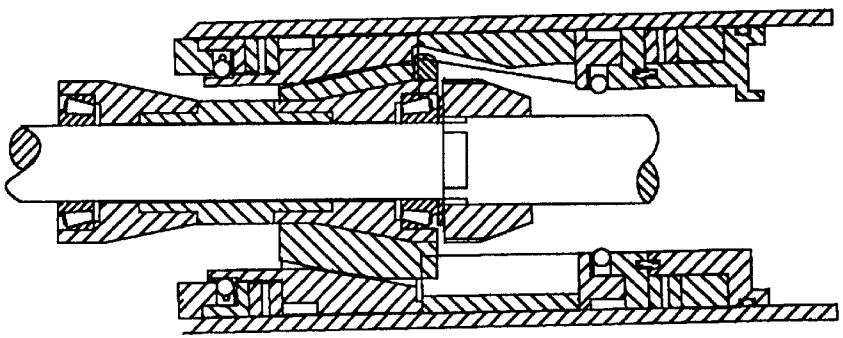
Figure 63:
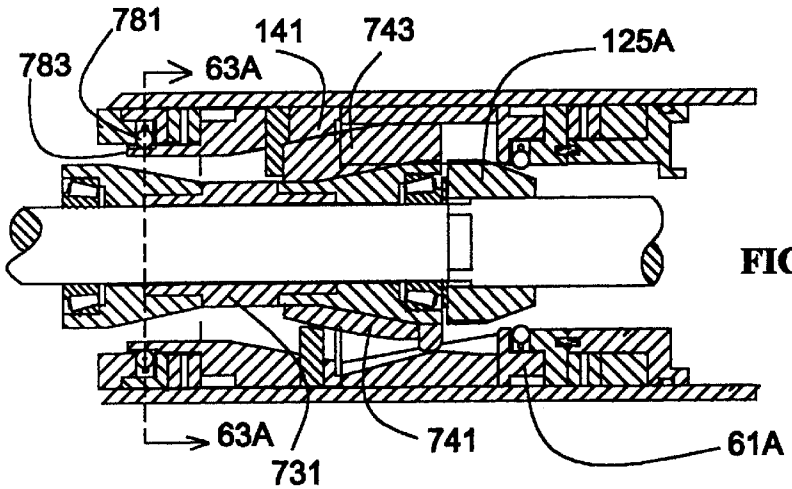
Figure 63A:
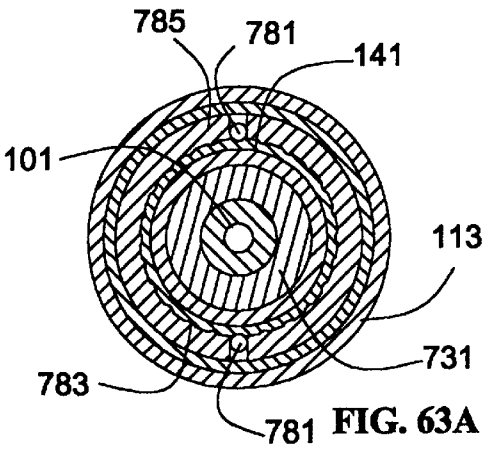
FIG. 63A is a cross-section of FIG. 63 taken along the lines 63A—63A thereof.

In the embodiment of FIGS. 1–34 the cam ring 141 is locked rotationally to the guide housing 113 and one or more clock positions have to be used for the straight mode and which prevents a turn from being conducted in this direction or clock position. Referring to FIGS. 62–64 there will be disclosed an embodiment that can reposition the straight position or cam 241 of FIG. 30 to a different clock position thus positioning one of the other cams or turning positions in the former place of cam 241. The other straight cam 255 of FIGS. 30 will be a sloped cam. Furthermore, if the turning positions or cams are of different amounts or slope, than different amount or slopes of turn can be directed in any clock position. Thus a normal degree of turn can be used for most of the bore but if needed, a more aggressive or sharp turn can be used for example to cut out a hole that has already been drilled or to drill into a strata of earth that lies close to parallel to the plane of the drill head.

In the embodiment of FIGS. 62–64 like reference numerals identify the same components as identified in FIGS. 1–34 and 48–61. Referring to FIGS. 62–64, the cam ring 141 is not fixed to the inside of the guide housing 113. The cam ring 141 can rotate within the housing 113 but is prevented from moving longitudinally of the housing 113 by members 754. The cam ring 141 may be locked to the guide housing 113 and unlocked from the guide housing 113 for rotation. A plurality of spring loaded balls 781 are used to engage dents 783 that are formed on the cam ring 141 to form a cam ring clutch 785. A stop 791 connected to the cam ring 141 and extending inward can be used to achieve straight drilling. A rotation ring stop 793 is connected to the cam ring 141, 180 degrees from the stop 791 and extends inward. The ring stop 793 has a pointed portion and the face of the follower member 743 has a groove for accepting the stop 793 as shown in FIG. 64. To rotate the ring 141, the cam follower member 743 is rotated 180 degrees from the stop 791 to a position opposite the stop 793. The member 743 is pushed forward until it is stopped by the stop 793 in the cam ring 141. In this position, the cam follower member 743 is in rotational contact with the cam ring 141 via the point on the stop 793 and the groove on the cam follower member 743 and the sprocket 125A is still in the cam follower housing ball clutch 61A. When the shaft 101 is rotated, the sprocket 125A being engaged in the cam follower housing ball clutch 61A rotates the cam follower housing 151 which in turn rotates the cam follower 731 which rotates the cam ring 141. The spring resistance of the cam ring ball clutch 785 is less than the resistance of the springs of the cam follower ball clutch 61A, thus allowing the cam ring 141 to be rotated.

Referring to FIG. 63, in order to drill straight, the operator must position the cam follower member 743 in the same rotational position as the stop 791. When this is done, and the cam follower member 743 is pushed forward, it will contact the stop 791 which stops the progress of the cam follower member 743 relative to the cam ring 141. In this position, the guide housing 113 is not deflected off center relative to the axis of the shaft 101 and the sprocket 125A is disengaged from the ball clutch 61A allowing the shaft 101 to rotate freely. The guide housing 113 is prevented from rotating by the roll stabilizers 181 and 183 located in the side holes 175 and 177 cut by the side cutters 171 and 173 or the spring wings 551 may be employed to prevent the guide housing 113 from rotating.

Figures 65, 66, 67, 68, 68A, 69, 70:
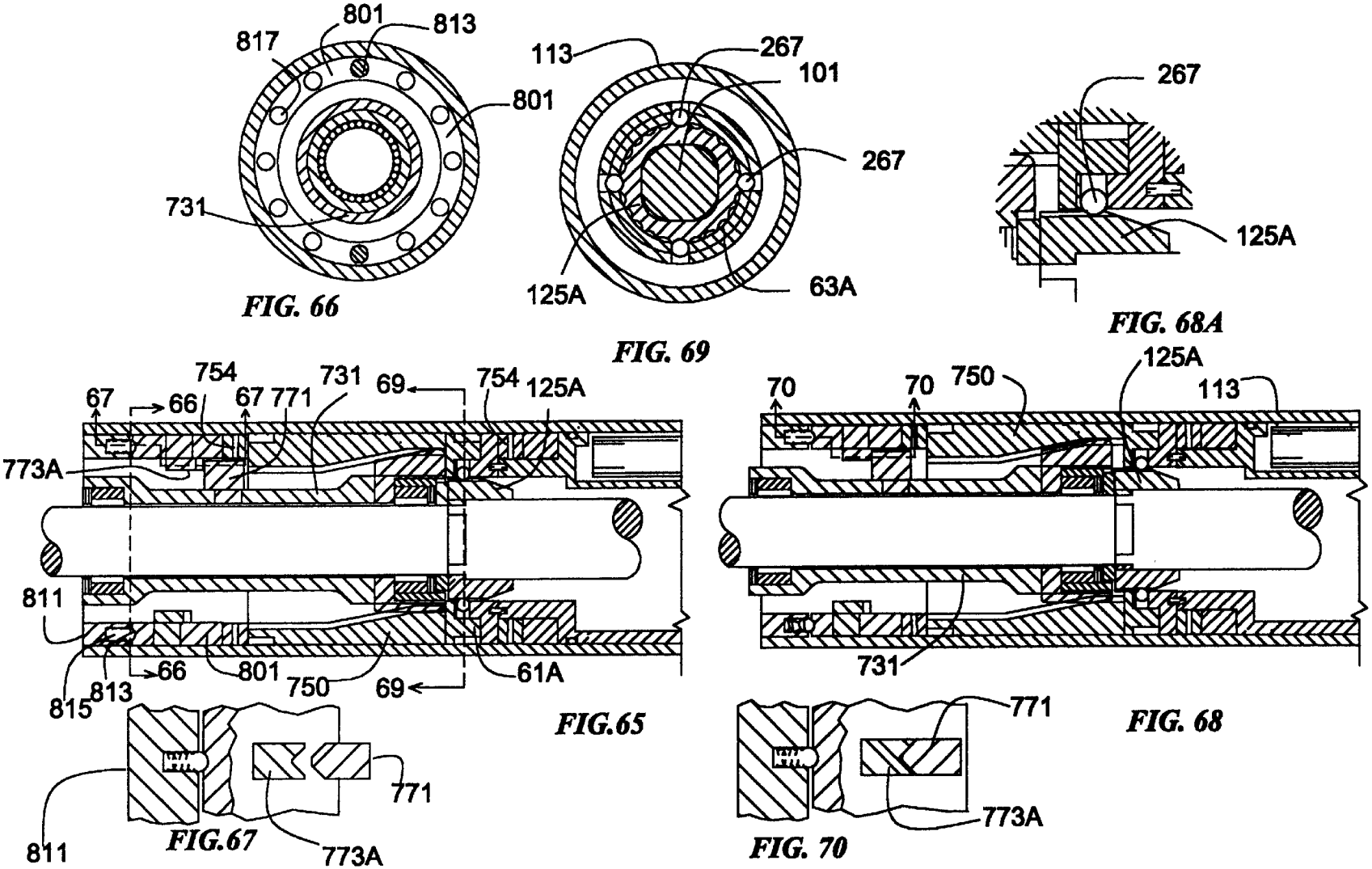
FIGS. 65–70 are cross-sectional views of another embodiment of the invention.
FIG. 68A is an enlarged portion of the clutch of FIG. 68.

In the embodiment of FIGS. 48–61, the stop 773 fixed to the guide housing 113, results in one of the turning directions being lost. In order to avoid this problem, the stop 773 is connected to a ring 801 that can be rotated when the operator wants to reposition the stop 773 to a different rotational position as will be described in connection with FIGS. 65–70. In FIGS. 65–70 like reference numerals identify the same components as identified in FIGS. 48–64. Referring to FIGS. 65–70 a ball clutch 811 is located in front of the ring 801. Balls 813 biased by springs 815 of the clutch 811 are positioned such that they engage the ring 801. The front of the ring 801 has a plurality of dents 817 made to accept the balls 813 of the clutch 811. On the ring 801 is located a stop 773A (similar to stop 773) that is positioned to stop the advancement of the cam follower 731 so that the sprocket 125A is still locked in the ball clutch 61A when the cam follower stop 771 comes into contact with the stop 773A as shown in FIGS. 68 and 70. To rotate the ring 801, the operator pulls back on the shaft 101 to the shifting mode. He rotates the shaft 101 which rotates the sprocket 125A and hence the clutch 61A which rotates the cam means 750 which in turn rotates the cam follower 731 so that the stop 771 on the cam follower 731 is rotationally aligned with the stop 773A as shown in FIG. 70. The operator then pushes forward on the shaft 101 which pushes on the sprocket 125A which pushes forward on the cam follower 731 which in turn pushes forward on the cam follower stop 771 until it comes into contact with the ring stop 773A as shown in FIG. 70. At this point, the cam follower stop 771 and the ring stop 773A become rotational tied together. The contact between the cam follower stop 771 and the ring stop 773A also stops the longitudinal displacement between the cam follower 731, sprocket 125A, shaft 101 and the cam means 750, guide housing 113, ball clutch 61A, and stop ring 801. The operator now rotates the drill stem which rotates the shaft 101 which rotates the sprocket 125A, which rotates the clutch 61A, which rotates the cam means 750. The cam means rotates the cam follower 731, which rotates the stop 771, which rotates the ring stop 773A. The stop 773A rotates the stop ring 801 to a different rotational position. When the desired rotational position is reached, the operator stops the rotation and pulls back on the drill stem which pulls back on the sprocket 125A and cam follower 731. This disengages the cam follower stop 771 from the ring stop 773A. With the sprocket 125A still in the cam means ball clutch 61A, the operator can rotate the drill stem to any rotational position he wants and then push forward on the shaft 101 which pushes forward on the sprocket 125A and cam follower 731. The cam follower 731 will either deflect the guide housing 113 relative to the shaft 101 or make its axis coincide with the axis of the shaft 101 for turning purposes or straight drilling (when stop 771 engages stop 773A) depending on the rotational relationship between the cam follower member 743 and the stops 773A and 771.

Figure 71:
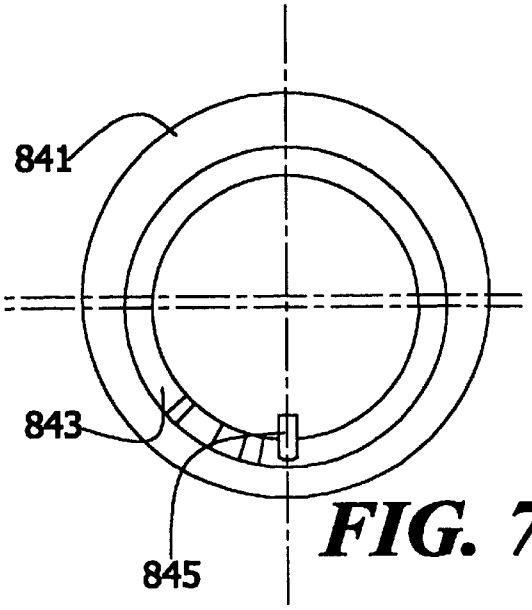
FIG. 71 is an end view of an off center cone cam.
Figure 72A:
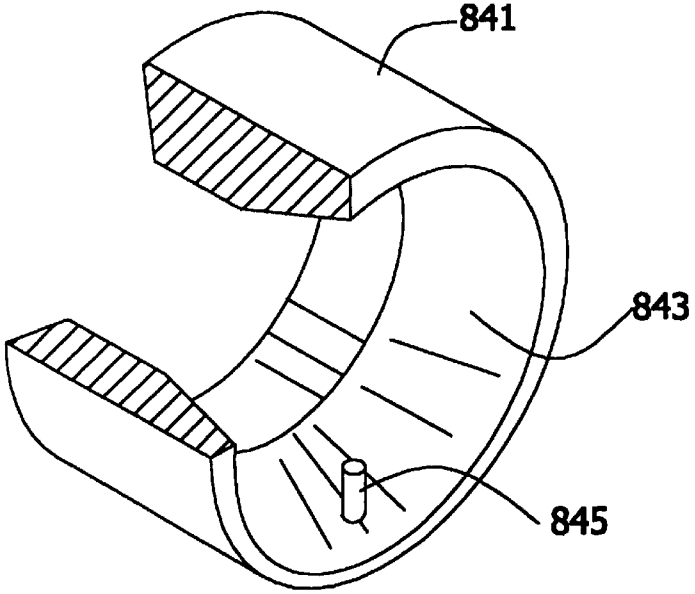
FIG. 72A is a partial isometric view of the cam of FIGS. 71 and 72.
Figure 72:
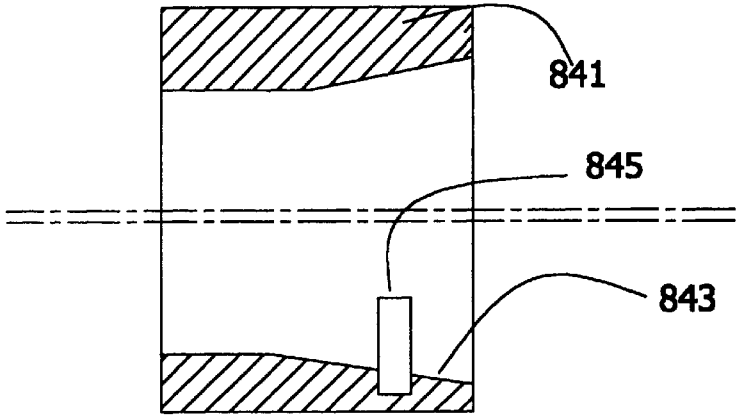
FIG. 72 is a cross-section of FIG. 71 taken along the lines 72—72 thereof.
Figure 74:
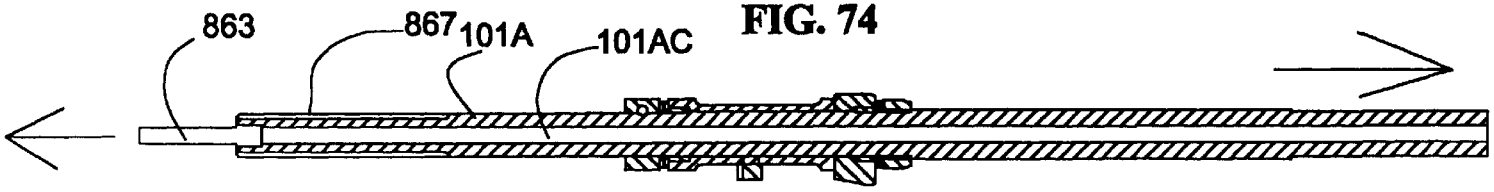
FIGS. 73–79 are cross-sectional views of the apparatus of the invention employing a telescoping shaft.
Figure 73:
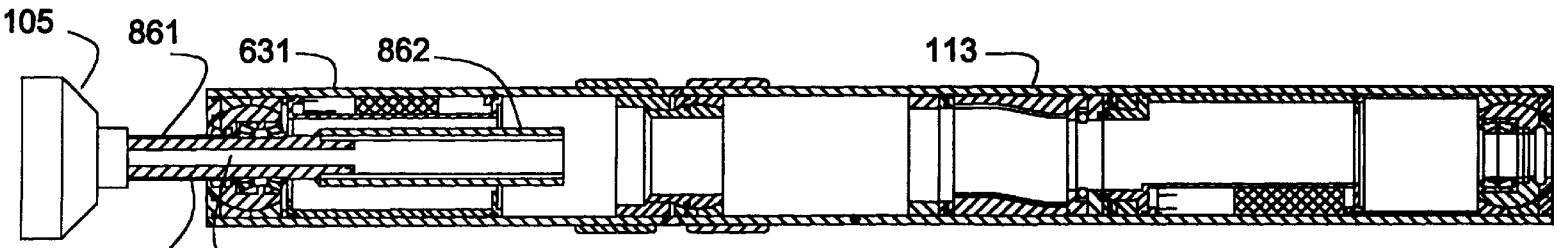
Figure 75:
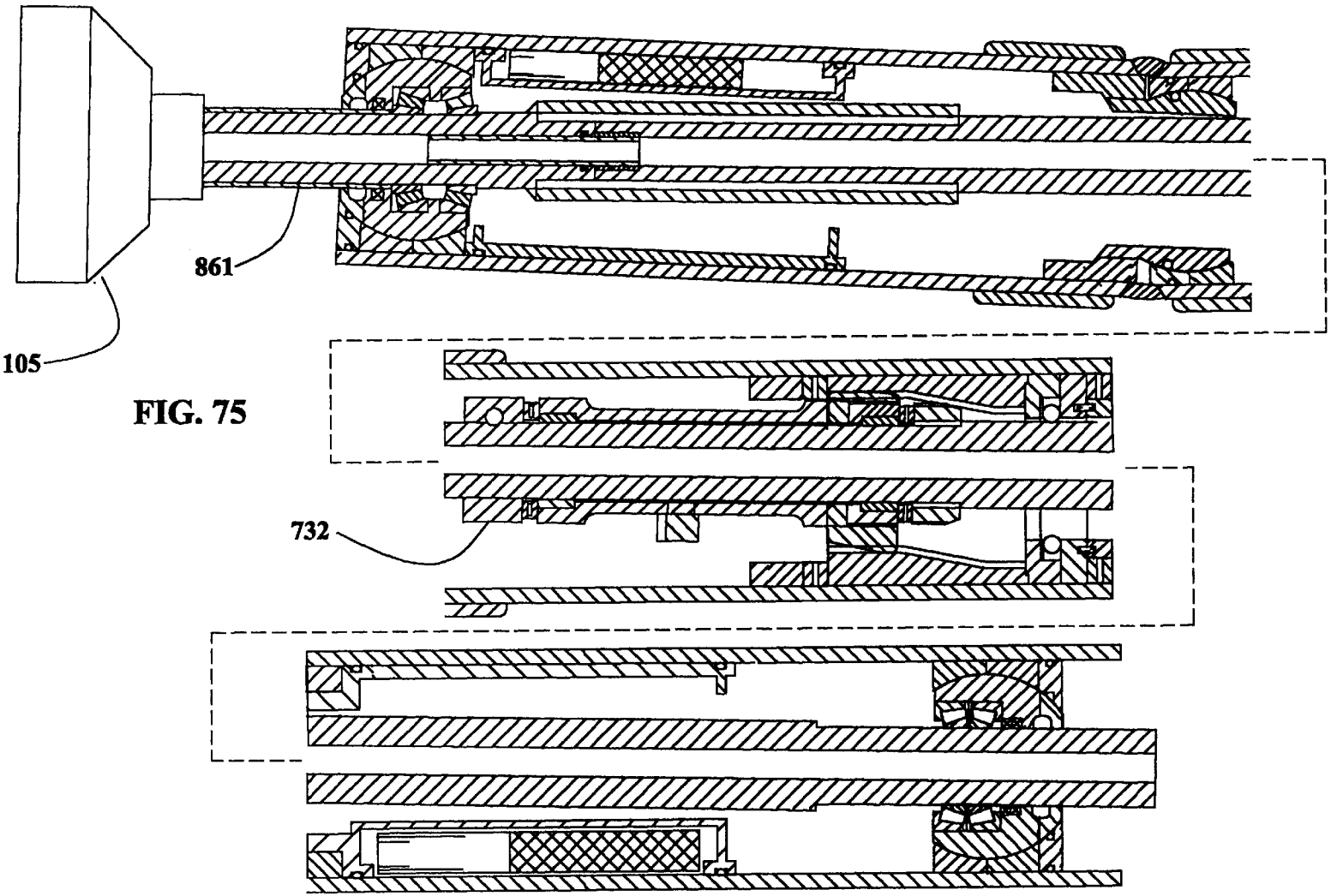
Figures 76, 77, 78, 79:
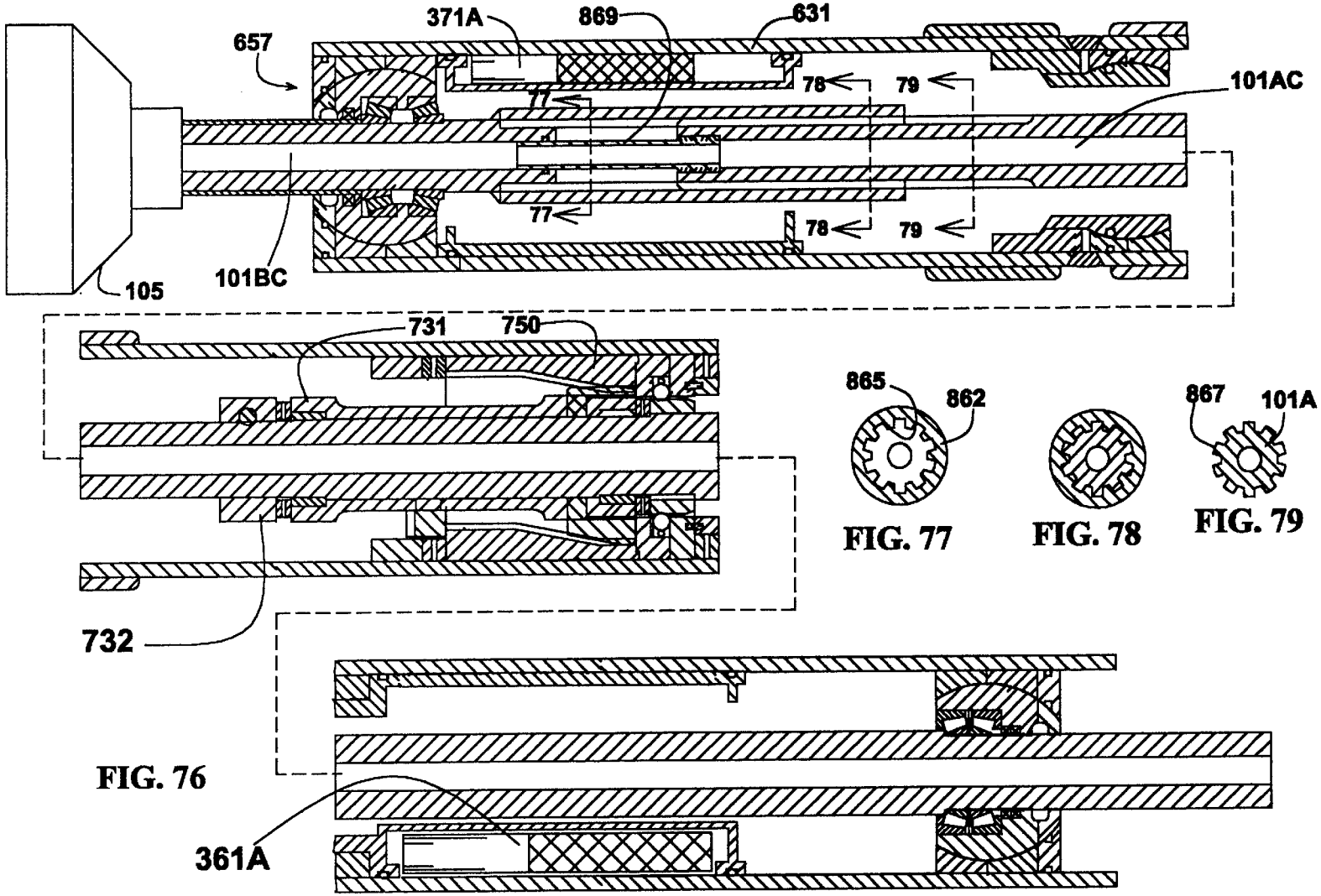

Referring to FIGS. 71 and 72, there is disclosed a cam ring 841 that can replace the cam ring 141 of the embodiment of FIGS. 1–34. The cam ring 841 has a center cone 843 that is off center from the outer perimeter. This ring provides different turning radii in different clock positions and can be used in the embodiments of FIGS. 1–34 and 40–45. The cone 841 has a stop 845 which performs the same function as the stops 65 of the embodiment of FIGS. 40–45 to obtain straight drilling operations or one radius may be close to zero for drilling straight.

When the drill head of the type of the invention is used in a vertical well, the friction of the walls may not be enough to hold the housing while the shaft pushes the cam follower into it. To avoid this problem we can use the push or force from the front of the hole to push on the guide housing. A telescoping main shaft is used, thus not having to rely on the friction of the sides of the hole. Another advantage is that the front cutter 105 can be placed closer to the front of the forward housing because the forward housing is not moving longitudinally in relation to the cutter 105. The guide housing 113 is prevented from rotating by the roll stabilizers 181 and 183 located in the side holes 175 and 177 cut by the side cutters 171 and 173. The spring wings 551 also may be employed to prevent the guide housing 113 from rotating.

Referring to FIGS. 73–79 there will be described a telescoping shaft 101A, 101B which is shown located in the embodiment of FIGS. 48–61 although it is to be understood that it may be used in all embodiments of the invention. In FIGS. 73–79, like reference numerals identify the same components as identified in FIGS. 48–61. A shaft 101B extends into the front of the forward housing 631. A spacer 861 is slid around the shaft 101B and retained by a nut (not shown) or by the drill bit 105 itself. The shaft 101B ends a short distance inside the forward housing 631. A coupling sleeve 862 is welded to the shaft 101B. The shaft 101B and sleeve 862 is free to rotate relative to the drill head. Shaft 101A has outer splines 867 which mate with inner splines 865. The male splined section of the shaft 101A is inserted into the sleeve 862 such that the shafts 101A and 101B can telescope relative to each other. The splines 865 and 867 prevent the two shafts 101A and 101B from rotating relative to each other. Both shaft 101A and 101B have central apertures 101AC and 101BC formed therein. A water tube 869 is connected in aperture 101AC and slidably extends into aperture 101BC of shaft 101B such that the tube 869 can slide in the aperture 101BC of shaft 101B. An O-ring is located on the outside of the tube 869 in aperture 101BC to prevent water from getting into the drill head. The shaft 101A continues rearward to act as the support of cam follower 731 and the sprocket 125A and passes out of the rear of the drill head where it connects to the drill string.

When the drill string is pushed forward, the shaft 101A pushes forward. This pushes everything connected to shaft 101A forward. When the drill bit 105 engages to the front wall of the bore, it is impeded from moving forward. This keeps the shaft 101 B and the guide housing 113 from moving forward, allowing the cam follower 731 to interact with the cam means 750 to influence the direction of swivel of the guide housing 113. The splined section 865 of shaft 101B slides on the splined section 867 of shaft 101A. The splines on each shaft interact with each other and keeps the two shafts 101 B and 101 A tied to each other. By pulling back on the stem and hence the shaft 101A, the shaft 101A can be moved rearward relative to shaft 101B.

Figures 80, 81, 82, 83, 83A, 83B, 84:
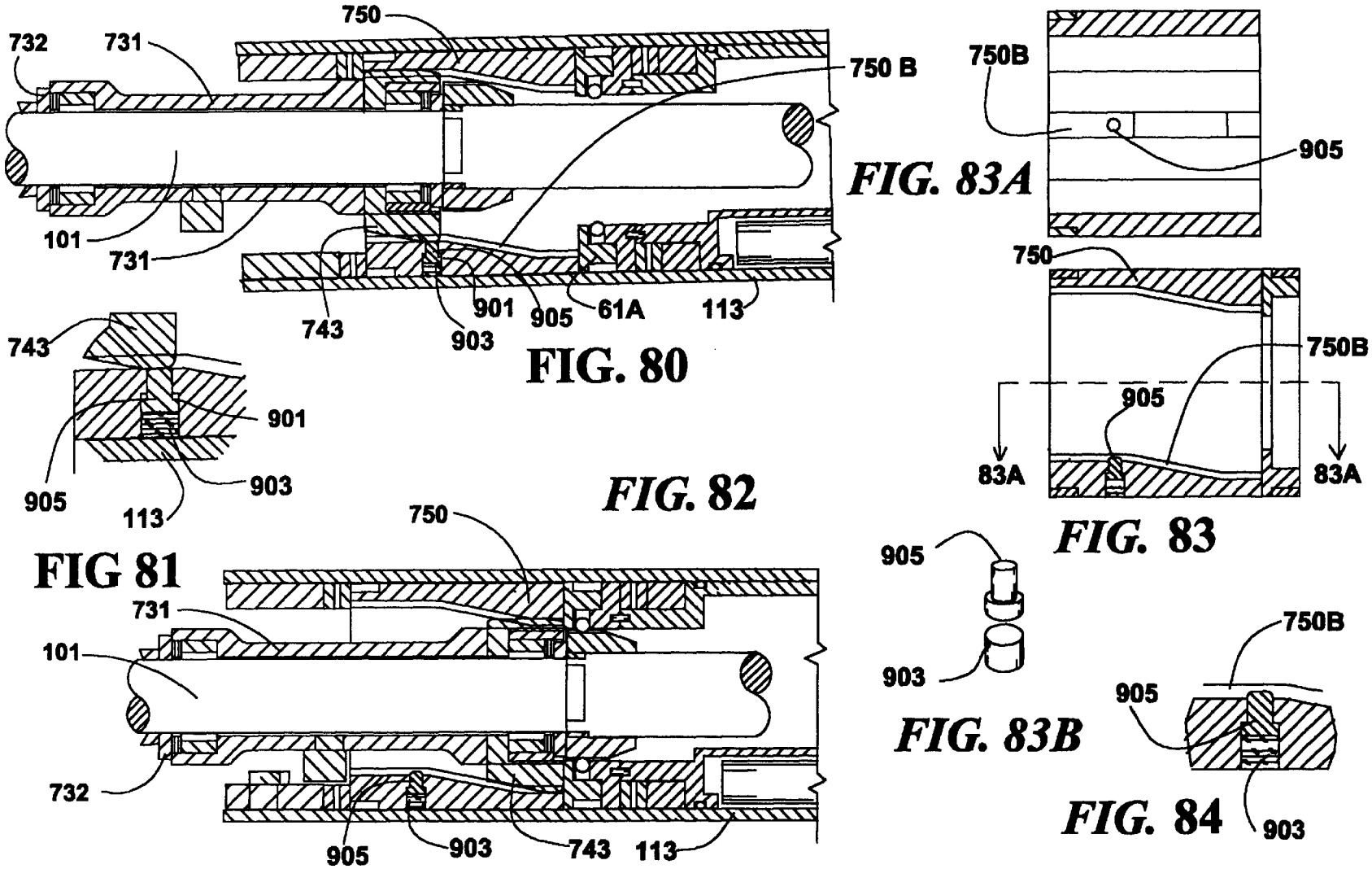
FIGS. 80–84 are a cross-sectional views of another embodiment of the apparatus of the invention employing a rotational brake.
FIG. 83A is a cross-section of FIG. 83 taken along the lines 83A—83A thereof.
FIG. 83B is an isometric drawing of the piston and high friction material of FIGS. 80–83.
Figure 85:
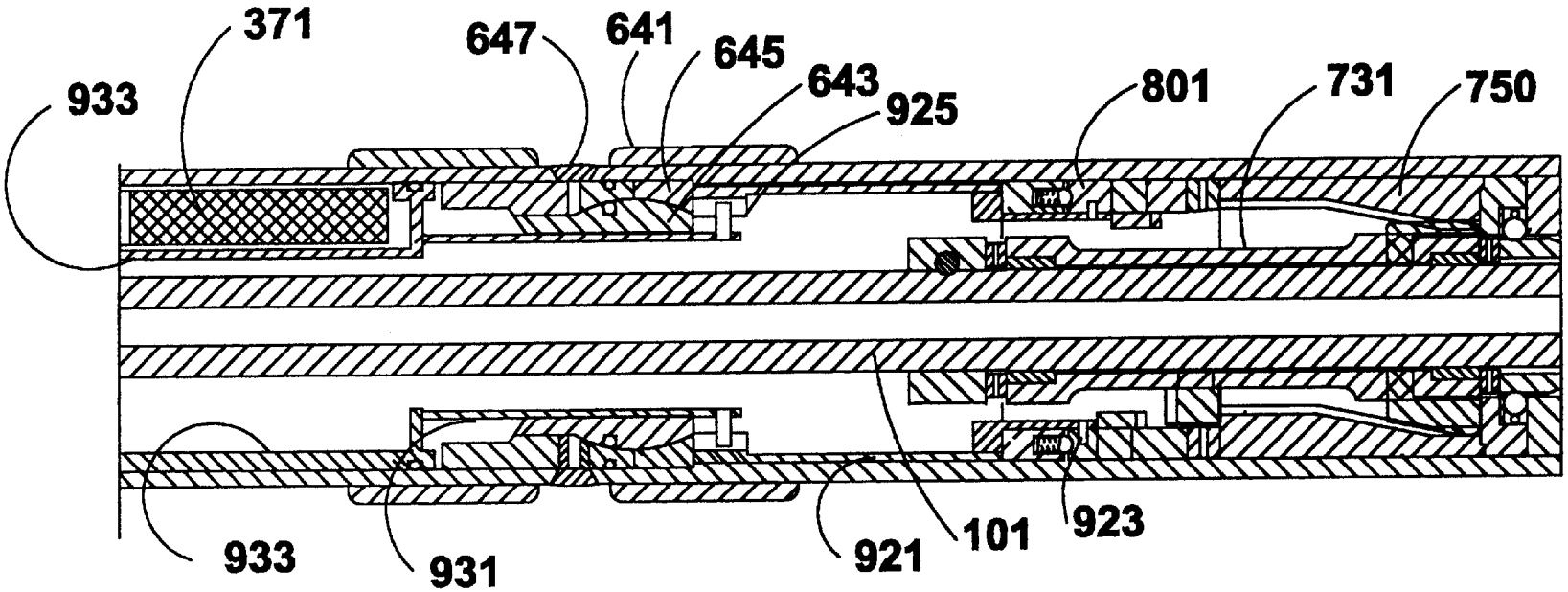
FIG. 85 is a cross-sectional of another embodiment of the apparatus of the invention illustrating a system for rotating the inner housing of one of the sondes such that the sonde rotates with the inner housing.
Figures 86, 87, 88, 89, 90, 91:
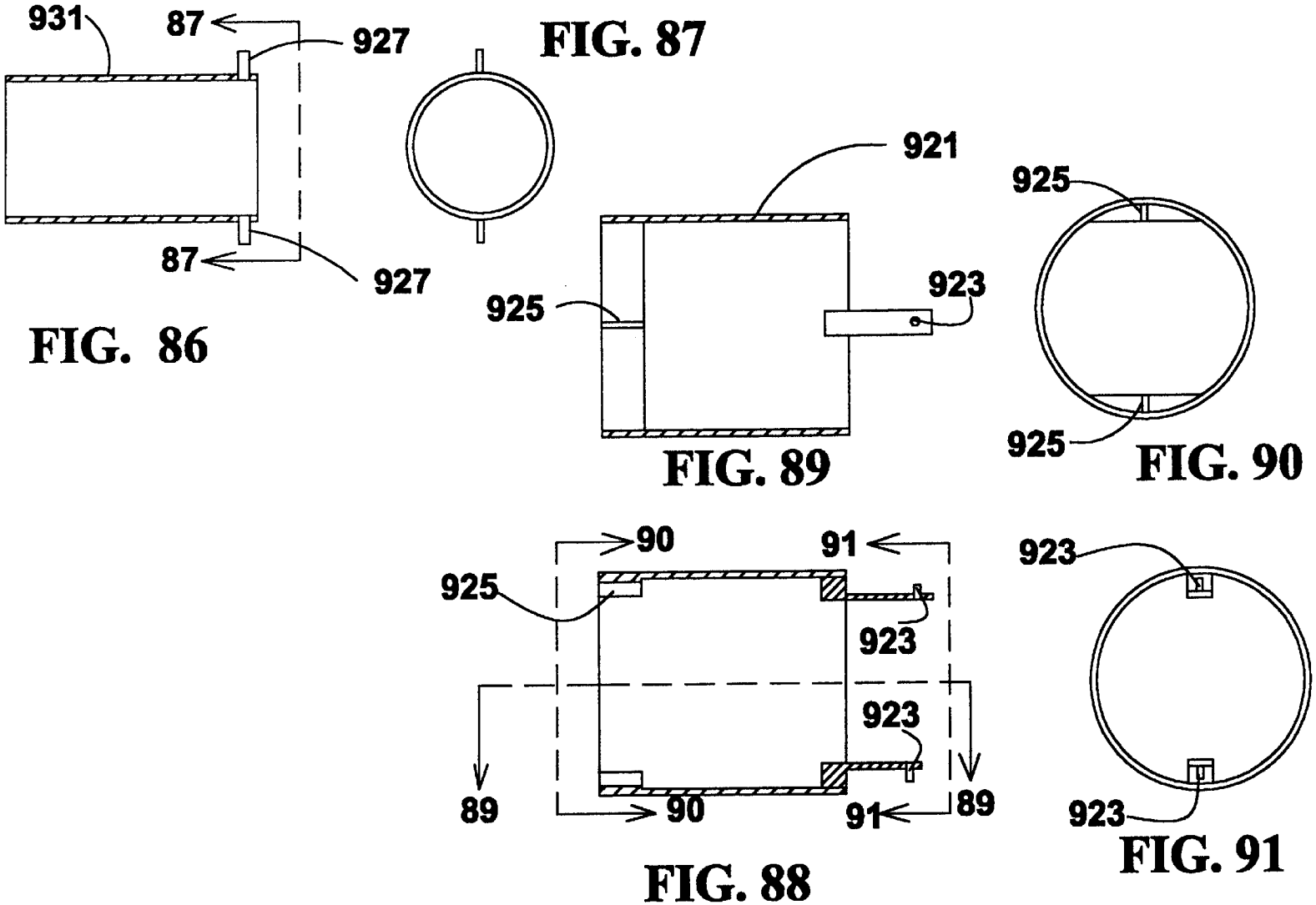
FIG. 86 illustrates a tube used in the system of FIG. 85.
FIG. 87 is a view of FIG. 85 as seen along the lines 87—87 thereof
FIG. 88 illustrates another tube used in the system of FIG. 85.
FIG. 89 is a cross-section of FIG. 88 as seen along the lines 89—89 thereof.
FIG. 90 is a view of FIG. 89 as seen along lines 90—90 thereof.
FIG.91 is a view of FIG. 89 as seen along lines 91—91 thereof.
Figure 92:
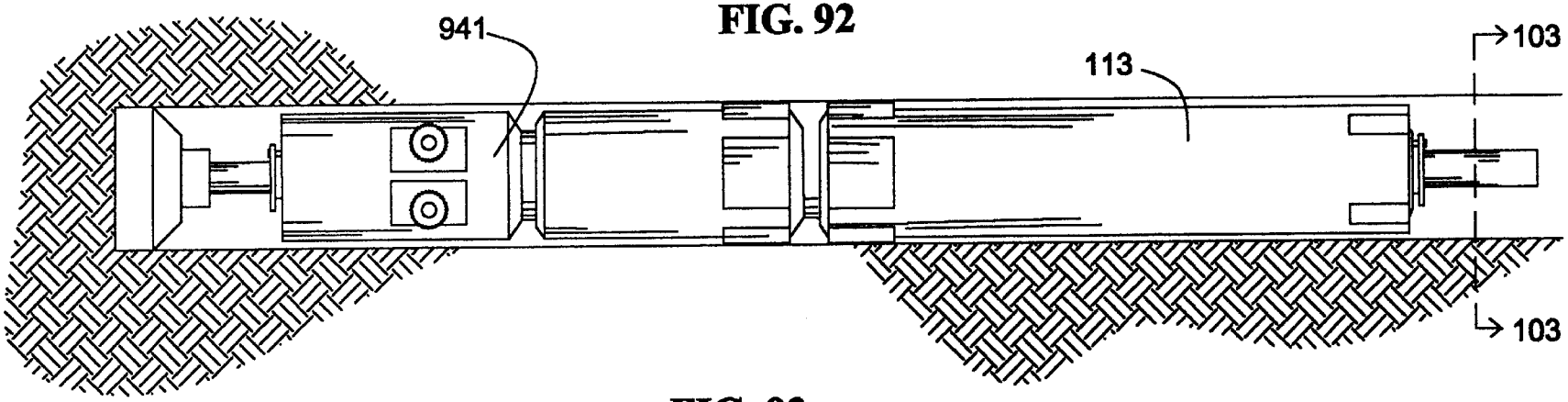
FIGS. 92–103 illustrates another embodiment of the apparatus of invention which employs pulling side cutters.
Figure 93:
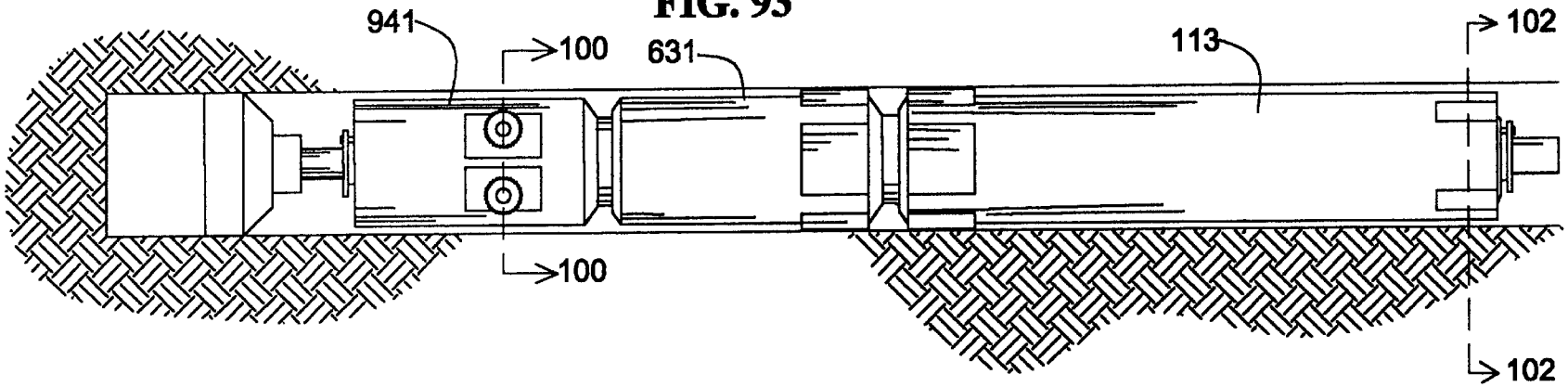
Figure 94:
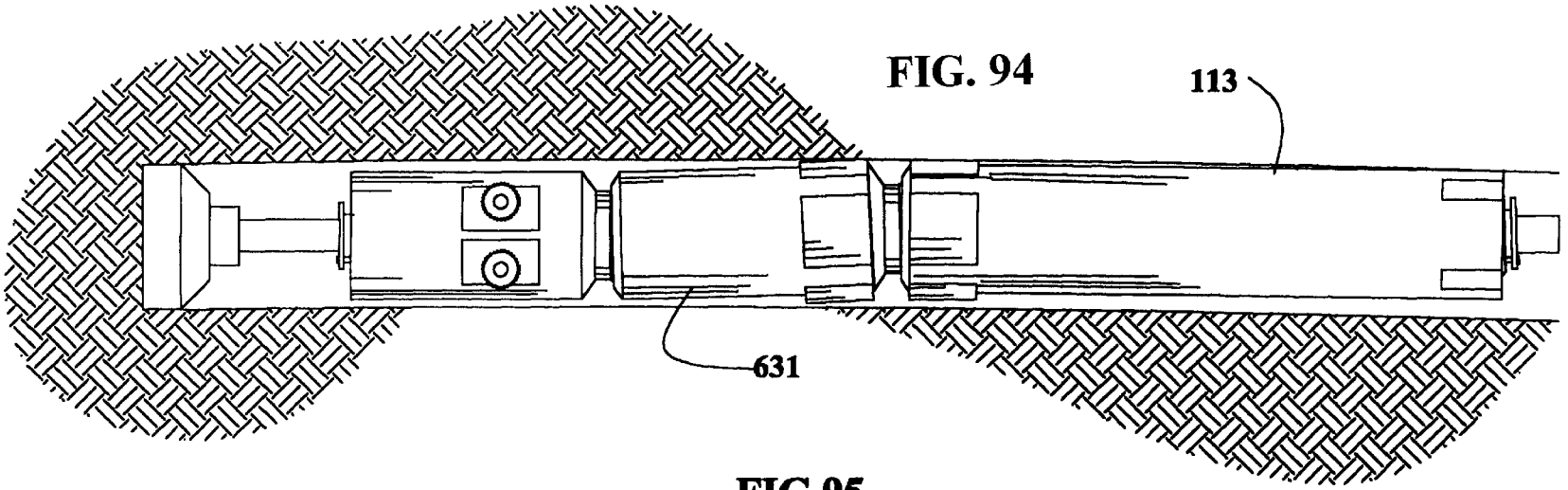
Figure 95:
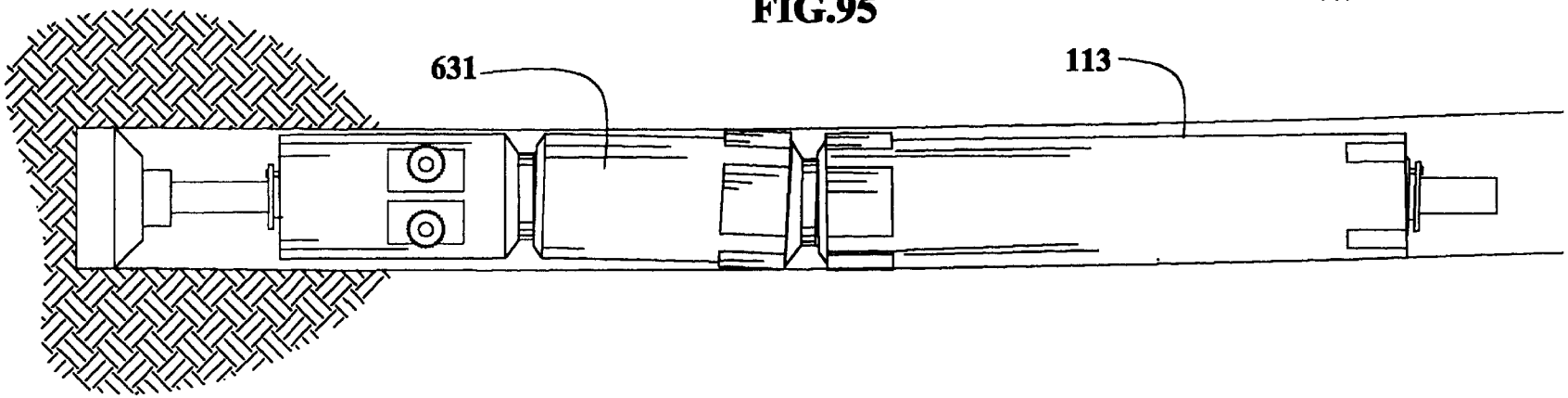
Figure 96:
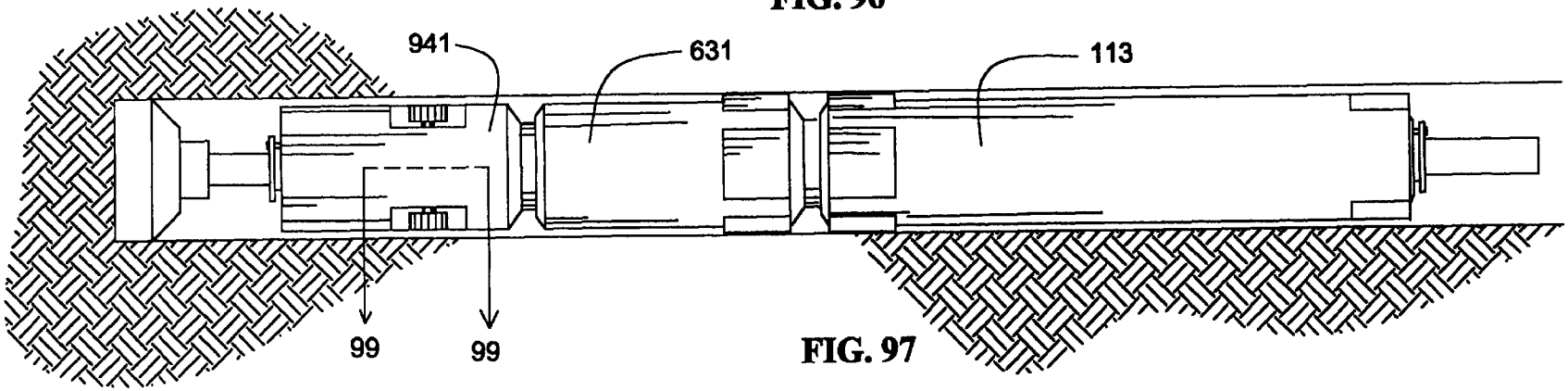
Figure 97:
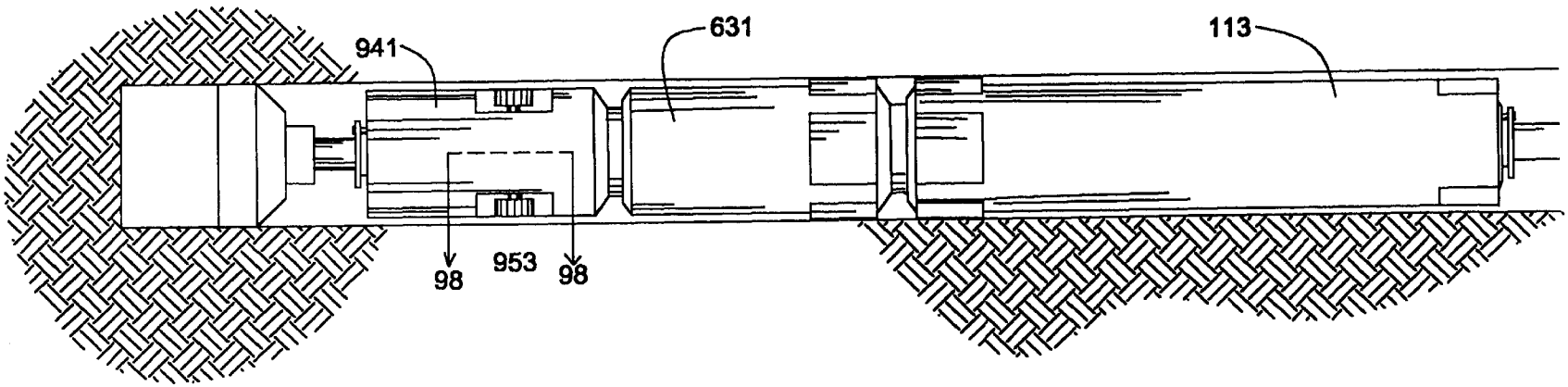
Figure 103:
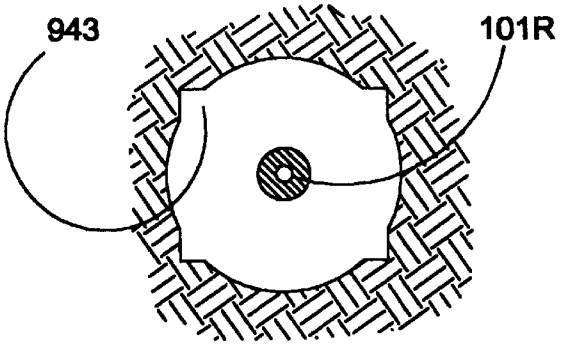
Figure 102:
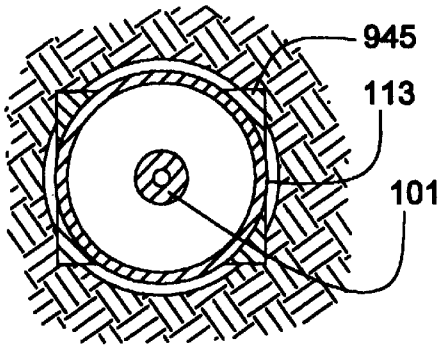
Figure 101:
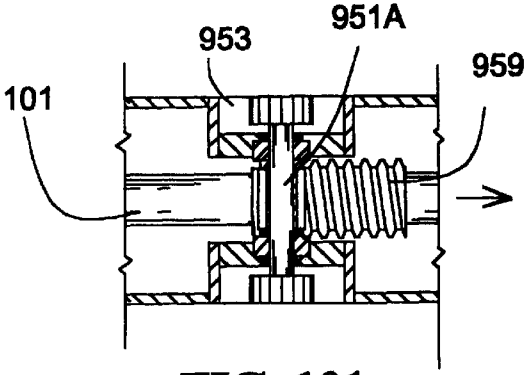
Figure 100:
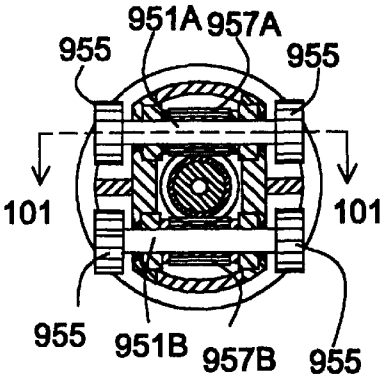
Figure 98:
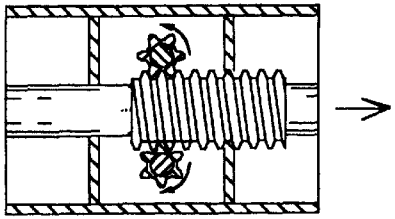
Figure 99:
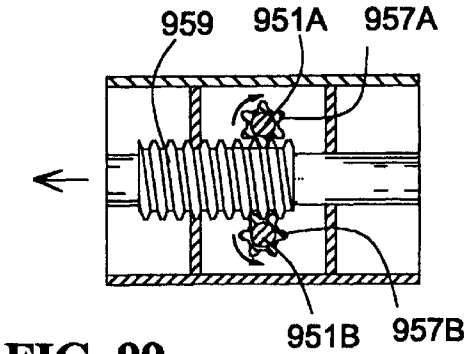
Figures 104, 105, 106, 107, 108:
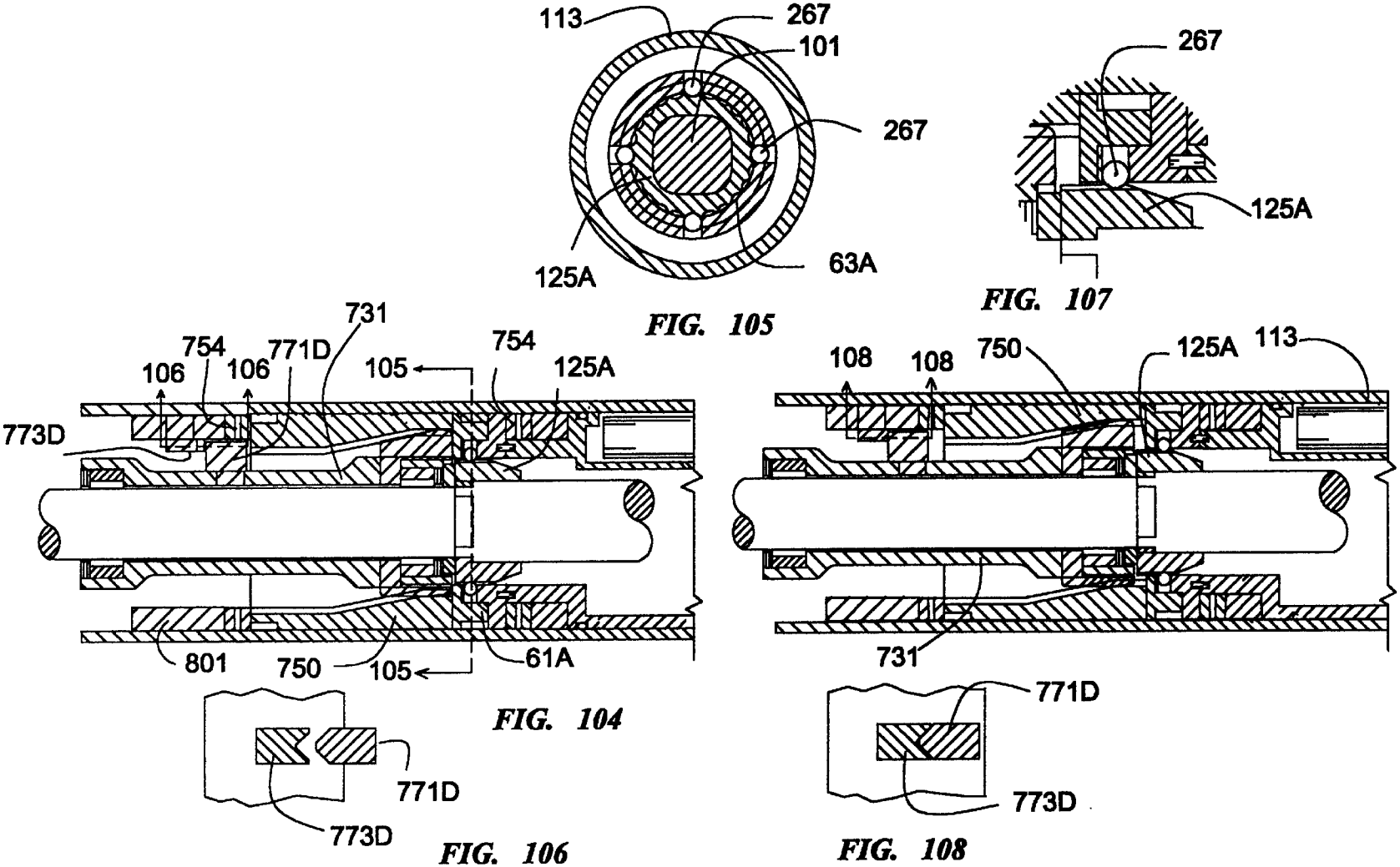
FIGS. 104–112 illustrates two embodiments of the apparatus of the invention wherein the shaft may be used to rotate the guide housing in the hole while drilling straight.
Figure 111:
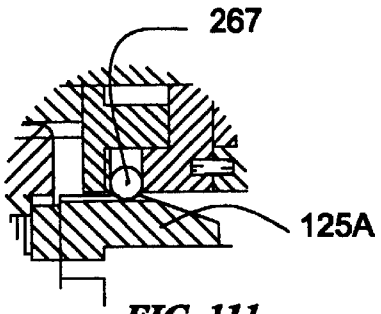
Figure 109A:
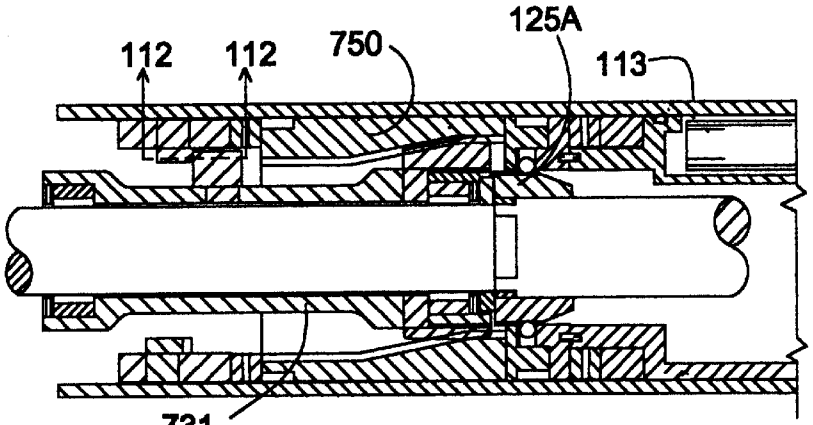
FIG. 109A is a partial cross-section of the apparatus of the other embodiment for rotating the guide housing with the shaft in a forward drilling position.
Figure 112:
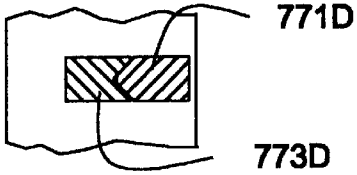
Figure 109:
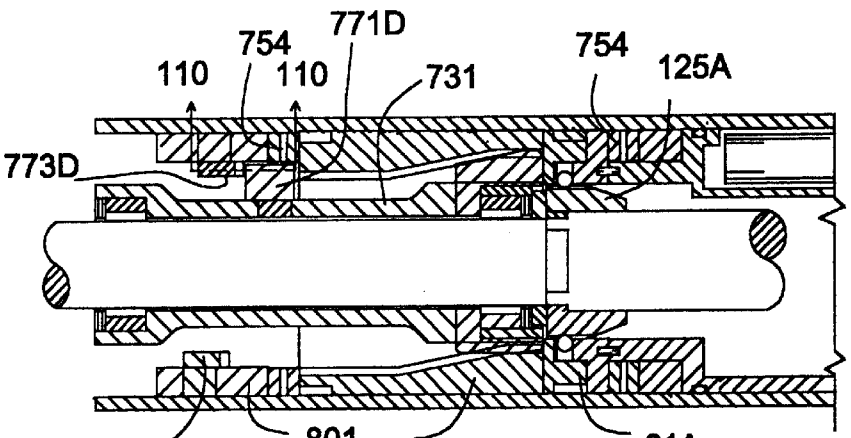
Figure 110:
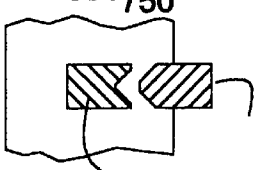

Referring to FIG. 80–84, there is disclosed the use of friction material that is employed to keep the cam means 750 from rotating when the drill head is drilling forward. An aperture 901 is formed radially through the cam means 750. A high friction material 903 is located in the aperture 901 next to the inner side of the housing 113. A piston 905 is located in the aperture 901 next to the slot 750B. When the cam follower 731 is located in a forward drilling position relative to the cam means 750, as shown in FIGS. 80 and 81, the cam member 743 engages the piston 905 and applies an outward radial force to the piston 905 which pushes the friction material 903 outward to engage the inner side of the housing 113. This force helps to keep the cam means 750 from rotating. When the cam follower 731 and member 743 are in a rearward position relative to the cam means 750, as shown in FIGS. 82–84, the piston 905 is relieved of pressure from the cam member 743 decreasing the pressure on the high friction material 903 allowing the cam mean 750 to be rotated by the shaft 101 and ball clutch 61A. In one embodiment, the high friction material 903 may be urethane. Although the rotational brake of FIGS. 80–84 is shown in the embodiment of FIGS. 48–61, it is to be understood that it can be employed in all embodiments of the apparatus of the invention.

When using the rotating stop ring embodiment of FIGS. 65–70 it is desirable to also rotate the housing of the rotation sonde 371 and hence to rotate the sonde 371. Referring to FIGS. 85–91, in order to do this, a tube 921 is placed in front of the stop ring 801. The tube 921 is tied rotational to the stop ring 801 by two pins 923. On the front of the tube 921 are two slots 925 made to accept two pins 927 that are connected to a second tube 931. The front of tube 931 is connected to the sonde housing 933 and rides in the ball 645 of the ball joint that connects the two housings. The pins 927 are positioned in the slots 925 to allow for the swivel of the housings in relation to each other but to keep the sonde housing 933 and the stop ring 801 tied to each other rotationally.

This U-joint can also be used on the rotating cam ring embodiment of FIGS. 62–64. When using the rotating cam ring embodiment it is desirable to also rotate the housing rotation sonde 371. To do this tube 921 is placed in front of the cam ring 141. The tube 921 is tied rotationally to the cam ring 141 by the two pins 923. On the front of the tube 921 are the two slots 925 made to accept the two pins 927 that are connected to the second tube 931. The front of the tube 931 is connected to the sonde housing 933 and rides in the ball 645 of the ball joint that connects the two housings. The pins 927 are positioned in the slots 925 to allow for the swivel of the housing in relation to each other but to keep the sonde housing 933 and the cam ring 141 tied to each other rotationally.

FIGS. 92–97 show the DCH with a pulling head 941 mounted in line and in front of the forward housing 631 and the guide housing 113. The rear of the pulling head is attached to the ball joint 657 and the front of the pulling head 941 is mounted on bearings supported by the shaft 101 that allow the shaft 101 to slide longitudinally relative to the pull head 941. The function of the pull head 941 is to first, cut side apertures or slots 943 in the earth for the guides 945 coupled to the rear of the drill head that follow to pass through the side apertures keep the apparatus from rotating and secondly to help pull the DCH into the hole by converting some of the rotational torque into thrust.

Referring to FIGS. 98–103 two shafts 951B and 951A are located on opposite sides of the shaft 101 with their axes perpendicular to shaft 101. The ends of the two shafts 951B and 951A pass out of the pullhead housing 941 into four recesses 953 that are formed through the wall structure of the pull head housing 941. On the ends of the shaft 951B and 951A are cutters 955. Coupled to the shafts 951A and 951B are gears 957A and 957B. On the shaft 101 in contact with the gears 957A and 957B is a worm gear 959. The worm gear is longer than would be normally needed to turn the gears 957A and 957B. The worm gear 959 works with the two side gears 957A and 957B to rotate the side cutters 955 when the center shaft 101 is rotated. The cutters 955 are placed at a distance both horizontally and vertically from the center of the shaft 101 so as to allow only the portions of the upper cutters that is furtherest from the center of shaft 101 to contact the bore wall. The worm gears teeth are cut so that when the shaft 101 is rotated clockwise as viewed from the rear of the DCH. The shaft 951 A is rotated clockwise when viewed from the left side of the DCH. Thus the upper portions of the upper cutters are moved toward the rear of the housing. Also when the shaft 101 is rotated clockwise, the lower side shaft 951B is rotated counter-clockwise when viewed from the left side of the DCH. Thus the lower portions of the lower cutters are moving toward the rear of the housing. By doing this, the portion of the side cutters 955 cutting the apertures is pushing away from the center of the shaft and backwards relative to the forward progress of the DCH. An upper shaft 951A and lower shaft 951B are used so that the outward thrust coming from the cutters will off set each other and a net forward thrust will be obtained.

The length of the worm gear 959 is used when the shaft 101 is shifted longitudinally relative to the housings. This allows the side cutters 955 to be rotated no matter what the longitudinal position of the shaft 101 relative to the housing is thus allowing the DCH to cut its way into the bore. By having the gears 957A, 957B and worm gear 959 cut a special way, they can act as worm gears when the shaft 101 is rotated or as rack and pinon gears when the shaft 101 is shifted longitudinally.

By having the side cutters 955 mounted on the housing 941 as shown and described, they provide a rearward thrust on the housing in relation to the shaft 101 thus allowing the cams and cam follower to fully engage. The rearward thrust comes from the cutters as they begin biting into the wall of the bore to begin cutting the side apertures so that the gears do not become disengaged from each other and drilling can commence at any longitudinal position. The embodiment of FIGS. 92–97 may be used in all embodiments of the apparatus of FIGS. 1–103.

Referring now to FIGS. 104–108 there will be disclosed an embodiment for rotating the guide housing while drilling straight. In this embodiment, the side cutters 171, 173 and guides 181, 183 and the side cutters 955 and guides 945 are not employed and the guide housing 113 is held rotationally stable by the friction between it and the bore wall. The cam means 750 is a single annular member having two slots spaced 180 degrees apart for receiving the two cam members of the cam follower 731. A stop 771D is coupled to the cam follower for engaging a forward guide housing stop 773D which is connected to the guide housing 113. This guide housing stop 773D is placed in a longitudinal position so that when it is contacted by the cam follower stop 771D, it stops the longitudinal displacement between the shaft 101 and the guide housing 113 which stops the longitudinal displacement between the cam follower 731 and the cam means 750. In this longitudinal position, the guide housing 113 is close to parallel to the shaft 101 and the sprocket 125A that is mounted on the shaft 101 is still engaged with the clutch balls 267 that are attached to the cam means 750. When the shaft 101 is rotated, it rotates the clutch balls 267, which rotate the cam means 750, which in turn rotates the cam follower 731. The cam follower 731 rotates the cam follower stop 771D, which rotates the guide housing stop 773D, which in turn rotate the guide housing 113, which rotates the sonde 371A. The sonde 371A keeps track of the stop 773D. The cam follower stop 771D is shaped to be accepted by the guide housing stop 773D so that they become tied rotationally together when they are engaged. By stopping the rotation of the shaft 101 and thus the guide housing 113 in a desired rotational position, the guide housing stop 773D can be positioned out of the way of the desired turning direction. Thus there is no loss of direction that the DCH can travel, by the stop 773D being non-rotating. By rotating the guide housing in the straight position, the straight position sonde 371A can be mounted solidly in the housing and there is also no need for the clutch of FIGS. 65–70 between the guide housing and the stop ring. A second sonde 361A is rotationally tied to the cam follower 731 to keep track of its rotational position.

In another embodiment, it is desirable to sometimes rotate the guide housing 113 only when the operator wants to reposition the stop or in this case the stops in a different rotational position as shown in FIGS. 109–112, which is a modification of the embodiment of FIGS. 104–108, to lessen the wear and tear on the sondes and the drill head. To do this, a second stop 961, known as the straight stop, is fixed to the guide housing 113 of the DCH as described above so that when this straight stop 961 is engaged by the cam follower stop 771D, the ball clutch 61A is disengaged from the sprocket 125A allowing the shaft 101 to rotate independent of the guide housing 113. The longitudinal displacement is also stopped at a place where the guide housing 113 is still fairly parallel with the shaft 101 allowing for straight drilling. In this embodiment the second stop 961 is used to drill straight, while the guide housing stop 793D is used to rotate itself and the second stop 961 to a new rotational position allowing a turn to be conducted in the former rotational positions of the guide housing stop 793D and the second stop 961.

Figure 114:
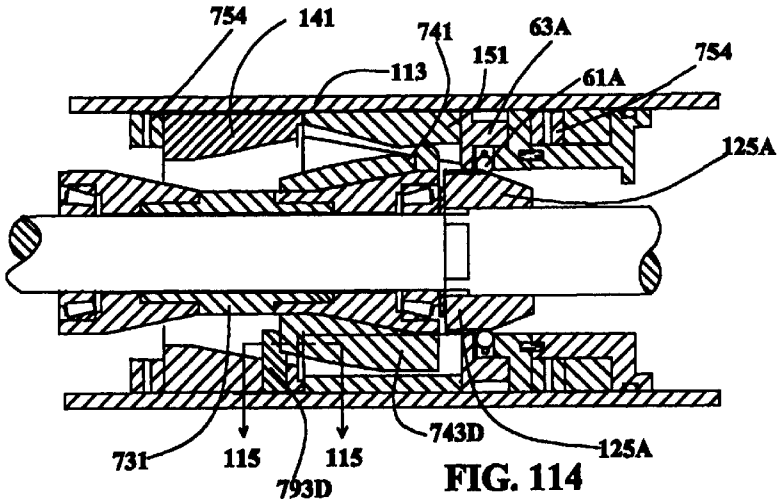
Figure 115:
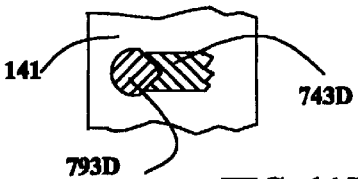
Figure 113:
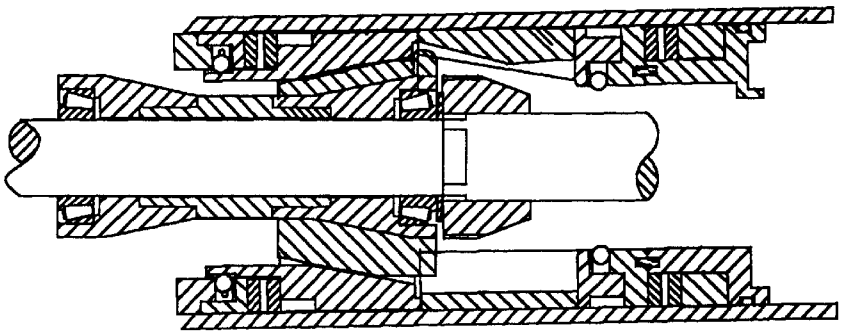
Figure 117:
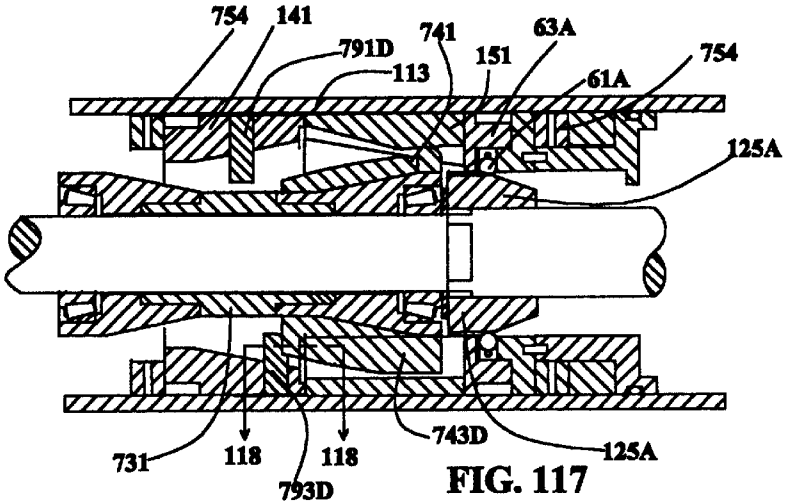
Figure 118:
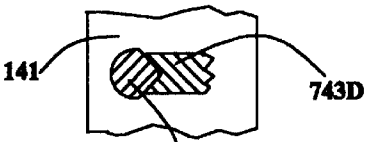
Figure 116:
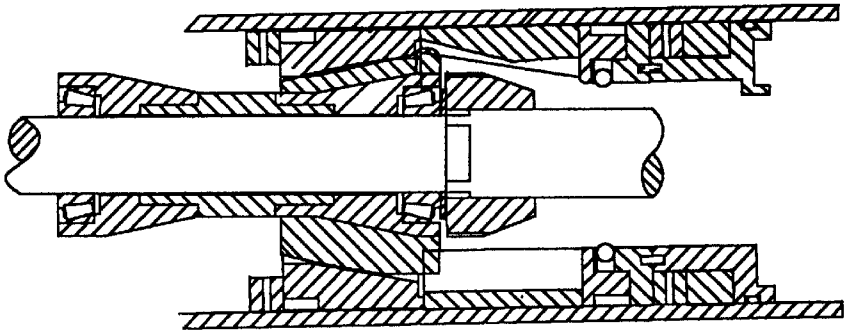
Figure 119:
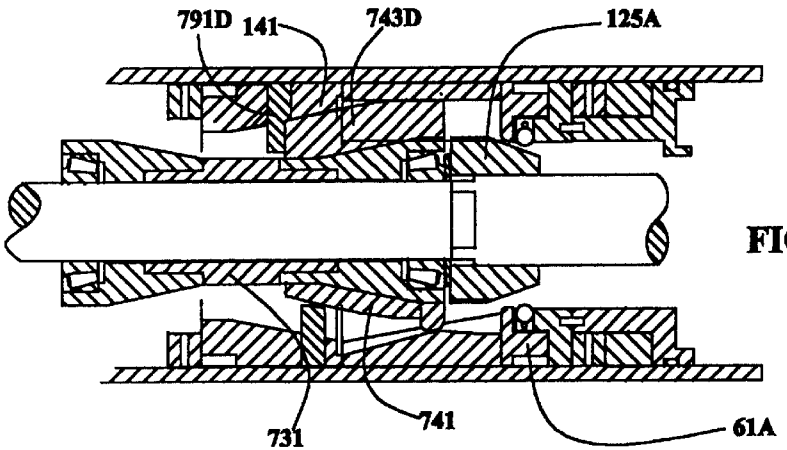

In another embodiment, as shown in FIGS. 113–115, the guide housing 113 is held rotationally stable by the friction between it and the bore wall as described in connection with FIGS. 104–108. The deflecting means is the same as the one used in FIGS. 1–34 wherein the cam ring 141 is fixed to the guide housing 113. A guide housing stop 793D is coupled to the guide housing 113. This guide housing stop 793D is placed in a longitudinal position so that when it is contacted by the cam follower member 743D, it stops the longitudinal displacement between the shaft 101 and the guide housing 113 which stops the longitudinal displacement between the cam follower member 743D and the cam ring 141. In this longitudinal position, the guide housing 113 is close to parallel to the shaft 101 and the sprocket 125A that is mounted on the shaft 101 is still engaged with the clutch balls 61A that are attached to the cam follower member 743D. When the shaft 101 is rotated, it rotates the balls of the clutch 61A, which rotate the cam follower housing 151 which in turn rotates the cam follower member 743D. Member 743D rotates the guide housing stop 793D, which rotates the guide housing 113 which rotates the sonde 371A. The cam follower member 743D is shaped to accept the guide housing stop 793D so that they become tied rotationally together when they are engaged. By stopping the rotation of the shaft 101 and thus the guide housing 113 in a desired rotational position, the guide housing stop 793D can be positioned out of the way of the desired turning direction. Thus there is no loss of direction that the DCH can travel, by the stop 793D being non-rotating and also if the cams of the cam ring 141 are of different slopes, then varying slope of turn can be taken in all directions. By rotating the guide housing in the straight position, the straight position sonde 371A can be mounted solidly in the housing and there is also no need for a clutch between the guide housing 113 and the cam ring 141. The sonde 371A keeps track of the position of the stop 793D. A second sonde 361A is rotationally tied to the cam follower member 743D to keep track of its rotational position.

In another embodiment, it is desirable to sometimes rotate the guide housing 113 only when the operator wants to reposition the stop or in this case the stops to a different rotational position or to achieve a desired turning radius in a desired direction. This lessens the wear and tear on the sondes and the drill head. Referring to FIGS. 116–119, and 117, to do this a second stop 791D, known as the straight stop, is fixed to the guide housing 113 of the DCH as described above so that when this straight stop 791D is engaged by the cam follower member 743D, the ball clutch 63A is disengaged from the sprocket 125A allowing the shaft 101 to rotate independent of the guide housing 113. The longitudinal displacement is also stopped at a place where the guide housing 113 is still fairly parallel with the shaft 101 allowing for straight drilling. In this embodiment the straight stop 791D is used to drill straight while the guide housing stop 793D is used to rotate itself and the straight stop 791D to a new rotational position allowing a turn to be conducted in the former rotational positions of the guide housing stop 793D and the straight stop 791D and also allowing for a varying amounts of turn in any direction.

In the different embodiments of the apparatus of the invention, when the shaft is being moved forward relative to the guide housing and the axis of the housing is being shifted relative to the axis of the shaft, the apparatus is drilling forward. By engaging the cams and the cam or cams follower longitudinally a turn can be made in solid rock. At the beginning of a turn the guide housing and cams are relatively aligned with the shaft and the cam follower is just starting to enter the cam. When the cam follower advances enough into the cam for the guide housing to touch the wall of the bore on one side and the cutter on the opposing side, the lateral forces continue to act on the drill bit and guide housing to cause the drill bit to drill laterally into the wall as well as forward establishing a turning hole. By continuing this procedure the cam follower will eventually reach its fully longitudinal displacement relative to the cam and at the same time the guide housing will reach its full deflection relative to the shaft. Thus the longitudinal displacement of the cam follower, relative to the cam converts part of the longitudinal forces into lateral forces. At all points during the longitudinal displacement, the relation between the lateral displacement and the longitudinal displacement is related to the ratio's of the means. By this self regulating method, turns can be established and the lateral shift can be completed in rock without wedging the drill head in the hole.

We claim:

1. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be moved to a forward drilling position relative to said guide housing and to a rearward shifting position relative to said guide housing, cam means coupled to said guide housing around said shaft, a cam follower means surrounding said shaft and being rotatable relative to said shaft, said cam follower means being movable longitudinally with said shaft relative to said cam means, a clutch for coupling said cam means to said shaft to prevent rotation of said cam means relative to said shaft when said shaft is in said shifting position such that said cam means may be rotated with said shaft to allow said cam means to rotate said cam follower means to a selected angular position, when said shaft moves toward said forward drilling position, said clutch allows said cam means to be uncoupled from said shaft such that in said forward drilling position of said shaft, said cam follower means engages said cam means and causes said axis of said guide housing to shift relative to said axis of said shaft to cause the direction of drilling by said shaft and said cutting means to change, a first stop coupled to said cam follower means, a second stop coupled to said guide housing forward of said first stop such that said shaft may move said cam follower means and hence said first stop to an engaging position sufficient to engage said second stop when said shaft is moved forward, in said engaging position said cam follower means is moved forward sufficient to be uncoupled from said shaft but not far enough to significantly move said axis of said guide housing out of alignment with the axis of said shaft.

2. The apparatus of claim 1, wherein:

said shaft comprises first and second shaft members with one of said shaft members having a central opening at one end and the other of said shaft members having an end located in said central opening such that said first and second shaft members may move toward and away from each other, and means for preventing said first and second shaft members from rotating relative to each other.

3. The apparatus of claim 1, wherein:

said cam means comprises a central axis with surrounding wall structure, an aperture formed through said wall structure transverse to said central axis of said cam means, brake means comprising a piston located in said aperture at a position to be moved outward against said guide housing by said cam follower means to prevent rotation of said cam means when said cam follower means engages said cam means for causing said axis of said guide housing to shift relative to said axis of said shaft.

4. The apparatus of claim 1, wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

5. The apparatus of claim 1, comprising:

a first indicating means for sensing and transmitting to the surface a signal indicative of the rotational position of said cam follower means, and a second indicating means for sensing and transmitting to the surface a signal indicative of the rotational position of said second stop.

6. The apparatus of claim 2, wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

7. The apparatus of claim 2, comprising:

a first indicating means for sensing and transmitting to the surface a signal indicative of the rotational position of said cam follower means, and a second indicating means for sensing and transmitting to the surface a signal indicative of the rotational position of said second stop.

8. The apparatus of claim 6, comprising:

a first indicating means for sensing and transmitting to the surface a signal indicative of the rotational position of said cam follower means, and a second indicating means for sensing and transmitting to the surface a signal indicative of the rotational position of said second stop.

9. The apparatus of claim 1, comprising:

means for preventing said guide housing from rotating in the hole being drilled.

10. The apparatus of claim 1, wherein:

said second stop is located such that when said first stop engages said second stop said cam follower means is coupled to said shaft, said clutch is sufficient to rotate said cam follower means when said first stop engages said second stop to rotate said guide housing in the hole being drilled when said shaft is rotated.

11. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be moved to a forward drilling position relative to said guide housing and to a rearward shifting position relative to said guide housing, a cam follower means surrounding said shaft and being rotatable about said shaft, a cam ring comprising cam means supported in said guide housing around said shaft for rotation relative to said guide housing and relative to said shaft, said cam follower means being movable longitudinally with said shaft relative to said cam ring, a clutch for coupling said cam follower means to said shaft to prevent rotation of said cam follower means relative to said shaft when said shaft is in said shifting position such that said cam follower means may be rotated with said shaft relative to said cam ring, when said shaft moves toward said forward drilling position, said clutch allows said cam follower means to be uncoupled from said shaft such that in said forward drilling position of said shaft, said cam follower means engages said cam means of said cam ring and causes said axis of said guide housing to shift relative to said axis of said shaft to cause the direction of drilling by said shaft and said cutting means to change, a first stop coupled to said cam ring, a second stop coupled to said cam ring forward of said first stop and angularly spaced from said first stop relative to said axis of said cam ring such that in said shifting position, said shaft may move said cam follower means to a first engaging position to engage said first stop when said shaft and cam follower means are moved forward for rotating said cam ring and hence said cam means to a desired angular position relative to said guide housing, in said shifting position, said shaft may rotate said cam follower means to a second engaging position to engage said second stop when said shaft and cam follower means are moved forward, in said second engaging position said cam follower means is moved forward sufficient to be uncoupled from said shaft but not enough to significantly move said axis of said guide housing out of alignment with the axis of said shaft.

12. The apparatus of claim 11, comprising:

a second clutch coupled to said guide housing and to said cam ring for locking said cam ring to said guide housing during drilling operations and for releasing said cam ring from said guide housing for allowing said shaft and cam follower means to rotate said cam ring to a desired angular position.

13. The apparatus of claim 11, wherein:

said shaft comprises first and second shaft members with one of said shaft members having a central opening at one end and the other of said shaft members having an end located in said central opening such that said first and second shaft members may move toward and away from each other, and means for preventing said first and second shaft members from rotating relative to each other.

14. The apparatus of claim 11, wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

15. The apparatus of claim 11, comprising:

a first indicating means for sensing and transmitting to the surface a signal indicative of the rotational position of said cam follower means, and a second indicating means for sensing and transmitting to the surface a signal indicative of the rotational position of said first and second stops.

16. The apparatus of claim 13, wherein:

said shaft is defined as a drill shaft having said forward end and a rear end opposite said forward end, a front shaft support housing coupled to said guide housing with said drill shaft extending through said front shaft support housing, at least one cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

17. The apparatus of claim 13, comprising:

a first indicating means for sensing and transmitting to the surface a signal indicative of the rotational position of said cam follower means, and a second indicating means for sensing and transmitting to the surface a signal indicative of the rotational position of said first and second stops.

18. The apparatus of claim 16, comprising:

a first indicating means for sensing and transmitting to the surface a signal indicative of the rotational position of said cam follower means, and a second indicating means for sensing and transmitting to the surface a signal indicative of the rotational position of said first and second stops.

19. The apparatus of claim 11, comprising:

means for preventing said guide housing from rotating in the hole being drilled.

20. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be moved to a forward drilling position relative to said guide housing and to a rearward shifting position relative to said guide housing, a cam follower means surrounding said shaft and being rotatable about said shaft, a cam ring comprising cam means fixed to in said guide housing around said shaft, said cam follower means being movable longitudinally with said shaft relative to said cam ring, a clutch for coupling said cam follower means to said shaft to prevent rotation of said cam follower means relative to said shaft when said shaft is in said shifting position such that said cam follower means may be rotated with said shaft, when said shaft moves toward said forward drilling position, said clutch allows said cam follower means to be uncoupled from said shaft such that in said forward drilling position of said shaft, said cam follower means engages said cam means of said cam ring and causes said axis of said guide housing to shift relative to said axis of said shaft to cause the direction of drilling by said shaft and said cutting means to change, a cam follower stop coupled to said cam follower, a ring stop coupled to said cam ring at a given longitudinal position such that when engaged by said cam follower stop said clutch is still engaged with said shaft, said clutch is sufficient to rotate said cam follower means when said cam follower stop is engaged with said ring stop to rotate said guide housing in the hole being drilled when said shaft is rotated.

21. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, cam means coupled to said guide housing around said shaft and being rotatable relative to said guide housing, a cam follower means surrounding said shaft and being rotatable relative to said shaft, said cam follower means being movable longitudinally with said shaft relative to said cam means, a clutch for coupling said cam means to said shaft to prevent rotation of said cam means relative to said shaft when said shaft is in said shifting position such that said cam follower means may be rotated with said shaft relative to said guide housing to allow said cam follower means to rotate said cam follower means to a selected angular position relative to said guide housing, when said shaft moves toward said forward drilling position, said clutch allows said cam follower means to be uncoupled from said shaft such that in said forward drilling position of said shaft, said cam follower means engages said cam means and causes said axis of said guide housing to shift relative to said axis of said shaft to cause the direction of drilling by said shaft and said cutting means to change, a ring rotatably supported in said guide housing forward of said cam means, a first stop coupled to said cam follower means, a second stop coupled to said ring forward of said cam follower means such that said shaft may move said cam follower means and hence said first stop to an engaging position sufficient to engage said second stop when said shaft is moved forward, in said engaging position, said cam follower means is moved forward sufficient to be uncoupled from said shaft but not far enough to significantly move said axis of said guide housing out of alignment with the axis of said shaft, and a third stop coupled to said ring forward of said cam follower longitudinally positioned to stop longitudinal displacement between cam follower and shaft such that said clutch is still engaged allowing shaft to rotate said ring, a second clutch for removably coupling said ring to said guide housing during drilling operations and for releasing said ring from said guide housing for allowing said shaft and said cam follower means to rotate said ring and hence said second stop to a desired angular position.

22. The apparatus of claim 21, wherein:

said shaft comprises first and second shaft members with one of said shaft members having a central opening at one end and the other of said shaft members having an end located in said central opening such that said first and second shaft members may move toward and away from each other, and means for preventing said first and second shaft members from rotating relative to each other.

23. The apparatus of claim 21, wherein:

said cam means comprises a central axis with surrounding wall structure, an aperture formed through said wall structure transverse to said central axis of said cam means, brake means comprising a piston located in said aperture at a position located to be moved outward against said guide housing by said cam follower means to prevent rotation of said cam means when said cam follower means engages said cam means for causing said axis of said guide housing to shift relative to said axis of said shaft.

24. The apparatus of claim 21, wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

25. The apparatus of claim 21, comprising:

a first indicating means for sensing and transmitting to the surface a signal indicative of the rotational position of said cam follower means, and a second indicating means for sensing and transmitting to the surface a signal indicative of the rotational position of said second and third stops.

26. The apparatus of claim 22,wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

27. The apparatus of claim 22, comprising:

a first indicating means for sensing and transmitting to the surface a signal indicative of the rotational position of said cam follower means, and a second indicating means for sensing and transmitting to the surface a signal indicative of the rotational position of said second and third stops.

28. The apparatus of claim 26, comprising:

a first indicating means for sensing and transmitting to the surface a signal indicative of the rotational position of said cam follower means, and a second indicating means for sensing and transmitting to the surface a signal indicative of the rotational position of said second and third stops.

29. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, cam means coupled to said guide housing around said shaft, said cam means comprising an annular member having a given axis with said annular member comprising wall structure defining a conical shaped surface having an axis offset from said given axis, a cam follower means coupled to a cam follower housing which surrounds said shaft, said cam follower being disengaged from said cam means when said shaft is in said shifting position, said cam follower housing and said cam follower means being rotatable together relative to said guide housing when said shaft is in said shifting position, said cam follower being movable longitudinally with said shaft relative to said cam follower housing and relative to said cam means, a clutch for coupling said cam follower housing to said shaft to prevent rotation of said cam follower means relative to said shaft when said shaft is in said shifting position such that said cam follower housing and hence said cam follower means may be rotated with said shaft relative to said cam means to allow said cam follower means to engage said cam means at a selected angular position around said shaft when said shaft is moved to said forward drilling position, when said shaft moves toward said forward drilling position, said clutch allows said cam follower means housing to be uncoupled from said shaft such that in said forward drilling position of said shaft, said cam follower means engages said cam means and causes said axis of said guide housing to shift relative to said axis of said shaft to cause the direction of drilling by said shaft and said cutting means to change.

30. The apparatus of claim 29, wherein:

said shaft comprises first and second shaft members with one of said shaft members having a central opening at one end and the other of said shaft members having an end located in said central opening such that said first and second shaft members may move toward and away from each other, and means for preventing said first and second shaft members from rotating relative to each other.

31. The apparatus of claim 29, wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

32. The apparatus of claim 29, comprising:

a first indicating means for sensing and transmitting to the surface a signal indicative of the rotational position of said cam follower means, and a second indicating means for sensing and transmitting to the surface a signal indicative of the rotational position of said cam means.

33. The apparatus of claim 30, wherein:

said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

34. The apparatus of claim 30, comprising:

a first indicating means for sensing and transmitting to the surface a signal indicative of the rotational position of said cam follower means, and a second indicating means for sensing and transmitting to the surface a signal indicative of the rotational position of said cam means.

35. The apparatus of claim 33, comprising:

a first indicating means for sensing and transmitting to the surface a signal indicative of the rotational position of said cam follower means, and a second indicating means for sensing and transmitting to the surface a signal indicative of the rotational position of said cam means.

36. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, means for shifting the axis of said guide housing relative to the axis of said shaft while said apparatus is drilling forward, said shaft comprises first and second shaft members with one of said shaft members having a central opening at one end and the other of said shaft members having an end located in said central opening such that said first and second shaft members may move toward and away from each other, and means for preventing said first and second shaft members from rotating relative to each other.

37. An apparatus for drilling a hole in the earth, comprising:

a guide housing having a given axis, a shaft extending through said guide housing, said shaft having a central axis and a forward end, drill cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, said shaft is defined as a drill shaft having said forward end and a rear end opposite said forward end, a front shaft support housing coupled to said guide housing with said drill shaft extending through said front shaft support housing, at least one side cutting means coupled to a cutter shaft supported by said front shaft support housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations and to cut a guide slot in the hole being drilled, and means coupled to said apparatus rearward of said front shaft support housing which extends into said guide slot as said apparatus is moved in the hole being drilled.

38. An apparatus for drilling a hole in the earth, comprising:

a guide housing having a given axis, a drill shaft extending through said guide housing, said drill shaft having a central axis and a forward end, cutting means coupled to said forward end of said shaft for drilling purposes, upon rotation of said shaft, said drill shaft being movable longitudinally relative to said guide housing such that said shaft may be movable to a forward drilling position relative to said guide housing and to a rearward shifting position relative to said guide housing, a front shaft support housing coupled to said guide housing with said drill shaft extending through said front shaft support housing, first and second spaced apart side cutting means coupled together by a first shaft supported by said front shaft support housing, said first shaft having a first axis extending transverse to said axis of said drill shaft and located on a first side of said axis of said drill shaft, third and fourth spaced apart side cutting means coupled together by a second shaft for rotation together by said second shaft, said second shaft having a second axis generally parallel to said first axis and located on a second side of said axis of said drill shaft opposite to said first side of said axis of said drill shaft, said first and third cutting means being located on one side of a plane which extends through said axis of said drill shaft transverse to said first and second axes, said second and fourth cutting means being located on a side of said plane opposite said one side of said plane, means coupled to said drill shaft for rotating said first and second shafts in opposite directions to rotate the portions of said first and third cutting means facing away from said drill shaft toward the rear end of said drill shaft and to rotate the portions of said second and fourth cutting means facing away from said drill shaft toward the rear end of said drill shaft to help move said apparatus forward during drilling operations and to cut four guide slots in the hole being drilled, and at least one guide means coupled to said apparatus rearward of said front shaft support housing which extends into at least one of said four guide slots respectively as said apparatus is moved in the hole being drilled.

39. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be moved to a forward drilling position relative to said guide housing and to a rearward shifting position relative to said guide housing, cam means coupled to said guide housing around said shaft, a cam follower coupled to a cam follower housing which surrounds said shaft, said cam follower being disengaged from said cam means when said shaft is in said shifting position, said cam follower housing and said cam follower being rotatable together relative to said guide housing when said shaft is in said shifting position, said cam follower means being movable longitudinally with said shaft relative to said follower housing and relative to said cam means, a clutch for coupling said cam follower housing to said shaft when said shaft is in said shifting position such that said cam follower housing and hence said cam follower may be rotated with said shaft relative to said cam means to allow said cam follower to engage said cam means to a selected angular position around said shaft when said shaft is moved to said forward drilling position, when said shaft moves toward said forward drilling position, said clutch allows said cam follower housing to be uncoupled from said shaft such that in said forward drilling position of said shaft, said cam follower engages said cam means and causes said axis of said guide housing to shift relative to said axis of said shaft to cause the direction of drilling by said shaft and said cutting means to change, a first indicating means for sensing and transmitting to the surface a signal indicative of the rotational position of said cam follower means, and a second indicating means for sensing and transmitting to the surface a signal indicative of the rotational position of said guide housing.

40. An apparatus for drilling a hole in the earth, comprising:

a housing having a given axis, a drill shaft extending through said housing, said drill shaft having a central axis, a forward end and a rear end opposite to said forward and, drill cutting means coupled to said forward end of said drill shaft for drilling purposes, upon rotation of said drill shaft, at least one side cutting means coupled to a cutter shaft supported by said housing, said cutter shaft having an axis extending transverse to said axis of said drill shaft and located on one side of said axis of said drill shaft, means coupled to said drill shaft for rotating said cutter shaft in a direction to rotate the portion of said side cutting means facing away from said drill shaft toward the rear end of said drill shaft to help move said apparatus forward during drilling operations.

41. The apparatus of claim 40, wherein:

said side cutting mean is located to cut a guide slot in the hole being drilled, and means coupled to said apparatus rearward of said front shaft support housing which extends into the guide slot as said apparatus is moved in the hole being drilled.

42. An apparatus for drilling a hole in the earth, comprising:

a housing having a given axis, a drill shaft extending through said housing, said drill shaft having a central axis, a forward end and a rear end opposite said forward end, cutting means coupled to said forward end of said drill shaft for drilling purposes, upon rotation of said drill shaft, first and second spaced apart side cutting means coupled together by a first shaft supported by said housing, said first shaft having a first axis extending transverse to said axis of said drill shaft and located on a first side of said axis of said drill shaft, third and fourth spaced apart side cutting means coupled together by a second shaft for rotation together by a second shaft supported by said housing, said second shaft having a second axis generally parallel to said first axis and located on a second side of said axis of said drill shaft opposite to said first side of said axis of said drill shaft, said first and third cutting means being located on one side of a plane which extends through said axis of said drill shaft transverse to said first and second axes, said second and fourth cutting means being located on a side of said plane opposite said one side of said plane, means coupled to said drill shaft for rotating said first and second shafts in opposite directions to rotate the portions of said first and third cutting means facing away from said drill shaft toward the rear end of said drill shaft and to rotate the portions of said second and fourth cutting means facing away from said drill shaft toward the rear end of said drill shaft to help move said apparatus forward during drilling operations.

43. The apparatus of claim 42, wherein:

said side cutting means are located to cut four guide slots in the hole being drilled, and at least one guide means coupled to said apparatus which extends into at least one of said guide slots as said apparatus is moved in the hole being drilled.

44. An apparatus for drilling a hole in the earth, comprising:

a guide housing having a given axis, a shaft extending through said guide housing, said shaft having a central axis and a forward end, a drill rig stem connected to rear end of said shaft, cutting means coupled to said forward end of said shaft for drilling purposes upon rotation and thrust of said shaft by means of said drill rig stem, said shaft being movable longitudinally relative to said guide housing by means of said drill rig stem such that said shaft may be movable to a forward position relative to said guide housing and to a rearward position relative to said guide housing, said guide housing being movable forward and rearward by means of said drill rig stem, means located in said guide housing to vary the alignment of said axis of said guide housing relative to axis of said shaft during longitudinal displacement of said shaft relative to said guide housing for locating said axis of said guide housing in at least first and second positions relative to said axis of said shaft, said shaft being adapted to rotate said cutting means during and after longitudinal displacement, in said first position, said axis of said housing generally coincides with said axis of said shaft to allow said apparatus to drill straight, in said second position, said axis of said guide housing is shifted relative to said axis of said shaft to cause the direction of said apparatus to turn while drilling operations are carried out.

* * * * *

UNITED STATES PATENT AND TRADEMARK OFFICE

CERTIFICATE OF CORRECTION

PATENT NO. : 6,082,470
DATED : July 4,2000
INVENTOR(S) : Charles T. Webb; Roy L. Chandler It is certified that error appears in the above-indentified patent and that said Letters Patent is hereby corrected as shown below:

In the drawings, sheet 7, Fig. 18, change reference numeral "233", to --133--.

Column 16, line 5, cancel "495", and insert --495T--.

In the drawings, sheet 14, Fig. 40, change the lower reference numeral "495" to --495T--.

Column 20, line 5, cancel "rotational", and insert --rotationally--.

Column 22, line 5, cancel "773A", and insert --773--.

Column 22, line 7, cancel "773A", and insert --773--.

Column 24, line 19, cancel ". The", and insert --, the--.

Column 31, line 18 which starts with "a cam ring", cancel --in--.

Column 32, line 2, after "cam", cancel --follower-- which extends into line 3.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*